United States Patent [19]

Hershberger

[11] 4,323,731

[45] Apr. 6, 1982

[54] VARIABLE-ANGLE, MULTIPLE CHANNEL AMPLITUDE MODULATION SYSTEM

[75] Inventor: David L. Hershberger, Quincy, Ill.

[73] Assignee: Harris Corporation, Melbourne, Fla.

[21] Appl. No.: 102,633

[22] Filed: Dec. 11, 1979

Related U.S. Application Data

[63] Continuation-in-part of Ser. No. 970,652, Dec. 18, 1978, Pat. No. 4,225,751.

[51] Int. Cl.[3] ..... H04H 5/00

[52] U.S. Cl. ..... 179/1 GS; 455/114; 332/21; 329/167

[58] Field of Search ..... 179/1 GS; 455/114, 109, 455/108; 329/50, 135, 167; 332/17, 21, 22, 23 A

[56] References Cited

U.S. PATENT DOCUMENTS

| | | | |
|---|---|---|---|
| 3,067,293 | 12/1962 | Moore | 179/1 GS |
| 3,295,072 | 12/1966 | Van Kessel | 455/109 |
| 3,378,772 | 4/1968 | Van Kessel et al. | 455/109 |
| 3,449,715 | 6/1969 | Van Kessel | 455/109 |
| 4,194,154 | 3/1980 | Kahn | 455/114 |
| 4,225,751 | 9/1980 | Hershberger | 179/1 GS |

*Primary Examiner*—Douglas W. Olms
*Attorney, Agent, or Firm*—Yount & Tarolli

[57] ABSTRACT

A compatible AM stereo system employing a modified quadrature modulation scheme where the gain in the quadrature-phased channel, and thus the phase angle between the L and R modulated phase components of the composite modulated signal, is dynamically varied in accordance with changing modulation conditions. The average phase angle between the L and R modulated phase components is much greater than was previously possible in fixed gain systems, thus signal-to-noise ratio (SNR) in stereophonic receivers is improved. In the transmitter (FIGS. 3, 7A and 7B), a matrix circuit (40, 188) adds and subtracts L and R audio signals to produce sum (L+R) and difference (L−R) signals. An analog divider (54; 194, 200) adjusts the gain of the (L−R) signal in accordance with a gain control signal $A_Q$. The (L+R) and gain adjusted (L−R) signals are transmitted on two quadrature-phased carriers by a quadrature AM (QAM) transmitter (50, 160). A distortion estimator (56, 190, FIGS. 5A and 5B) calculates the amount of distortion which the envelope of the composite modulated signal will produce in a conventional monophonic receiver and dynamically adjusts the gain control signal $A_Q$ to maximize gain without exceeding predetermined distortion constraints. A circuit (60, 210, FIGS. 9 and 10) generates a pilot signal and modulates it with the dynamically varying gain control. This pilot signal is added to, and thus transmitted with, the gain adjusted (L−R) signal. In one transmitter embodiment (FIGS. 7A and 7B), a circuit (156, FIG. 8) is provided for compressing low amplitude audio signals so as to further improve SNR. A signal indicative of the amounts of compression is also modulated onto the pilot signal, and thus transmitted to the receiver. A filter network (154) provides a gap in the low frequency portion of the (L−R) signal into which the pilot signal may be inserted, and processes the (L+R) and (L−R) signals so that no loss in bass occurs as a result of this filtering. Stereophonic receivers (FIGS. 11-13) are disclosed which demodulate the pilot signal and control the gain of the recovered (L+R) and (L−R) signals in accordance therewith so as to track the varying phase angle and signal compression of the composite modulated signal, and thus optimally recover the L and R audio signals in their original form. The system may easily be converted into an improved independent sideband (ISB) system by the insertion of appropriate phase delays in the (L+R) and (L−R) signal paths.

35 Claims, 47 Drawing Figures

DISTORTION ESTIMATOR ATTACK/RELEASE CIRCUIT

LIMITER CONTROL

AM PILOT DET. AND DEMOD

AM PILOT SIG. GEN. AND MODULATOR

FM PILOT SIG. GEN AND MODULATOR

AC COUPLING ADAPTER

AC COUPLING ADAPTER

INTEGRATOR

VARIABLE GAIN AMPLIFIER (VGA)

DISTORTION ESTIMATOR

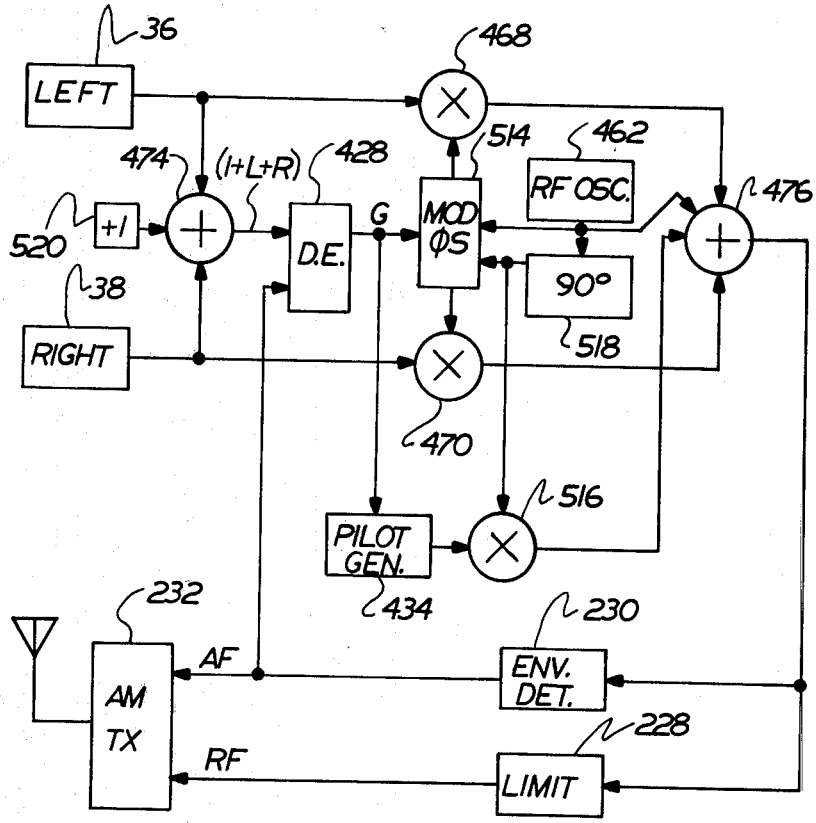
FIG. 29
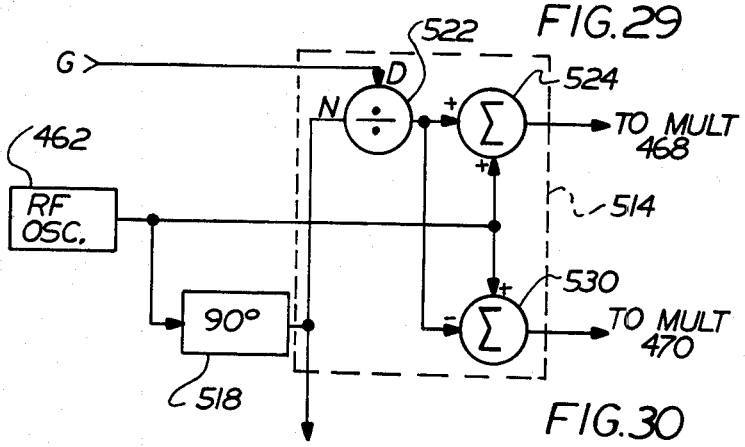
FIG. 30
FIG. 31
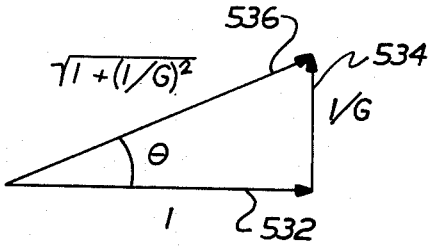
$\Theta = \text{ARCTAN } 1/G$
$\text{SECANT } \Theta = \sqrt{1+(1/G)^2}$

VARIABLE-ANGLE, MULTIPLE CHANNEL AMPLITUDE MODULATION SYSTEM

This is a continuation-in-part of Ser. No. 970,652, filed Dec. 18, 1978, now U.S. Pat. No. 4,225,751.

BACKGROUND AND FIELD OF THE INVENTION

The present invention relates to multichannel communications systems, and more particularly to a compatible AM stereo system employing a modulated signal having differently phased carriers, where the phase angle between the carriers is dynamically varied.

Interest in transmitting stereophonic information over the AM frequency band has existed for more than 50 years, nearly as long as commercial AM broadcasting, itself, has existed. During this time, many different schemes have been suggested for communicating the stereophonically-related audio signals from the broadcasting station to the radio receivers. None of these schemes, however, has met with general approval by the broadcasting community since none has demonstrated a clear superiority over the others.

A number of criteria are commonly used in comparing the performance of the various systems. Generally stated, these criteria include the quality of stereophonic reproduction in stereophonic receivers and the compatibility of the transmitted stereo signal for reception by currently available (monophonic) AM receivers. In addition, it is desired that the stereophonic signals transmitted should not occupy any greater RF bandwidth than that presently allocated for monophonic AM transmission.

More specifically, the stereophonic performance of an acceptable AM stereo system should be such that, upon reception, the signal-to-noise ratio is as great as possible. In any event, it should not be significantly degraded as compared to reception obtainable with current monophonic systems. Also, the distortion introduced by the transmission and reception of the stereo signal should be minimal. Finally, the separation between the stereophonically related signals (usually referred to as the left (L) and right (R) signals) should be as great as possible.

With respect to mono-compatibility, any acceptable AM stereo system must be fully compatible with monophonic receivers currently available on the market. In other words, the detection of the composite stereo signal with the monophonic envelope detectors and product detectors currently in use should produce a signal corresponding to the sum (L+R) of the two stereophonically related signals, without noticeable distortion. Additionally, the loss in the loudness of the received signal in monophonic receivers due to the stereophonic nature of the broadcast signal should be as low as possible.

In a system proposed by Harris Corporation (and disclosed in the co-pending U.S. application of Leitch, Ser. No. 019,837) several differently-phased carriers are separately modulated and then added together to produce the composite modulated signal for transmission. One of the carrier signals is modulated by the L (left) audio signal, whereas the other carrier is modulated by the R (right) audio signal. In this system, referred to as the compatible phase multiplex system, the angle between the two modulated carriers (referred to occasionally hereinafter as "modulated phase components") is set to a value of around 30°. In another method of generating the same composite modulated signal, a conventional quadrature AM transmitter is used. A signal corresponding to the sum of L and R audio signals is used to modulate the in-phase channel, and a signal corresponding to the weighted difference between the L and R audio signals is used to modulate the quadrature-phase signal. The angle of 30° between the L and R modulated phase components in the resulting composite modulated signal is established by appropriate weighting of the quadrature-phase modulating signal.

Signal-to-noise ratio (SNR) in stereophonic receivers for receiving this signal is dependent upon the phase angle employed, and would be greater at greater phase angles. It would therefore be desirable to utilize a phase angle which is greater than 30° in order to improve SNR in stereophonic receivers. Unfortunately, to do so would increase distortion in conventional monophonic receivers to above acceptable levels.

BRIEF SUMMARY OF THE INVENTION

It is an object of the present invention to provide a compatible AM stereo system which increases SNR in stereophonic receivers without increasing worst case distortion in monophonic receivers.

It is another object of the present invention to provide a compatible AM stereo system wherein the phase angle between modulated phase components of the composite stereo signal can be increased without a commensurate increase in worst case distortion in monophonic receivers.

It is yet another object of the present invention to provide a system for generating a composite modulated signal including several modulated phase components, wherein the phase angle between the modulated phase components may be dynamically varied in any desired manner.

It is still another object of the present invention to provide stereophonic receivers for receiving and demodulating a composite modulated signal including several modulated phase components, wherein the receiver is controllable to provide optimum demodulation of a signal having any given phase angle between the modulated phase components thereof.

It is even another object of the present invention to provide a system wherein a stereophonic receiver may be controlled from a stereophonic transmitter so as to automatically track variations in the stereophonic signal transmitted to the receiver from the transmitter.

It is a further object of the present invention to provide a stereophonic system wherein a modulated pilot signal is transmitted in the composite modulated signal along with the stereophonic information, without loss in any stereophonic information due to the inclusion of the modulated pilot signal.

It is another object of the present invention to provide a compatible AM stereo system wherein SNR is further improved by compressing low level signals at the transmitter and automatically expanding them by corresponding amounts at the receiver.

It is another object of the present invention to provide a circuit for estimating the amount of distortion in the envelope of the composite modulated signal and for controlling the phase angle between the modulated phase components thereof so as to limit the distortion to a preselected maximum.

It is still a further object of the present invention to provide a receiver for receiving a stereophonic signal including a modulated pilot signal, wherein the pilot signal is eliminated from the stereophonic signal by a signal cancellation technique.

It is another object of the present invention to also provide an independent sideband AM stereo system which achieves each of the foregoing objects.

The present invention provides an improved system wherein the phase angle between the two modulated phase components is dynamically varied in such a manner as to provide optimum stereophonic and monophonic performance under varying modulation conditions. The modulating system includes means for monitoring the amount of distortion which will be present when the signal is demodulated in a conventional monophonic receiver. The phase angle between the modulated phase components is then adjusted so as to be as close to 90° as possible, without causing the distortion to exceed predetermined constraints.

To remain within these constraints, the phase angle will be reduced to as little as 30° under certain modulation conditions. Often, though, the phase angle will be much larger. When at these larger phase angles, however, signal-to-noise ratio will be improved in stereophonic receivers.

In order to vary the phase angle between the modulated phase components, the disclosed embodiments utilize quadrature modulation and vary the weighting of the quadrature-phase component in accordance with the desired phase angle. Thus, the L and R signals are matrixed to produce (L+R) and (L−R) signals. The (L+R) signal is used to modulate the in-phase component of the composite modulated signal, whereas the (L−R) signal is amplitude adjusted in accordance with the desired phase angle, and then used to modulate the quadrature-phase component of the composite modulated signal.

Optimum demodulation of the composite modulated signal at a subsequent receiver can only be provided when the receiver is provided with information as to the dynamic variations of the phase angle between the two phase components of the modulated signal. In the disclosed embodiments, the modulator provides a low frequency pilot signal which is modulated in accordance with this information. This pilot signal is added to the quadrature channel and is thus transmitted along with the composite modulated signal. The receiver extracts from the pilot signal the information indicative of the dynamically varying phase angle, and utilizes that information to optimally recover the L and R signals.

The present invention also contemplates that the pilot signal which is used to communicate the phase information to the receiver will also be modulated with other signal processing information. Preferably, the modulator will include signal compression circuitry for compressing the dynamic range of the audio signals by increasing the amplitude of low level L and R signals to thereby further increase the signal-to-noise ratio of the system. The pilot signal is then modulated with the information indicative of the amount of compression of the signals, so that the receiver can expand the signals by a corresponding amount by reducing their gain to thereby recover the signals in their original form.

Moreover, a modified independent-sideband (ISB) system may be derived from the disclosed system simply by introducing a relative phase shift of 90° between the (L+R) and (L−R) audio signals at the transmitter, with a complimentary phase shift of −90° being provided at the receiver. The composite modulated signal communicated between the transmitter and receiver in this system will have the L information predominantly carried in one sideband and the R information predominantly carried in the other. Due to the dynamic variation in the phase angle, however, the envelope of the composite modulated signal will again never differ from the desired compatible form by more than a preselected amount.

BRIEF DESCRIPTION OF THE DRAWINGS

The foregoing and other aspects and advantages of the present invention will become more readily apparent from the following detailed description, as taken in conjunction with the accompanying drawings, wherein:

FIG. 29 is a block diagram of a modulator/transmitter similar to that of FIG. 25, but where a modified phase shifter is employed;

FIG. 30 is a block diagram of one embodiment of a modified phase shifter such as could be used in the modulator/transmitter of FIG. 29;

FIG. 31 is a vector diagram useful in understanding the operation of the phase shifter of FIG. 30;

DETAILED DESCRIPTION OF THE DRAWINGS

Figure 1:
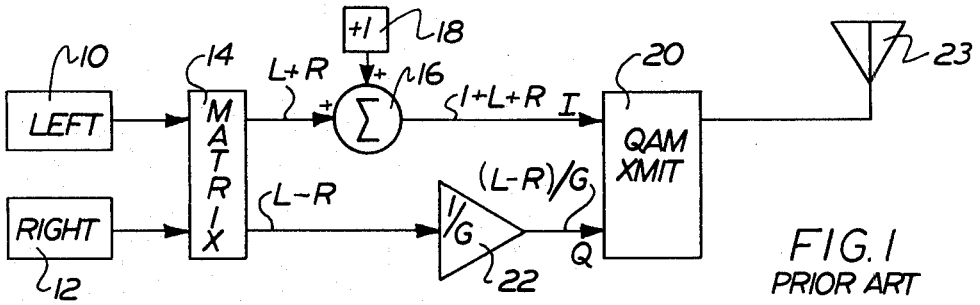
FIG. 1 PRIOR ART
FIG. 1 is a block diagram of a prior art modulator/-transmitter system.

There is illustrated in FIG. 1 a block diagram of a prior art modulator/transmitter utilizing a modified quadrature modulation technique. Two signal sources 10 and 12 produce the stereophonically related left (L) and right (R) audio signals which are to be communicated to the receiving station. The L and R audio signals are supplied to a matrix circuit 14 which adds them together to produce a sum signal (L+R) and subtracts them from one another to produce a difference signal (L−R). A DC component is added to the (L+R) signal by means of a signal adder circuit 16 which sums the (L+R) signal with a DC signal supplied by a circuit 18. The output of signal adder 16 has the form (1+L+R) and is supplied to the in-phase modulating input I of a QAM transmitter 20. The (L−R) signal, on the other hand, is supplied to the quadrature phase modulating input Q through a gain circuit 22. The output of gain circuit 22 has the form of (L−R)/G. The QAM transmitter 20 modulates each of two quadrature-phased carrier signals in accordance with a corresponding one of the two modulating signals, linearly combines (i.e. adds) the two resulting modulated carrier signals, and transmits the resulting signal via an antenna 23.

Both synchronous and nonsychronous forms of stereophonic receivers may be constructed which will be capable of separating the sum and difference signals from the composite modulated signal as transmitted by the transmitter of FIG. 1. The composite modulated signal may also be received by conventional monophonic receivers. Monophonic receivers using product detectors will synchronously detect the in-phase component of a composite modulated signal, and will thus automatically recover the sum signals (L+R) alone. Monophonic signals utilizing envelope detection techniques, however, will experience some amount of distortion due to the existence of the quadrature-phase component. This is because the envelope of the composite modulated signal will represent a vector addition of the in-phase and quadrature-phase components of the composite modulated signal. The envelope thus differs in form from the desired (1+L+R) form by an amount which varies with the amplitude of the (L−R) component.

Figure 2A:
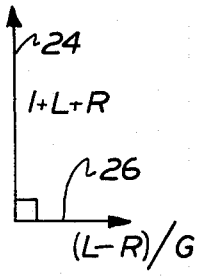
FIGS. 2A and 2B are vector diagrams useful in understanding the nature of the modulated signals provided by the circuitry of FIG. 1.
Figure 2B:
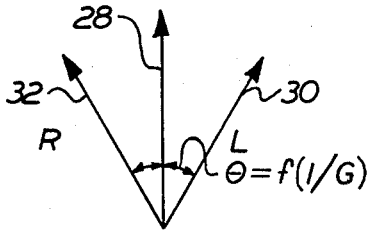

This may be more readily understood through reference to FIGS. 2A and 2B, which are vectoral representations of two different but equivalent characterizations of the composite modulated signal transmitted by the prior art modulator of FIG. 1. In FIG. 2A, the composite modulated signal is characterized as a combination of an in-phase vector 24 and a quadrature-phase vector 26. The composite modulated signal $V_c$ may thus be described by the mathematical expression:

$$V_c=[1+L+R]\ \text{Cos}\ w_c t+[(L-R)/G]\ \text{Sin}\ w_c t. \quad (1)$$

Where $w_c$ is the carrier frequency, in radians per second. This mathematical expression can be shown to be equivalent to the alternative expression:

$$V_c=[(L)\ \text{Cos}\ (w_c t-\theta)+(R)\ \text{Cos}\ (w_c t+\theta)]\ \text{Secant}\ \theta+\text{Cos}\ w_c t. \quad (2)$$

Where:

$$\theta=f(1/G)=\text{arctan}\ (1/G) \quad (3)$$

FIG. 2B provides a vectoral representation of equation 2, and illustrates the second manner in which the composite modulated signal may be characterized. In this vector diagram, the vector 28 represents a continuous, unmodulated carrier signal, whereas vectors 30 and 32 represent differently-phased carriers modulated with the L and R signals. These modulated carriers are often referred to herein as modulated phase components. These phase components are phased at equal and opposite angles of $\theta$ on either side of the carrier vector 28. As indicated at (3) above, the angle separating the L and R vectors will vary with the gain factor 1/G of gain circuit 22 of FIG. 1.

The envelope of the composite modulated signal will have an amplitude which is the vector sum of vectors 24 and 26 of FIG. 2A, which, of course, is equivalent to the vector sum of vectors 28, 30, and 32 of FIG. 2B (since both vector diagrams characterize the same signal). This amplitude function will identically represent (1+L+R) when the gain factor 1/G has a value of 0 or when L=R. When 1/G=0 the vector 26 of the vector diagram of FIG. 2A will be nonexistent, and the angle between the L and R vectors 30 and 32 of the FIG. 2B vector diagram will be 0 so that the two vectors are coextensive. In either event, only the L+R component will remain. As the gain factor 1/G increases from 0 to 1 (alternatively stated, as the phase angle between the L and R vectors 30 and 32 increases from 0 to 90 degrees) the amount by which the envelope will differ from the (1+L+R) value will similarly increase, producing a corresponding increase in distortion in monophonic receivers.

In the Harris CPM system, the phase angle between the L and the R vectors is set equal to 30°. In this event, the amount of distortion in a monophonic receiver employing an envelope detector will never exceed acceptable limits. Furthermore, under many signal circumstances, the amount of distortion will be significantly below this limit. Thus, when the L and the R signals are essentially identical, the L-R component will virtually vanish, resulting in the demodulation of an essentially distortion free signal by an envelope detector. In other words, as the content of the L and R signals changes, the amount of distortion experienced in an envelope detector will also change.

The signal-to-noise ratio (SNR) in stereophonic receivers is also affected by the phase angle between the L and R vectors, but in a different direction. The signal-to-noise ratio, unlike distortion, will be at its optimum (highest) value when the phase angle between the L and R vectors is 90°, and will deteriorate as the phase angle is reduced towards zero. To improve signal-to-noise ratio, then, it would be desirable to increase the phase angle above the 30° value used in the CPM system. To do so, however, would result in a commensurate increase in worst case distortion in monophonic receivers to above acceptable limits.

In the system in accordance with the present invention, signal-to-noise ratio in stereophonic receivers is improved without a commensurate increase in worst case distortion. This is accomplished by including circuitry at the transmitter for continuously monitoring the actual level of distortion which will be produced in a monophonic receiver by the envelope of the composite modulated signal, and then setting the phase angle between the L and R vectors as close to 90° as possible without causing that distortion to exceed the worst case limit. The phase angle is thus dynamically varied with the changing modulation conditions. Under conditions of low modulation the phase angle will always be 90° and SNR will be high. For high modulation with high amplitude (L−R), the angle, and hence SNR are reduced. However, due to the well known noise masking phenomenon, preceived SNR will be that of a static 90° system.

Figure 3:
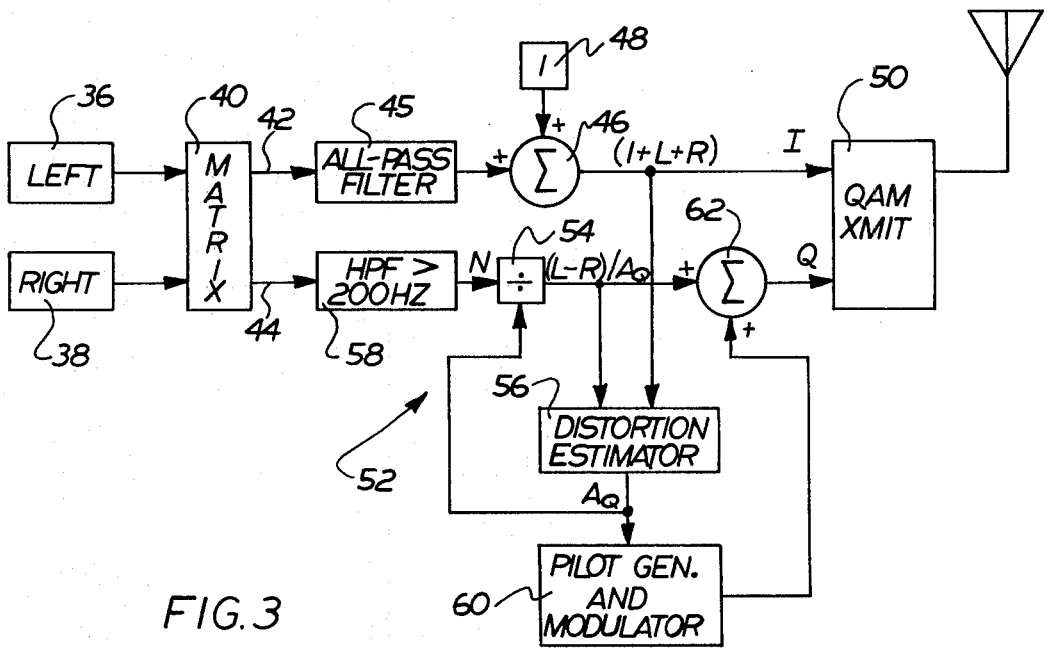
FIG. 3 is a broad block diagram of a modulator/-transmitter system in accordance with the teachings of the present invention.

FIG. 3 illustrates a modulator/transmitter in accordance with the teachings of the present invention. As in the prior art, two signal sources 36 and 38 provide two stereophonically related audio signals to a matrix circuit 40, which adds and subtracts them to respectively provide sum and difference signals along output lines 42 and 44. The sum signal is supplied to signal adder 46 through an all-pass filter 45, whose purpose will be described hereinafter. Signal adder 46 adds a DC component provided by a circuit 48 to the sum signal to produce the in-phase modulating signal, in this embodiment having essentially the same form as the in-phase modulating signal utilized in the prior art system of FIG. 1. This signal is directed to the in-phase modulating input I of a QAM transmitter 50.

The difference signal output 44 of matrix circuit 40 is connected to the quadrature-phase modulating input Q of the QAM transmitter 50 via a processing circuit 52. This processing circuit operates to change the gain of the difference signals (and thus the phase angle between the L and R vectors of the composite modulated signal) by an amount which, unlike prior art systems, will dynamically vary with the program content of the audio signals being transmitted. More specifically, the processing circuit 52 includes an analog divider circuit 54 for dividing the difference signal by a second analog signal supplied by a distortion estimator 56. If the gain control signal $A_Q$ supplied to the analog divider 54 by the distortion estimator increases, then the gain of the difference signals supplied to the Q channel of the QAM transmitter will be reduced. Similarly, if the gain control signal $A_Q$ is reduced, then the gain of the difference signal supplied to the QAM transmitter 50 will increase. It should be noted that the phase angle could also be varied by changing the gain of the (L+R) signal or by changing the gains of both the (L+R) and (L−R) signals, but by different amounts. For simplicity and improved mono-compatibility, however, it is preferred that the gain of only the (L−R) signal be changed, with the (L+R) signal being kept at a fixed gain.

The outputs of summing circuit 46 and divider circuit 54 are connected to the inputs to distortion estimator 56, which calculates the form which the envelope of the composite modulated signal will have. If this differs from the desired "compatible" form (i.e. from the 1+L+R) signal) by more than a predetermined limit (3–4%, for example), the amplitude of the gain control signal is increased so as to reduce the gain of the difference signal by the amount necessary to reduce the amount of distortion to the selected limit. If, on the other hand, the amount of distortion is sufficiently below the selected limit, then the gain control signal is permitted to decrease to a lower value, increasing the gain of the difference signal and effectively increasing the phase angle between the L and R vectors 30 and 32 of FIG. 2B. In this fashion, the distortion estimator operates to dynamically vary the gain of the quadrature channel modulating signal in accordance with a program content so that the phase angle between the L and R vectors 30 and 32 (FIG. 2B) is as great as possible without exceeding the predetermined distortion constraints. This provides optimum SNR within the distortion constraints.

In order for a stereophonic receiver to demodulate the composite modulated signal produced by the transmitter of FIG. 3 with maximum fidelity, it is necessary for the receiver to know what the phase angle between the L and R vectors is at any given time. The modulator of FIG. 3 transmits this information to the receiver via a modulated pilot signal, added to the quadrature-phase channel.

In order to make room in the frequency spectrum of the quadrature-phase channel for the insertion of the pilot signal, a high-pass filter 58 is included. This high-pass filter eliminates all frequencies below a predetermined limit (for example, 200 Hz) from the difference signal. As is well known, these lower frequencies contribute very little towards the stereophonics of the signal, and thus may be deleted without significant adverse effects to the stereophonic reception of the signal. This filter does, however, introduce significant phase shift in signals having frequencies close to the predetermined limit. The all-pass filter 45 in the sum signal path is provided to introduce a similar frequency-dependent phase shift in the sum signal. If this were not provided, the phase difference between the sum and difference signals would interfere with the de-matrixing of the signals in a stereophonic receiver. The all-pass filter does not, however, affect the amplitude versus frequency characteristics of the sum signal.

A pilot generator and modulator 60 generates a pilot signal having a medium frequency below the pass frequency of filter 58, and modulates it in accordance with the gain signal being supplied to the divider 54 from the distortion estimator 56. In the illustrated embodiment, for example, the medium frequency of the pilot signal is 80 Hz. The modulated pilot signal, which has a frequency bandwidth falling entirely within the frequency band deleted from the quadrature-phase channel, is then added to the quadrature-phase modulating channel by an adder 62.

Figure 4:
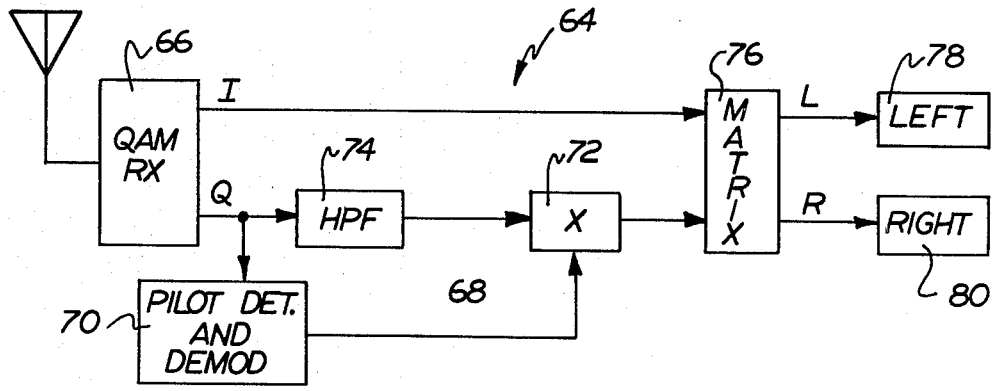
FIG. 4 is a broad block diagram of a receiver for receiving and demodulating signals generated by the circuitry of FIG. 3.

FIG. 4 illustrates a radio receiver 64 for receiving and demodulating the composite modulated signal produced by the modulator/transmitter of FIG. 3. This receiver 64 includes a conventional QAM receiver 66 for demodulating and separating out the in-phase and quadrature-phase modulating signals from the composite modulated signal. These two signals corresponds to the signal provided to the QAM transmitter 50.

The receiver also includes a circuit, generally indicated at 68, for correcting the amplitude of the quadrature-phase modulated signal in accordance with the modulation of the pilot signal. This circuit includes a pilot detector and demodulator 70 for recovering the gain control signal which had been modulated thereon by the pilot generator and modulator 60 of FIG. 3. A multiplier 72 multiplies the quadrature-phase modulating signal by the gain signal to produce a difference signal at its output having a corrected gain. A high-pass filter 74 eliminates those frequencies in the quadrature-phase modulating signal below a predetermined limit (200 Hz in the described embodiment), thus eliminating the pilot signal and passing only the difference signal to the multiplier 72. If desired, an all-pass filter may be provided in the in-phase channel to add a frequency-dependent phase shift similar to that created by the high-pass filter 74.

The recovered in-phase modulating signal, corresponding to the sum signal (1+L+R) and the gain-corrected quadrature-phase modulating signal, corresponding to the difference signal (L−R), are provided to an audio matrix circuit 76 which adds them to separate out the left audio signal L and subtracts them to separate out the right audio signal R. The DC component of the in-phase modulating signal may be eliminated in any conventional manner, as by including a DC blocking capacitor in the matrix circuit 76 or in the individual left and right utilization means 78 and 80. The utilization means 78 and 80 will usually be audio amplifiers and loudspeakers, but may, of course, also take other forms.

Figure 5A:
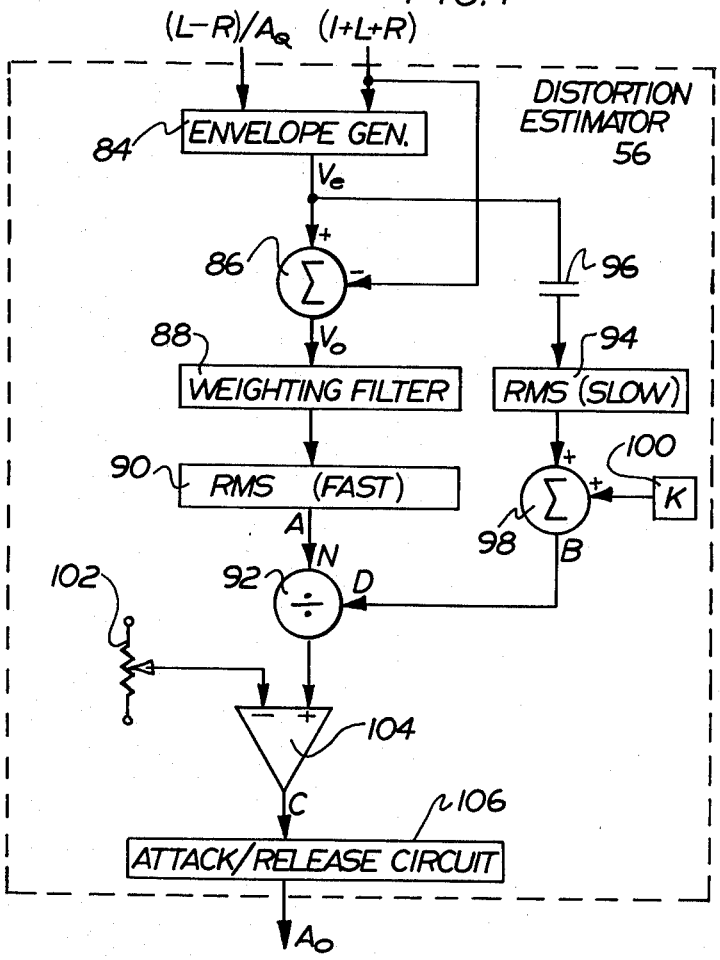
FIGS. 5A and 5B are more detailed block diagrams of the distortion estimator block of the block diagram of FIG. 3.

FIG. 5A is a more detailed block diagram of the distortion estimator 56 utilized in the modulator/transmitter of FIG. 3. As can be seen in this figure, the distortion estimator 56 includes an envelope generator 84 which responds to the sum and difference signals to generate a signal $V_e$ at its output corresponding to the vector sum thereof. More specifically, the envelope generator 84 computes the squareroot of the sum of the squares of the two input signals (L−R) and (1+L+R). This envelope generator may take any conventional form, and could, for example, be a vector module model VM 101, manufactured by Intronics. This signal $V_e$ represents the actual envelope of the composite modulated signal, as it would be detected in a monophonic receiver utilizing an envelope detector.

A signal subtractor 86 subtracts a signal indicative of the ideal compatible envelope form (1+L+R) from the actual envelope $V_e$ to produce a difference signal $V_d$ at its output. A weighting filter 88 selectively weights different frequencies in the signal $V_d$ in accordance with the sensitivity of the human ear and/or other criteria, and provides a weighted output to a fast RMS detector 90. The RMS detector 90 detects the RMS (root-mean-squared) value of the output of the weighting filter 88, to thereby provide a signal having an amplitude indicative of the amount of distortion which would be produced in a monophonic receiver by the signals then present at the input to the distortion estimator.

A divider circuit 92 divides this absolute distortion estimate by a signal indicative of the magnitude of the AC component of the envelope so as to normalize the distortion in accordance with the magnitude of the envelope and thereby provide an estimate of the percent of distortion. The signal indicative of the magnitude of the AC portion of the envelope is produced by a second RMS converter 94 which is provided with the envelope signal $V_e$ through a DC blocking capacitor 96. A signal adder 98 adds a small DC value, provided a circuit 100, to the signal at the output of the RMS converter 94 so that the input to the normalization divider 92, in the absence of modulation, does not drop to zero.

The percent distortion, as indicated by at the output of divider 92, is compared in a comparator 104 with a preset limit (for example, 3–4%) established by potentiometer 102. The output of the comparator 104 will remain low as long as the percent distortion in the envelope is below the limit set by the potentiometer 102. When the percent distortion increases above this preset limit, however, the output of comparator 104 will shift to a high level, causing an attack/release circuit 106 to increase the amplitude of the gain control signal supplied to the divider 54 (FIG. 3). Thus, an increase in distortion above the acceptable limit established by potentiometer 102 will result in a reduction in the gain of the quadrature-phase component, thereby reducing the amount of distortion in the envelope. Eventually a point will be reached at which the percent distortion is below the limit set by potentiometer 102, at which time the output of comparator 104 will again drop to a low voltage level. The attack/release circuit 106 will then stop slewing the gain control signal $A_Q$ in the positive direction, and instead will permit the gain control signal to decay with time. Therefore, if the percent distortion drops to a lower level due to a change in the program content of the signals, the gain control signal will also decay to a lower level, permitting the amplitude of the quadrature-phase component to increase. At some point, the quadrature-phase component will increase to the point where the percent distortion is again equal to the predetermined limit, resulting in the actuation of the comparator 104 and the increase in amplitude of the gain control signal. The distortion estimator 56 thus varies the gain control signal so that the percent distortion does not exceed the predetermined limit established in the potentiometer 102.

Figure 5B:
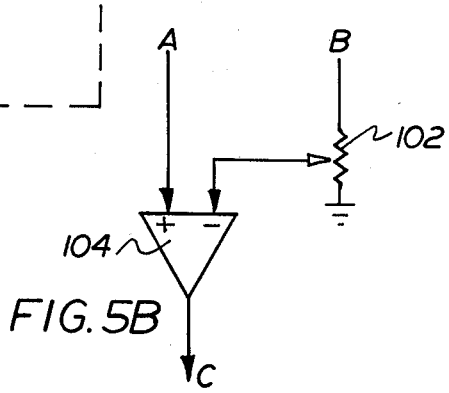

FIG. 5B illustrates an alternative arrangement for a portion of the distortion estimator 56. This alternative arrangement eliminates the need for the divider 92 for normalization of the output of RMS convertor 90. In the circuit of FIG. 5B, the potentiometer 102 is connected to the output of signal adder 98 so that the distortion limit signal provided to comparator 104 will automatically vary with the amplitude of the AC component of the envelope. This limit is then directly compared with the output of RMS converter 90 via the comparator 104. This circuit will function in the same fashion as that set forth in FIG. 5A, but does not need a divider 92 since the limit signal, instead of the distortion signal, is changed with the amplitude of the AC component of the envelope.

Figure 6:
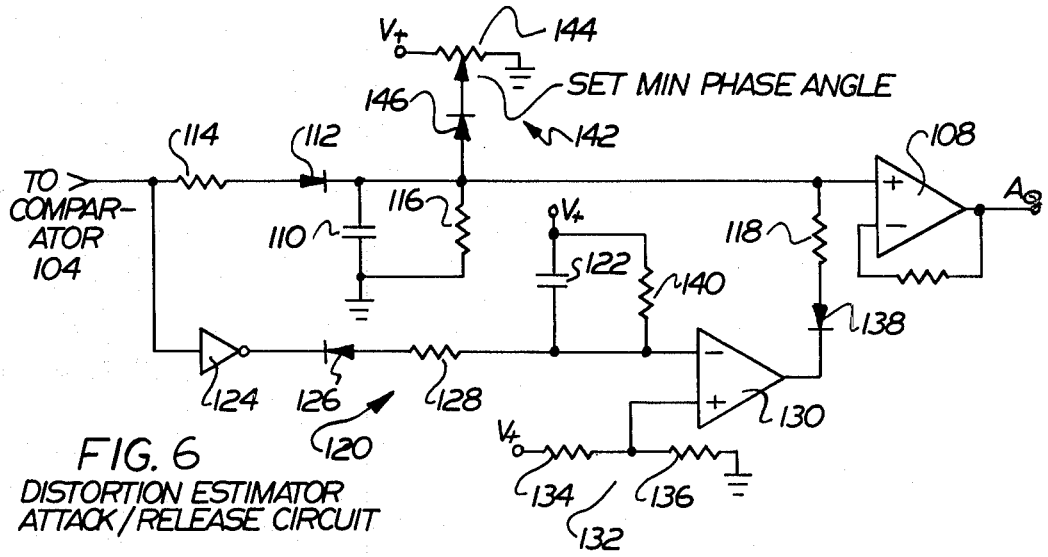
FIG. 6 is a more detailed block diagram of the attack-/release circuit of the distortion estimator of FIG. 5A.

FIG. 6 illustrates a more detailed circuit schematic of attack/release circuit 106 of the distortion estimator of FIGS. 5A and 5B. This circuit includes a capacitor 110 across which a voltage is developed representative of the gain signal to be supplied to the divider circuit 54 of FIG. 1. This gain control signal is supplied to the divider circuit 54 via a unity gain buffer 108. The comparator 104 is connected to the capacitor 110 through a resistor 114 and a diode 112. The resistor 114 sets the rate at which the voltage across capacitor 110 will increase when the output of comparator 104 goes high. This resistor therefore sets the attack time of the circuit. Preferably, the resistor 114 will be set so that the attack time of the circuit will be quite low, on the order of 20 milliseconds, for example.

The voltage across capacitor 110 decays as a result of current flow through two resistors 116 and 118. Since resistor 116 has a quite high resistance value, the decay of the voltage across capacitor 110 is essentially established by resistor 118. Decay of the voltage across capacitor 110 is prevented, during that portion of time in which the output of comparator 104 is high, by a circuit generally indicated at 120. When the output of comparator 104 goes to a high voltage level, the voltage across a capacitor 122 in circuit 120 will be charged to a ground voltage level via an inverter 124, a diode 126 and a resistor 128. Thus, since the input to inverter 124 is at a high voltage level, the output thereof will be at a low (ground) voltage level, so that the capacitor 122 will charge to a ground voltage level through the resistor 128. This resistor is selected so that this charge time is much smaller than the attack time of the attack-/release circuit. The voltage at the junction of resistor 128 and capacitor 122 is connected to a comparator 130 which compares the voltage at this node with a fixed voltage established by a resistive divider 132 including resistors 134 and 136. When the voltage across capacitor 122 charges towards a ground potential, the output of comparator 130 will shift to a high logic level. This reverse biases a diode 132 serially interconnected with the resistor 118. Since the diode 132 is reverse biased, essentially no current will flow through resistor 118 and no decay of the voltage across capacitor 110 will take place.

When the output of comparitor 104 returns to a low logic level, indicating that the distortion has dropped to acceptable levels, the output of comparator 130 will remain at a high logic level until the voltage across capacitor 122 decays up to a voltage which is greater than the voltage established at the junction of resistors 134 and 136. Consequently, for a brief interval following the release of comparator 104, no decay of the voltage across capacitor 110 will take place. More specifically, when the output of comparator 104 shifts to a low level, the output of inverter 124 will shift to a high level, thus reverse biasing diode 126 and essentially disconnecting capacitor 122 from ground. The capacitor 122 will therefore charge up to a positive voltage via a resistor 140 which is connected across it. When the voltage across capacitor 122 charges up to the point at which that voltage exceeds the voltage at the junction of resistors 134 and 136, the output of comparator 130 will drop to a low voltage level. The diode 138 will thus become forward biased, permitting discharging of capacitor 110 to take place through resistor 118. The gain control signal will thereafter decay at a rate established by the resistance value of resistor 118.

A clipping circuit 142 is included to clip the maximum voltage across capacitor 110 at a preset limit. This prevents the phase angle between the L and R vectors components of the composite modulated signal (or, equivalently, the amplitude of the quadrature-phase component) from being reduced below a certain limit, preferably about 30°. Clipping circuit 142 includes a potentiometer 144, having its wiper arm connected to capacitor 110 through a diode 146. In operation, diode 146 will be reverse biased as long as the voltage across capacitor 110 does not exceed the voltage at the wiper arm of potentiometer 144. As the voltage across capacitor 110 increases beyond this voltage, however, diode 146 will become forward biased, and current will be shunted past the capacitor 110 through the potentiometer 144. The resistance value of potentiometer 144 is selected to be small enough so that the current flow therethrough due to the forward biasing of diode 146 will not significantly change the voltage at the wiper arm. The clipping circuit 142 therefore prevents the voltage across capacitor 110 from exceeding the voltage at the wiper arm of potentiometer 144. The maximum voltage across capacitor 110, and thus the minimum phase angle, may be set by adjusting potentiometer 144.

Figure 7A:
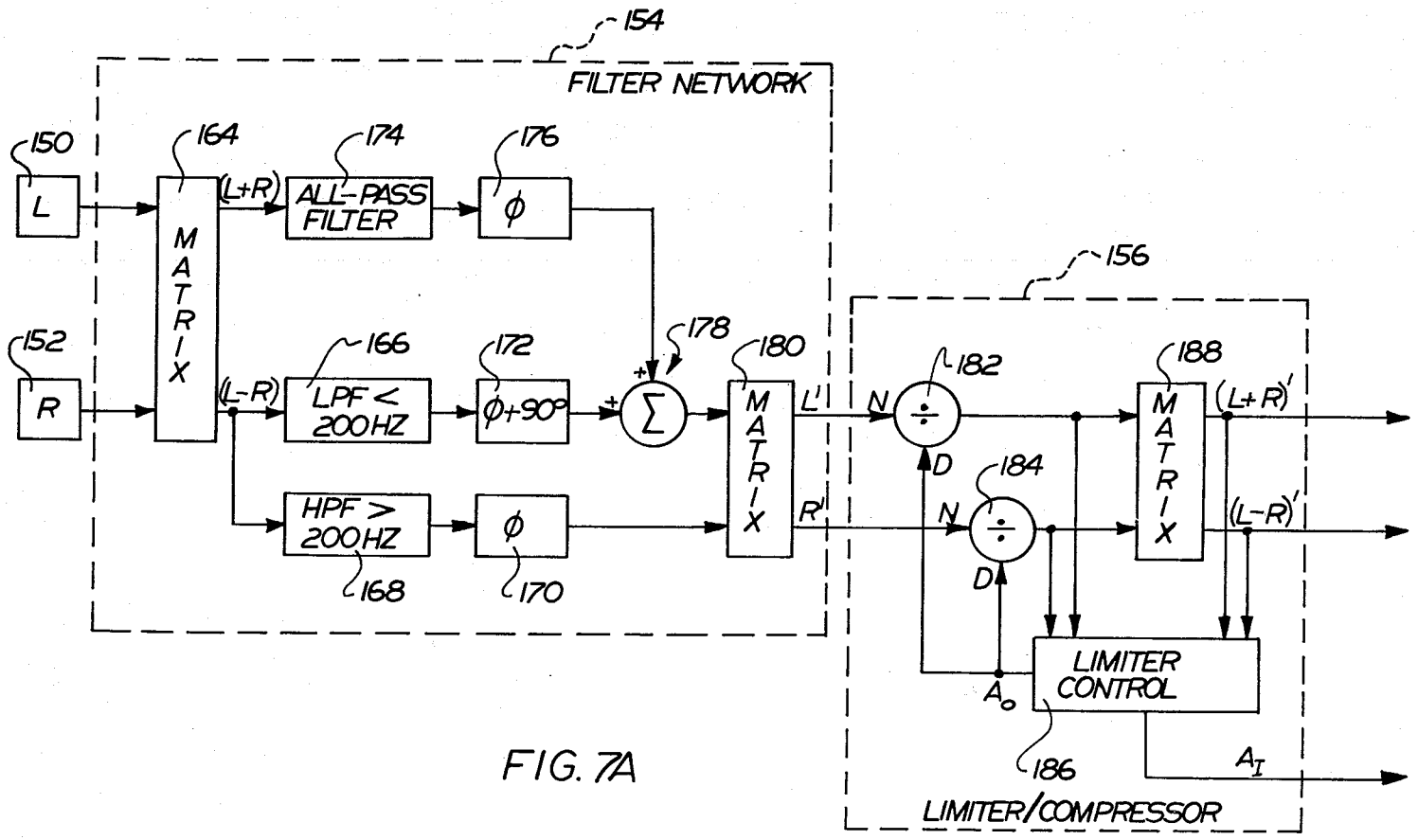
FIGS. 7A and 7B are more detailed illustrations of a practical embodiment of a modulator/transmitter in accordance with the teachings of the present invention, and incorporating selective compression of the low level audio signals.
Figure 7B:
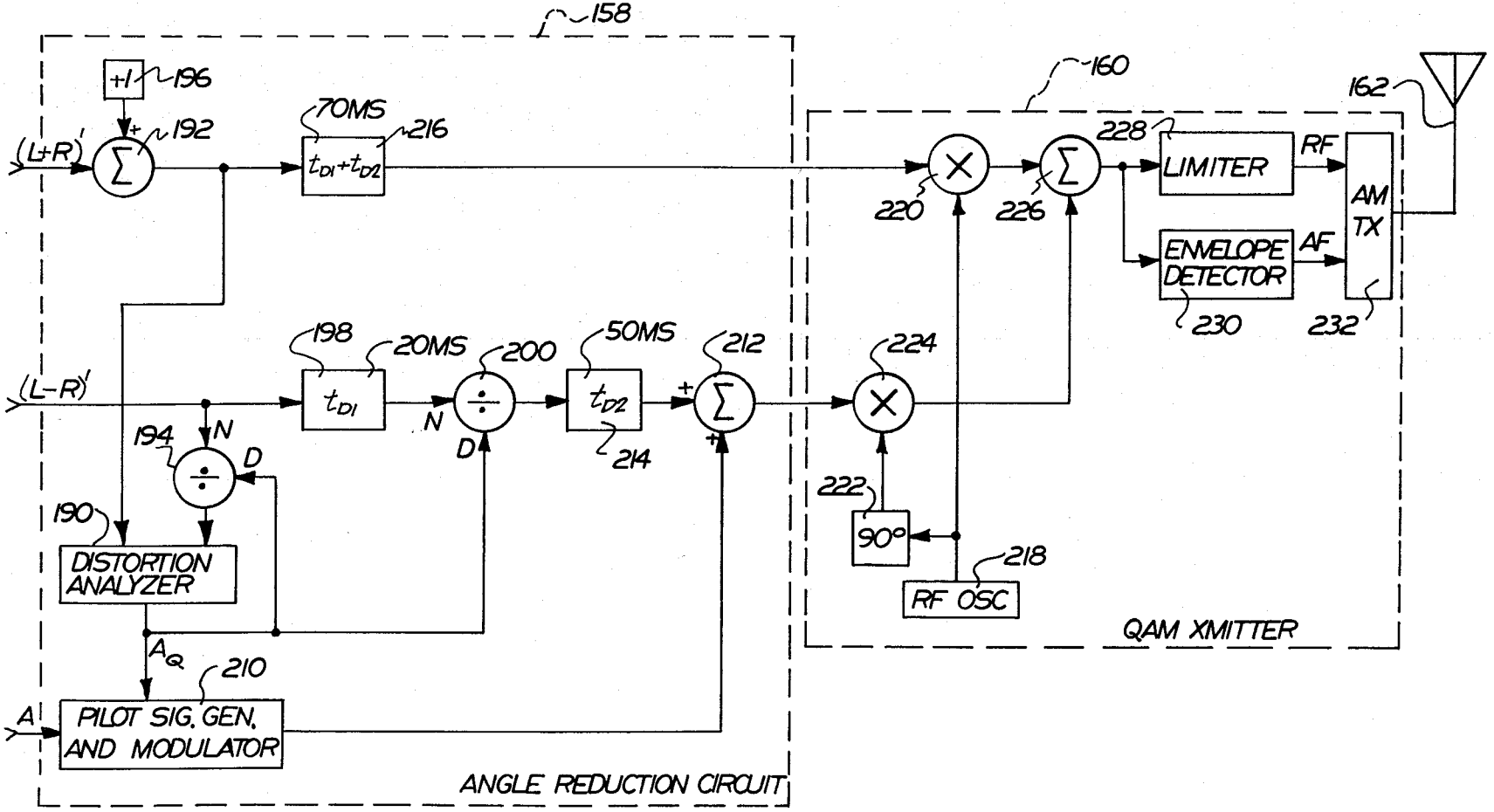

FIGS. 7A and 7B are more detailed diagrams of a modulator/transmitter in accordance with the teachings of the present invention. Two signal sources 150 and 152 provide stereophonically related audio signals L and R which are to be communicated to a receiving station. These signals are provided to a filter network 154 whose purpose is to eliminate the frequencies in the difference (L−R) channel below a predetermined limit (for example, 200 Hz), without affecting the apparent loudness of the bass in the signals as recovered by a subsequent receiver. The L and R signals are then further processed by a limiter/compressor 156, which limits the maximum modulation of the composite modulated signal by applying amplitude constraints to the modulating signals, and which also provides a signal compression function which will be described hereinafter.

An angle reduction circuit 158 responds to the outputs of the limiter/compressor 156, and functions to adjust the amplitude of the quadrature-phase modulating signal in accordance with a distortion estimate, as in the FIG. 3 embodiment. This circuit also generates and modulates a pilot signal in accordance with the gain reduction factor, and then adds the pilot signal to the quadrature-phase modulating signal. A quadrature AM (QAM) transmitter 160 utilizes the in-phase and quadrature-phase modulating signals provided by the angle reduction circuit 158 to modulate in-phase and quadrature-phase carriers, with the modulated carriers then being linearly combined to produce the composite modulated signal. This signal is transmitted via an antenna 162.

Describing these broad blocks now in greater detail, the filter network 154 has a more complicated form than the simple high-pass filter and all-pass filter utilized in the embodiment of FIG. 3, since it also deals with a problem not addressed by the embodiment of FIG. 3. It was found that the elimination of the low frequency signals from the quadrature-phase channel produced a small but noticeable decrease in the loudness of the bass (low frequency) content of the L only or R only signals as subsequently received and demodulated. Filter network 154 is designed to avoid this loss in bass by adding the bass from the difference signal to the sum signal, with a 90° phase shift. The sum channel therefore contains all of the bass signal which had previously been included in both the sum and difference channels. The phase shift of 90° prevents inadvertent cancellation of the low frequencies of the sum channel with the low frequencies of the difference channel.

The filter network 154 includes a matrix circuit 164 for adding and subtracting the L and R signals to produce the sum (L+R) and difference (L−R) signals. The difference signal is supplied to two filters 166 and 168 which separate it into frequencies below and above a predetermined frequency limit (for example, 200 Hz), respectively. Filter 168 is a high-pass filter which eliminates those frequencies in the difference channel below the frequency limit, where filter 166 is a low-pass filter which eliminates those frequencies which are greater than the frequency limit. As in FIG. 3, the sum signal is processed with an all-pass filter 174 in order to introduce phase shifts which are equivalent to the phase shifts introduced by high-pass filter 168. The signals provided at the outputs of filters 174 and 168 therefore have similar phase shift characteristics. The output of all three filters 166, 168 and 174 are phase-shifted by respective phase shifters 172, 170 and 176. The purpose of these phase shift circuits is to introduce a 90° phase shift between the low frequencies of the difference channel and the low frequencies of the sum channel, without affecting the relative phases of the sum channel and the high frequency portion of the difference channel. Although this could be accomplished by providing a 90° phase shift circuit at the output of low-pass filter 166, it is in practice quite difficult to construct and align a circuit having a phase shift over a given frequency range of precisely 90°. It is, on the other hand, relatively simple to construct a circuit which will have a phase shift of 90° with respect to another circuit, and it is this principle which is utilized herein. Thus, circuits 170 and 176 provide corresponding phase shifts of $\phi$, whereas circuit 172 provides a phase shift of $\phi+90°$.

A signal adder 178 adds the outputs of phase shifters 172 and 176 to provide an output signal which corresponds generally to the sum signal, but which has a low frequency content which has been augmented by the low frequencies of the difference channel. A matrix circuit 180 adds and subtracts the output of adder 178 and phase shifter 170 to recover modified left and right signals therefrom. It is these signals which are then supplied to the limiter/compressor circuit 156.

In limiter/compressor circuit 156, divider circuits 182 and 184 are provided for the two audio channels. A limiter control circuit 186 provides a common gain control signal to both of dividers 182 and 184. The limiter control circuit 186 monitors the amplitudes of the L and R signals as well as the amplitudes of (L+R) and (L−R) signals (derived by another matrix circuit 188), and reduces the gains of the L and R signals when necessary to prevent overmodulation of the transmitter. It should be noted that since the gain is uniformly affected in both the left and right channels, this limiting function has no effect on the relative amplitudes of the in-phase and quadrature-phase modulating channels. The limiter/compressor 156 therefore does not affect the phase angles between the L and R vectors of the composite modulated signal.

The limiter control 186 also provides an additional function in order to improve the low amplitude signal-to-noise ratio of the system. When the limiter control circuit 186 senses that the signal level in both the L and R channels has dropped below a predetermined level (corresponding, for example, to 20% modulation), the gain control signal supplied to dividers 182 and 184 is decreased so as to increase the gain of both channels to bring the signals back up to the predetermined modulation level. Since this low level signal compression increases the amplitude of the modulation for low amplitude L and R signals it operates to improve the signal-to-noise ratio in a subsequent stereophonic receiver. Of course, the compression of the L and R signals should be offset by a corresponding expansion of these low amplitude signals in the receiver, and thus it is desirable to transmit a signal to the receiver indicating the existence and extent of any compression of the signals. To this end, the limiter control circuit 186 provides a signal $A_I$ to the pilot signal generator of the angle reduction circuit 158.

The angle reduction circuit 158 is supplied with the modified sum and difference signals from the output of matrix circuit 188, and includes a distortion estimator 190 which will preferably have essentially the same form illustrated in FIGS. 5A and 5B. The two inputs to the distortion estimator 190 are derived from a signal adder circuit 192 and a divider circuit 194. As in the FIG. 3 embodiment, the purpose of adder circuit 192 is to add a DC value supplied by a circuit 196 to the sum signal channel so that the resulting composite modulated signal will contain a DC carrier component which is in-phase with the (L+R) vector component.

Unlike the embodiment illustrated in FIG. 3, the FIG. 7 embodiment does not utilize the output of divider circuit 194 to modulate the quadrature-phase channel of the composite modulated signal. A second divider 200 is instead provided to derive the modulating signal. Both dividers, however, are supplied with the gain control signal derived by the distortion estimator 190. The desireability of including two dividers follows from the presence of a time delay in distortion estimator 190. Because of this delay, which is mainly due to the attack delay previously described, the output of the distortion estimator will not instantaneously reflect a change in the amount of distortion; a circuit such as that illustrated in FIG. 3 will therefore not correct the gain of the quadrature-phase modulating channel rapidly enough to prevent a short period of distortion which is greater than the acceptable limit. The angle reduction circuit 158 of the FIG. 7 embodiment avoids this problem by inserting a delay circuit 198 in the difference channel prior to the second divider circuit 200. This time delay circuit has a time delay which is approximately equal to the attack delay of the distortion estimator 190, so that the (L−R) signal will arrive at the divider 200 approximately coincident with the arrival of the gain control signal derived from that (L−R) value.

As in the previous embodiment, the gain control signal provided at the output of the distortion estimator 190 is also supplied to a pilot signal generator and modulator 210 which generates a low frequency pilot signal, and modulates it in accordance with the gain control signal. This pilot signal modulator also modulates the pilot signal with the compressor signal supplied by the limiter/expander circuit 156. The pilot signal then contains information both relating to the angle between the L and R vectors of the composite modulated signal, and relating to the compression of low level L and R signals. This modulated pilot signal is added into the quadrature-phase channel via an adder circuit 212.

The angle reduction circuit 158 of the FIG. 7 embodiment includes a second time delay 214 between the analog divider circuit 200 and the analog adder circuit 212. This delay is included to account for delays in the pilot recovery loop in a subsequent receiver. If this delay were not included, the inherent time delay in the recovery of the pilot signal by a subsequent receiver would result in the application of the control information embodied in the pilot signal to the audio signal which came a short delay thereafter. By inserting the delay 214 between the divider 200 and the adder circuit 212, however, the pilot signal is advanced in time with respect to the audio signals to which it pertains. This delay circuit 214 has a time delay corresponding to the time delay which will be experienced in the pilot recovery loop in a subsequent receiver, for example, 50 milliseconds.

A third time delay circuit 216 is provided in the (L+R) channel to delay the modified (L+R) signal by an amount corresponding to the total delays of delay circuits 198 and 214. In other words, in the embodiment being disclosed, time delay circuit 216 delays the modified (L+R) signal by approximately 70 milliseconds.

The QAM transmitter 160 may take any conventional form. In the disclosed embodiment, an RF oscillator 218 provides an RF carrier signal to a balanced modulator 220, where it is amplitude modulated by the modified (L+R) signal. The RF carrier signal is also provided to a 90° phase shift circuit 222 which shifts the carrier in phase by 90° to provide a quadrature-phase carrier signal to a second balanced modulator 224. This modulator double-sideband, suppressed carrier (DSB-SC) modulates the quadrature-phase carrier signal in accordance with a quadrature-phase modulating signal, including the modified (L−R) signal and the pilot signal. The two modulated signals provided by modulators 220 and 224 are then additively combined in an adder circuit 226, which provides a low level composite modulated signal at its output.

In the illustrated embodiment, an interface circuit comprised of a limiter 228 and envelope detector 230 is included so as to adapt the composite signal for transmission via conventional AM transmitter 232. The limiter 228 clips the composite modulated signal provided at the output of adder circuit 226, and provides the resulting low level, constant amplitude RF signal to the RF input of the AM transmitter 232. This RF signal will carry with it the phase information from the low level composite modulated signal. The envelope detector 230, on the other hand, detects the envelope of the composite modulated signal, and provides the resulting audio frequency signal to the audio frequency input of the conventional AM transmitter 232. The AM transmitter amplifies the low level RF signal and amplitude modulates the resulting high level RF signal with the amplitude information provided by the envelope detector 230. A high level composite modulated signal is thus provided which is transmitted by means of an antenna 262.

Figure 8:
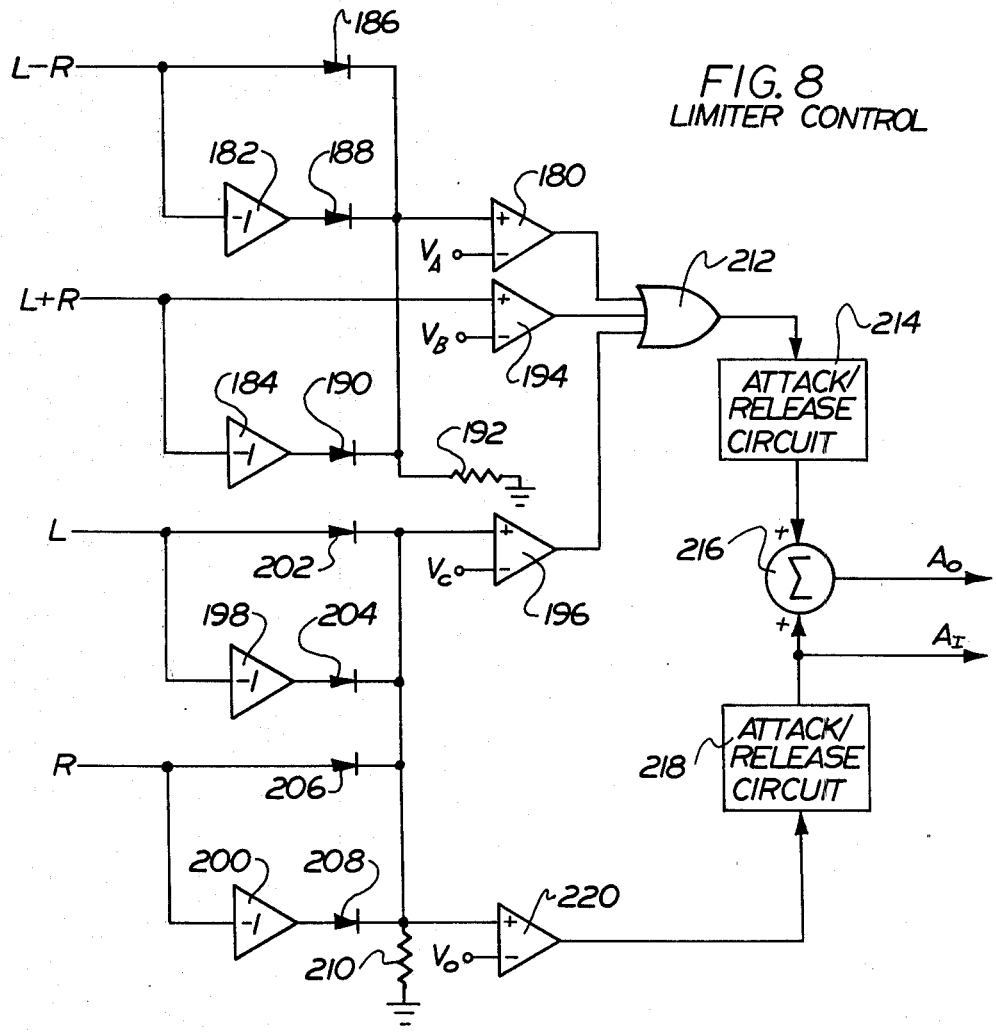
FIG. 8 is a more detailed block diagram of the limiter control circuit of the block diagram of FIG. 7B.

FIG. 8 is a broader block diagram of the limiter control circuit 186 of FIG. 7B. This limiter control circuit applies maximum amplitude constraints to the L and R signals so as to limit modulation of the transmitted signal in the in-phase channel to the presently accepted limits of +125% and −100%. The limiter control further establishes modulation limits of + and −100% in the quadrature-phase channel, and prevents either the left or right channel from individually exceeding a level representative of + or −80% modulation. Of course, limits other than these could instead be used if desired.

The 100% modulation constraints for both in-phase and quadrature-phase channels are established by comparator 180. The negative input to comparator 180 is provided with a reference voltage level $V_A$ representative of 100% modulation. The positive input to comparator 180, on the other hand, is derived by a nonadditive combination of three different signals: The (L−R) signal, an inverted (L−R) signal provided by an analog inverter 182, and an inverted (L+R) signal provided by an analog inverter 184. Nonadditive mixing of these three signals is provided by connecting all three signals to the positive input of comparator 180 through corresponding diodes 186, 188 and 190. A resistor 192 connects the junction of these three diodes to ground so that the input of comparator 180 is never left floating.

The positive input to comparator 180 will therefore reflect whichever of these three signals is the greatest in amplitude.

The output of comparator 180 will normally be at a low voltage level. Whenever the positive or negative peaks of the (L−R) signal or the negative peaks of the (L+R) signal have an amplitude greater than the 100% modulation reference signal $V_A$, however, the comparator output will shift to a high level. This will trigger L and R gain reduction through a circuit which will be described hereinafter.

A comparator 194 establishes the +125% modulation constraint for the in-phase channel. This comparator has a signal level representative of +125% modulation applied to its negative input, and the (L+R) signal directly supplied to its positive input. The output of comparator 194 will therefore go to a high voltage level whenever the positive peaks of the (L+R) signal exceed the level representative of 125% modulation. Again, this will trigger L and R gain reduction.

A third comparator 196 establishes the + and −80% modulation constraints for the individual L and R channels. The negative input of this comparator is again provided with a reference voltage, in this case a voltage $V_C$ indicative of positive 80% modulation. The positive input to comparator 196, however, is derived by a nonadditive mixing of four signals: The L signal, an inverted L signal derived from an analog inverter 198, the R signal, and an inverted R signal derived by a second analog inverter 200. Nonadditive mixing is again achieved by means of diodes, in this case four diodes 202, 204, 206, and 208. Also, a resistor 210 again connects the junction of the diodes to ground. The output of comparator 196 will normally be at a low voltage level and will shift to a high voltage level whenever the positive or negative peaks of the L or R signal exceeds the reference level $V_C$. This will again trigger gain reduction in the L and R channels.

The outputs of comparators 180, 194 and 196 are logically "ORed" together by means of a three input OR gate 212. Consequently, the output of OR gate 212 will shift from a low logic level to a high logic level whenever any of the modulation constraints represented by comparators 180, 194, and 196 has been exceeded. The output of OR gate 212 is connected to an attack/release circuit 214 which generates a gain control signal in response thereto. This attack/release circuit may have a form similar to the attack/release circuit utilized in the distortion estimator, described with particular references to FIG. 6. This attack/release circuit, however, lacks the clipping circuit 142 utilized in the attack/release circuit illustrated in FIG. 6, and has a much more rapid attack time than that circuit. Preferably, attack/release circuit 214 has an attack time on the order of 10 microseconds, for example.

The gain control signal provided at the output of attack/release circuit 214 is directed to a signal adder circuit 216 and is there additively combined with a second gain control signal provided by a second attack/release circuit 218. The resulting sum signal is directed to the denominator input of dividers 182 and 184 (FIG. 7A) to control the gain of the L and R signals.

The attack/release circuit 218 operates in conjunction with a comparator 220 to provide compression of low level signals. Thus, comparator 220 has its negative input connected to a reference signal $V_D$ indicative, for example, of +20% modulation, and its positive input connected to the common connection of diodes 202, 204, 206, and 208. The output of comparator 220 will therefore remain at a high logic level as long as any of these signals exceeds the reference level $V_D$. In the event that all four of these signals are below the reference level, however, the output of comparator 220 will shift to a low logic level, and will remain there as long as the condition persists. As will be made clearer hereinafter, the outputs of circuit 218 will normally be at a constant level representative of a denominator value of one. Thus, when the output of circuit 214 has a value of zero (which will always be the case unless modulation limiting is required) the net gain of limiter/compressor 156 will be unity. When any of the modulation constraints established by comparators 180, 194, and 196 are exceeded, however, the output of attack/release circuit 218 will slew positive, producing an increase in the gain control signal $A_O$ supplied to the dividers and a reduction in the gain of the L and R signals.

Attack/release circuit 218 again has substantially the same form illustrated and described with respect to FIG. 6, in this case also including a clipping circuit such as clipping circuit 142. This clipping circuit will establish the maximum output signal from the attack/release circuit, and as stated above will correspond to a denominator value of one so that the limiter/compressor block 156 of FIG. 7B will have unity gain in the absence of modulation limiting. As long as either the left or right signal exceeds 20% positive or negative modulation, the output of comparator 220 will generally be at a high logic level (except during zero crossings of the L and R signals, of course, when the output of comparator 220 will drop low). This will hold the attack/release circuit 218 at the positive clipping voltage. When the peak amplitudes of both the left and right signals drop below the level $V_D$ necessary to produce 20% positive and negative modulation, however, the output of the comparator 220 will remain at a low level, permitting the attack/release circuit 218 to slowly release from the clipping voltage. As the output of attack/release circuit 218 decays, the output of adder circuit 216 will similarly decay, resulting in an increase in the gain of the L and R signals. When the gain of the signals has increased to the point where the left and right signals again exceed 20% modulation, the output of comparator 220 will again shift to a high level, thereby preventing further increases in the gain of the left and right signals. The output of attack/release circuit 218 will stabilize at the value which increases the gain of the L and R signals back to the 20% modulation level.

Attack/release circuit 218 will also preferably includes a second clipping circuit for preventing the voltage at the output thereof from dropping below a preset level, thereby preventing the compression of the low level signals from exceeding a preselect amount, for example, 12 db.

In summary, then, as long as the L and R audio signals do not exceed maximum modulation constraints, the output of OR gate 212 will remain low, and the output of attack/release circuit 214 will remain at essentially a ground voltage level. Further, as long as the audio signals are above the 20% modulation level, the output of comparator 220 will at least periodically shift to a high level, resulting in attack/release circuit 218 slewing to the positive clipping voltage, representing a gain factor of one. The output $A_o$ will therefore normally reflect a gain factor of 1. In the event that the maximum modulation constraints are exceeded, the output of OR gate 212 will shift to a high level, causing attack/release circuit 214 to slew positive and producing a very rapid decrease in the gain of the signals in the L and R channels. If, the other hand, the audio signals drop below 20% modulation for a significant interval of time, then the output of comparator 220 will remain low and the attack/release circuit 218 will be released. The voltage provided at the output thereof will then begin to decay. The gain in the two audio channels will in that event increase, producing an increase in the gain of the L and R signals to bring them back up to the 20% modulation level.

Figure 9:
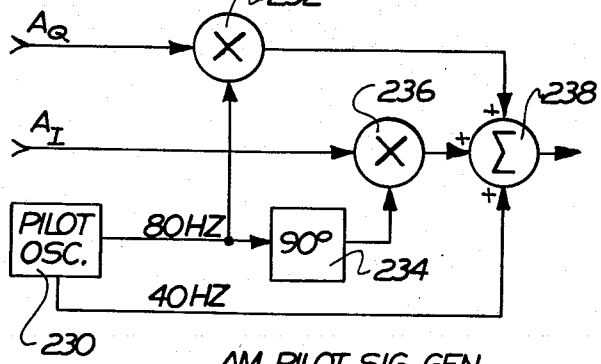
FIG. 9 is a block diagram of an AM pilot signal generator and modulator which could be used in the systems of FIGS. 3 or 7A and 7B.

FIG. 9 illustrates one embodiment of the pilot signal generator and modulator block 210 of FIG. 7A. This circuit amplitude modulates the phase angle and signal expansion information onto two quadrature-phased pilot signals. A pilot oscillator 230 provides a carrier signal having a frequency of 80 Hz, for example, to a balanced modulator 232 and to a 90° phase shifter 234. Modulator 232 modulates the 80 Hz carrier signal by the signal $A_Q$ derived from distortion estimator 190 of FIG. 7B. A second balanced modulator 236 modulates the 90° phase shifted signal supplied by 90° phase shifter 234 with the signal $A_I$ provided by the attack/release circuit 218 of FIG. 8, and which indicates the level of compression being provided by the limiter/compressor circuit. The double sideband signals at the outputs of modulators 232 and 236 are added together in an adder circuit 238, together with a half-frequency signal, also provided by pilot oscillator 230. This one-half frequency (40 Hz) signal, which is in-phase with the 80 Hz signal provided to modulator 232, will be utilized in a subsequent receiver to synchronize an oscillator therein for purposes of demodulating the amplitude modulated pilot signal.

Figure 10:
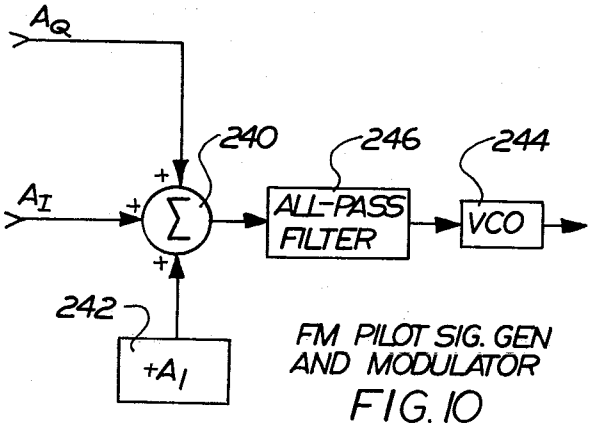
FIG. 10 is a block diagram of an FM pilot signal generator and modulator which could also be used in the systems of FIG. 3 or 7.

FIG. 10 illustrates a second, and presently preferred, embodiment of the pilot signal generator and modulator 210 of FIG. 7B. In this figure, a signal adder circuit 240 adds the phase angle and signal expansion signals $A_Q$ and $A_I$ together with a DC signal $A_1$ provided by a circuit 242. The resulting sum signal is provided to the frequency control input of a conventional voltage controlled oscillator (VCO) 244 through an all-pass filter 246. The purpose of all-pass filter 246 is to minimize overshoot in the output of the low-pass filter which will be used in the FM pilot signal demodulator at the receiver. To accomplish this, all-pass filter 246 is selected to have a time delay versus frequency characteristic which is the complement of that of the low-pass filter in the receiver. The result is that all frequencies will experience a similar time delay, and thus little overshoot will result.

The center frequency (preferably 55 Hz) of the FM pilot provided by the VCO 244 will be set by the sum of the DC value provided by circuit 242, and the DC value of the expansion signal $A_I$ provided by the attack/release circuit 218 of FIG. 8. Reduction in the phase angle between the L and R vectors will be accompanied by an increase in the value of the gain control signal $A_Q$, and will thus result in an increase in the frequency of the pilot signal provided at the output of VCO 244 above the center frequency. Conversely, compression of low level signals will be accompanied by a reduction in the value of the expansion signal $A_I$, resulting in a deviation in the frequency of the signal at the output of VCO 244 below the center frequency. It should be noted that the two events will not take place simultaneously, since compression of the audio signal will only take place when low level signals are present whereas a reduction in the angle between the L and R vectors will characteristically take place only when high amplitude signals are present. It is therefore possible to separate out the two types of information from the FM pilot signal at the receiver by recognizing whether the pilot has deviated in a positive or negative direction from the center frequency.

The AM embodiment of the pilot signal generator and modulator which has been described will preferably produce pilot signals having frequency spectrums centered on 80 Hz. This center frequency has been selected to fall midway between 60 Hz (power line frequency in the United States) and 100 Hz (a harmonic of the 50 Hz power line frequency used in many foreign countries). This pilot signal frequency spectrum may thus extend 20 Hz above or below the center frequency while still avoiding the significant noise components which are synchronous with the power line frequencies.

The FM embodiment of the pilot signal generator and modulator which has been described will preferably produce an FM pilot signal having a quiescent carrier frequency of 55 Hz. This center frequency has been selected to fall midway between the 50 and 60 Hz power line frequencies to make better use of the FM capturing effect. Thus, although an interfering carrier always produces the same amount of phase modulation interference to a desired FM carrier independently of frequency difference between the two carriers, the rate of phase modulation (and hence FM interference) is reduced as frequency difference is reduced.

Figure 11:
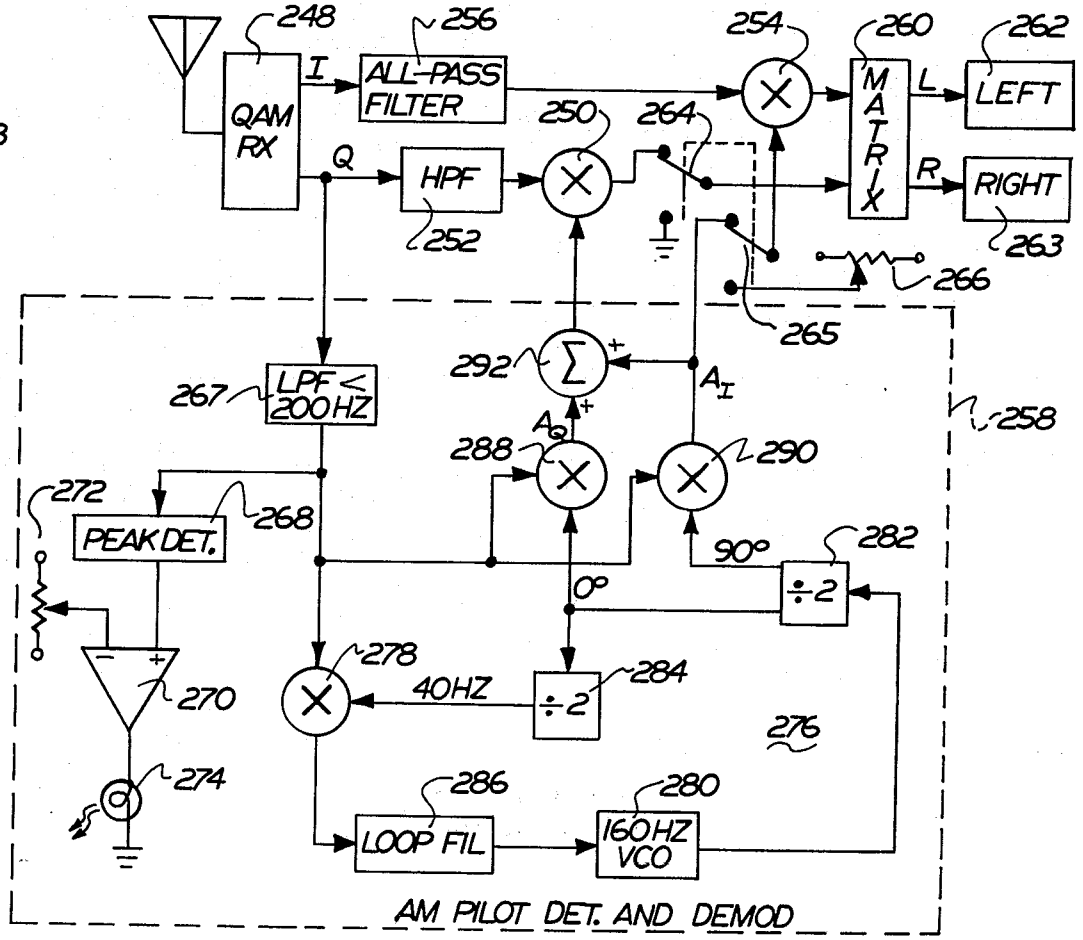
FIG. 11 is a block diagram of a receiver system for receiving the modulated signals generated by the modulator/transmitter system of FIGS. 7A and 7B, including a circuit for demodulating an AM pilot signal.

FIG. 11 illustrates a receiver which is constructed not only to track the varying phase angle between the L and R vectors of the composite modulated signals, but also to make use of the signal expansion information which is modulated on the pilot signal thereof. As in the receiver of FIG. 4, the receiver of FIG. 11 includes a conventional tunable QAM receiver 248 which separately recovers the in-phase and quadrature-phase modulating signals I and Q from the composite modulated signal. The quadrature-phase modulating signal Q is directed to an analog multiplier 250 through a high-pass filter 252, included to eliminate the pilot signals from the channel by removing all frequencies below a certain limit, shown as being 200 Hz. The in-phase modulating signal I, on the other hand, is provided to a second multiplier 254 through an all-pass filter 256 which has the same phase shift characteristics as the high-pass filter 252 in the quadrature channel. The Q output of the QAM receiver 248 is also supplied to an AM pilot detector and demodulator 258 which recovers gain control information for providing gain control signals to multipliers 250 and 254. The gain corrected I and Q signals, corresponding respectively to the sum (L+R) and the difference (L−R) signals are matrixed in a conventional audio matrix 260 to recover the L and R audio signals therefrom. Any desired utilization circuits 262 and 263 may be provided for use of the L and R signals as thus recovered. These circuits will generally include audio amplifiers and associated loudspeakers.

In the receiver of FIG. 11, a DPDT switch is included to permit the listener to switch between stereo and mono modes of reception. In the figure, the two poles 264 and 265 of this switch are shown in the position for stereo reception, where the operation of the receiver is as described above. When receiving a monophonic signal (which, of course, will not include a Q component), the operator may switch the receiver to a mono mode, where poles 264 and 265 are in their alternative positions so as to specifically adapt the receiver to receive monophonic signals. When in the monophonic mode, pole 264 will connect the (L−R) input of matrix 260 to ground, thus preventing the introduction of noise via this route. The other pole 265 will then connect the gain input of multiplier 254 to a fixed gain value set in a potentiometer 266.

In FIG. 11, the pilot detector and demodulator 258 is constructed to detect and demodulate a pilot signal which has been amplitude modulated in two quadrature-phased channels, such as the one provided by the pilot signal generator and modulator of FIG. 9. The pilot detector includes a low-pass filter 267 which filters the Q output of QAM receiver 248 to eliminate all frequencies therefrom which are above the pilot signal in frequency. The output of this low-pass filter is peak detected in a peak detector 268 to provide an indication to a comparator 270 as to whether or not a pilot signal is included in the received signal. If a stereo signal is being received, a pilot signal will be included, and the output of peak detector 268 will exceed a threshold set by a potentiometer 272. The output of comparator 270 will thus go to a high voltage level, illuminating a stereo indicator lamp 274. When receiving monophonic signals (which, of course, will not include a pilot signal), the amplitude of the signal provided at the output of peak detector 268 will be below the threshold set by potentiometer 272, thus the stereo indicator will not be illuminated. A visual indication of the stereo/mono nature of the received signal is thus provided.

In those situations in which it is desired to have the receiver automatically switch between stereo and mono modes of operation, the output of comparator 270 may also be used to control the state of solid state electronic switches, substituted for poles 264 and 265.

The output of low-pass filter 267 is also provided to a pilot signal recovery loop, generally indicated at 276. This pilot signal recovery loop includes a multiplier circuit 278 which multiplies the pilot signals provided at the output of low-pass filter 267 by a 40 Hz signal generated by a 40 Hz oscillator, comprised of a 160 Hz VCO 280, and two divide-by-two circuits 282 and 284. As is conventional practice, the output of the multiplier 278 will be filtered through a loop filter 286, and used to control the frequency of operation of the VCO 280. This pilot recovery loop 276 will synchronize the oscillator 280 with the 40 Hz half-frequency tone included with the pilot signal.

The divide-by-two circuit 282 has two 80 Hz outputs which are in phase quadrature with one another. These two outputs are respectively directed to multipliers 288 and 290, the other inputs of each of which are derived from the output of low-pass filter 267. These multipliers will demodulate the two channels of the pilot signal, with the outputs of multiplier 288 and 290 respectively comprising the signals $A_Q$ and $A_I$ utilized to modulate the in-phase and quadrature-phase channels of the pilot signal.

The recovered $A_I$ signal will be directly used to control the gain of multiplier 254 (when the receiver is in the stereo mode), and will be supplied also to multiplier 250 through a signal adder circuit 292. Thus, as the signal $A_I$ diminishes in amplitude, indicating that the signal is being compressed at the transmitter, the gain of both of the signals in the I and Q channels will be reduced by a corresponding amount.

The recovered $A_Q$ signal, representative of the varying angle between the L and R vectors of the composite modulated signal, will be added to the $A_I$ signal by the signal adder circuit 292 and thus also used to control the gain in the quadrature-phase channel by means of the multiplier 250. Thus, as the signal $A_Q$ increases, indicating a reduction in the angle between the L and R vectors of the composite modulated signal, the gain in the Q channel will be increased to compensate for the reduced amplitude of the quadrature-phase component. Similarly, when the signal $A_Q$ diminishes in amplitude, indicating that the angle between the two vectors is increasing, a decrease in the gain in the quadrature channel will result which exactly mirrors the increase in the amplitude of the quadrature component. The FIG. 11 receiver therefore automatically compensates for both compression of the signal at the transmitter, and for dynamic variations in the phase angle between the L and R vectors in the composite modulated signal.

Figure 12:
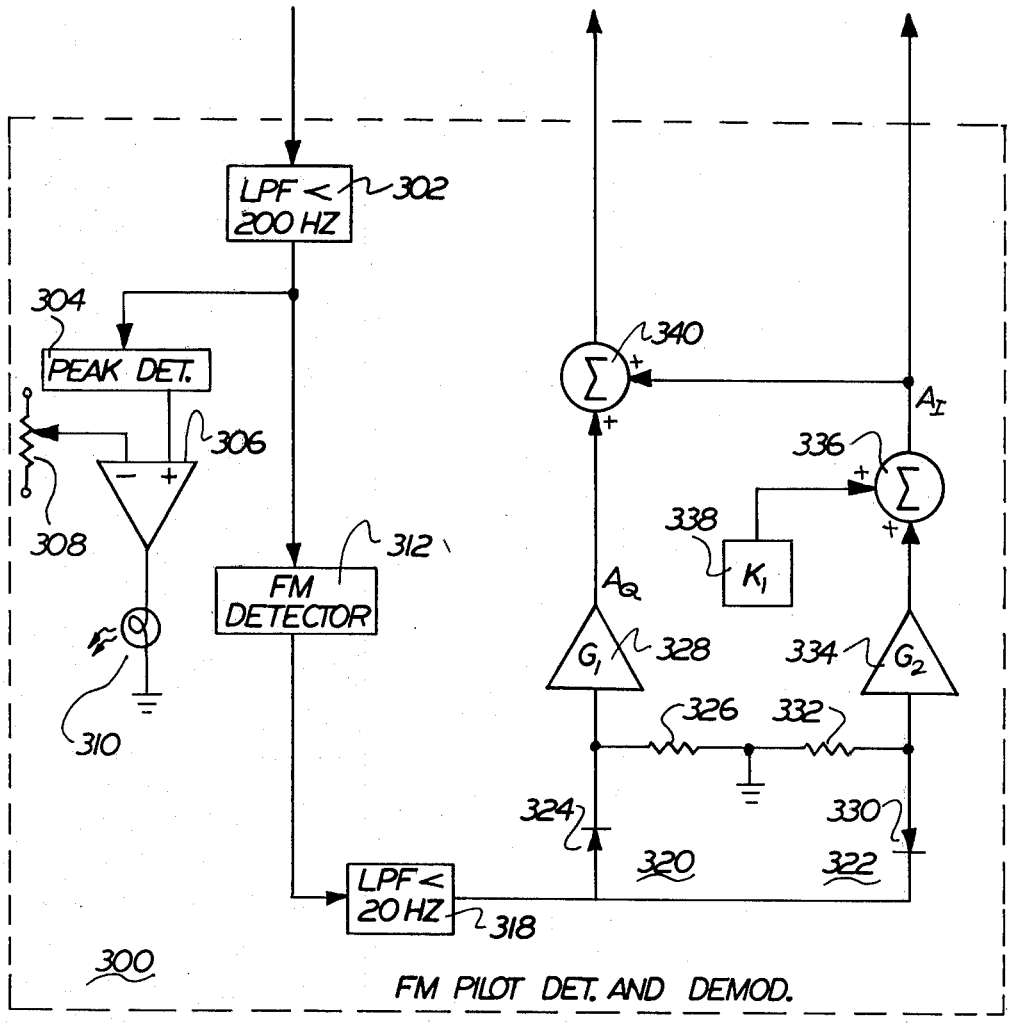
FIG. 12 is a block diagram of a circuit for demodulating an FM pilot signal, which could be alternatively used in the system of FIG. 11.

FIG. 12 illustrates a pilot detector and demodulator 300 which may be substituted for the detector and demodulator 258 of FIG. 11 when an FM pilot is being used instead of an AM pilot. The FM pilot detector and demodulator 300 of FIG. 12 again includes a low-pass filter 302 for eliminating all frequencies above the pilot, thereby separating out the modulated pilot signal from the (L−R) information. Also, a peak detector 304 will again operate in conjunction with a comparator 306, a reference circuit 308, and a stereo indicator light 310 to provide a visual indication that a stereo signal is being received. As before, the output of comparator 306 could be used to provide automatic stereo/mono switching, if desired.

The output of the low-pass filter 302 is also directed to an FM detector 312. This FM detector may take any convenient form, and will preferably utilize a phase-locked-loop in a conventional manner to accomplish the FM demodulation. The output of the FM detector 312 is a signal whose amplitude varies with the frequency of the FM pilot. Preferably, the output thereof will have a ground voltage level when the FM pilot signal is at the center frequency. Deviations of the pilot above the center frequency will then produce a positive output, whereas frequency deviations below the center frequency will produce a corresponding negative voltage at the output of the detector.

A low-pass filter 318 filters the frequency indication signal so as to remove any beat frequencies at harmonics of the pilot signal. As stated earlier, overshoot from this filter is minimized due to the inclusion of the all-pass filter 246 in the pilot signal generator and modulator of FIG. 10.

To separate the phase angle information from the signal expansion information, the output of low-pass filter 318 is directed to a positive peak rectifier 320 and a negative peak rectifier 322. Positive peak rectifier 320, comprised of a diode 324 and a resistor 326, provides all positive signals at the output of low-pass filter 318 to a gain circuit 328 having a gain $G_1$. Since these positive signals represent positive frequency deviations of the FM pilot, they carry all of the phase angle information. Negative peak rectifier 322, on the other hand, comprised of a diode 330 and a resistor 332, provides only the negative going portions of the output of low-pass filter 318 to a second amplifier circuit 334. This amplifier has a gain $G_2$ which may be different from the gain $G_1$ of amplifier 328. The output of amplifier 328 is thus a positive going signal corresponding to the phase angle signal $A_Q$, whereas the output of amplifier 334 is a negative going signal corresponding to the expansion signal $A_I$ minus a DC value. A signal adding circuit 336 restores a DC value, derived from circuit 338, to the signal at the output of amplifier 334. The output of adder 336 will then correspond to the gain term $A_I$.

The recovered $A_I$ signal is directly supplied to the multiplier 254 for the I channel through the pole 265 of the stereo/mono switch, and is indirectly supplied to the multiplier 250 for the Q channel through signal adder 340. When no compression of the signal is being provided at the transmitter, there will be no negative deviations of the carrier from the center frequency and the output of the amplifier 334 will remain at a ground value. The output of signal adder 336 will therefore have the DC value established by the circuit 338, which may be considered to represent a gain factor of 1. Compression of the audio signals at the transmitter will result in a negative deviation of the pilot from the center frequency, producing a negative going output from the amplifier 334. This negative signal will result in a decrease in the recovered signal $A_I$, and a resulting decrease in the gain of the audio signals which will exactly mirror the gain increase provided in the transmitter.

The output of amplifier 328, representing the term $A_Q$, is used as in the FIG. 11 embodiment to directly control the gain of the quadrature channel via signal adder 340. The gain in the Q channel will thus again be automatically controlled in accordance with the changing phase angle between the L and R vectors of the composite modulated signal.

Two of the filters in the receivers of FIGS. 11 and 12 may be eliminated by removing the pilot signal by signal cancellation techniques, rather than filtering. Thus, FM detector 312 will conveniently include a VCO whose output is locked in phase with the input signal. More specifically, the phase of the output of the VCO included in the FM detector 312 may be made to closely follow the phase variations of the pilot signal. By appropriate signal processing of the output of the VCO then, a signal can be generated which will exactly cancel the pilot signal when the two are added together.

Figure 13:
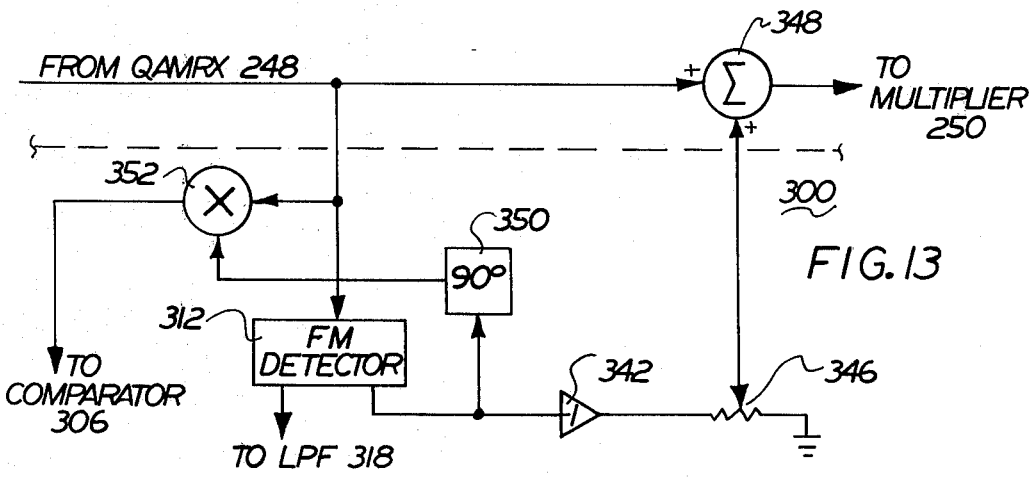
FIG. 13 is a block diagram of an alternative embodiment of a portion of the receiver system of FIGS. 11 and 12.

A circuit for accomplishing this is generally illustrated in FIG. 13. The FM detector 312 utilized in this event includes a sinewave VCO so that the output thereof may be easily used for cancellation of the pilot signal, which also has a sinusoidal waveform. The output in the VCO in the FM detector 312 is provided to an analog inverter 342 which inverts it so as to provide a signal which is in phase opposition with the pilot signal.

In order to cancel the pilot signal, it is necessary to adjust the amplitude of the signal at the output of inverter 342 to be the same as the amplitude of the pilot signal. The amplitude of the pilot signal in the Q output of receiver 248 will, however, remain substantially constant since the QAM receiver will conventionally include an AGC (automatic gain control) circuit. The amplitude of the inverted VCO output is adjusted to this expected level of the pilot by means of a potentiometer 346. The output of the potentiometer 346 will therefore comprise a signal which will be essentially identical with the pilot signal, but which is in phase opposition with it. Cancellation of the pilot signal from the quadrature-phase modulating signal on the Q output of receiver 248 may therefore be accomplished by simply adding the signal derived from the potentiometer 346 into the Q signal with a signal adder 348. This eliminates the need for both of filters 252 and 256, thus simplifying the receiver by permitting a larger portion of it to be integrated into one or more integrated circuits without extensive need for additional discrete components.

In order for the circuit thus far described to operate properly, it is desirable that low-pass filter 302 included in the circuit of FIG. 12 also be eliminated. This is because filter 302 will introduce phase shifts in the subsequent cancellation signal provided at the wiper arm of the potentiometer 346. Since the cancellation signal would then not exactly mirror the pilot signal, however, cancellation would not be as effective. In the circuitry of FIG. 13, the need for a low-pass filter such as filter 302 is eliminated by designing the loop filter in the phase-locked-loop associated with the FM detector to reject extraneous frequencies.

The elimination of low-pass filter 302 necessitates some revision in the circuitry for providing the stereo indicator. In FIG. 13, the signal provided to comparator 306 is derived by phase shifting the VCO output with a circuit 350 which provides a 90° phase shift at the FM center frequency of 55 Hz, and multiplying the resulting phase shifted signal by the quadrature-phase modulating signal Q in a multiplier 352. If an FM pilot signal is present, the output of multiplier 352 will include a DC component. This DC component is detected by a comparator 306 operating in conjunction with a reference potentiometer 308, as in the past.

The method which has been described of dynamically varying the phase angle between the L and R vectors of a composite modulated signal may also be advantageously employed in such other systems as the so-called "independent sideband" (ISB) systems. In one ISB system, the L and R signals are matrixed to form sum (L+R) and difference (L−R) signals. These (L+R) and (L−R) signals are shifted in phase by 90° with respect to one another, and then modulated onto quadrature-phased carriers in a conventional QAM transmitter. Due to the 90° phase shift between the (L+R) and (L−R) signals, the resulting composite modulated signal has the L information carried entirely in one sideband thereof and the R information carried entirely in the other sideband. In this type of ISB system, which may be referred to pure ISB, existence of a quadrature-phased component in the modulated signal again causes the envelope to be unacceptably distorted from the desired compatible form. It has thus been necessary in the past to predistort the composite modulated signal into a format which is more compatible for reception in conventional monophonic receivers.

The need for predistorting the ISB composite modulated signal may be eliminated by dynamically varying the amplitude of the quadrature-phased component in the manner which has been described above. A transmitter system utilizing this concept may have the same form as illustrated in FIG. 7A–7B, except that means will be provided prior to limiter/compressor 156 for phase shifting the (L+R) and (L−R) signals by 90° with respect to one another. This may be accomplished in any number of ways. Phase shifter 170, for example, could be constructed to provide a phase shift of $\phi+90°$ across the audio frequency band. Alternatively, separate phase shifters could be provided in each channel immediately prior to matrix 180 or immediately following matrix 164 to shift the (L+R) and (L−R) signals by $\phi$ and $\phi+90°$, respectively.

A radio receiver for receiving and demodulating a signal as transmitted by the above described transmitter would have essentially the form illustrated in FIGS. 11 or 12, depending again upon whether an AM or FM pilot were used. In addition, phase shifters would be included to offset the phase shifts in the transmitter and thus restore the recovered (L+R) and (L−R) signals to their original phase relationship. For the transmitter phase shift examples described above, a corresponding radio receiver would have phase shifters in the (L+R) and (L−R) signal paths providing phase shifts of $\phi$ and $\phi-90°$, respectively.

Reduction of the phase angle between the L and R modulated phase components of the ISB composite modulated signal causes a loss in the otherwise total independence of the upper and lower sidebands. Thus, as the phase angle is reduced from 90° to 30°, the information from each sideband blends in increasing amounts into the other sideband. Each sideband will, however, still predominantly carry information from only one of the two audio signals.

This modified ISB system has the further advantage that, when the L and R audio signals are in-phase with one another, the distortion in the envelope of the composite modulated signal will be smaller than in the previously described modified QAM system. The phase angle between the L and R components of the composite modulated signal will thus have a larger average value than in the modified QAM system, resulting in a somewhat improved SNR in stereophonic receivers.

Figure 18:
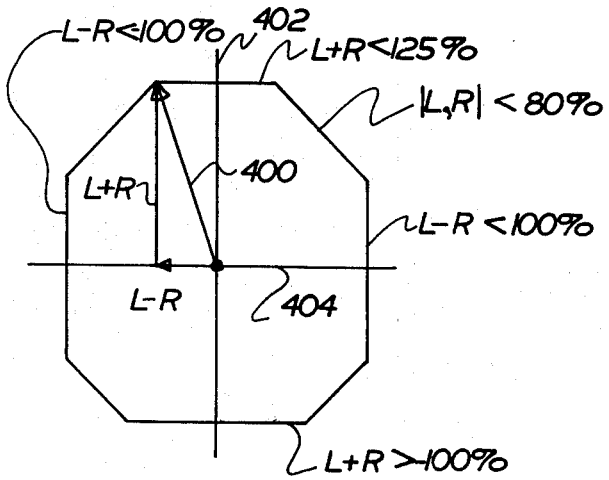
FIG. 18 is a vector diagram similar to those of FIGS. 2A and 2B, and illustrating the locus of vectors permitted by the limiter control circuitry of FIG. 8.
Figure 19:
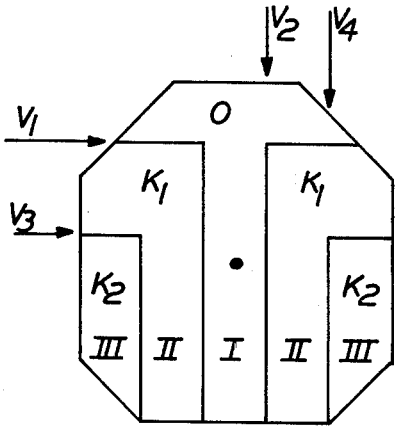
FIG. 19 illustrates the fashion in which the vector locus of FIG. 18 can be broken into five distortion ranges.
Figure 20:
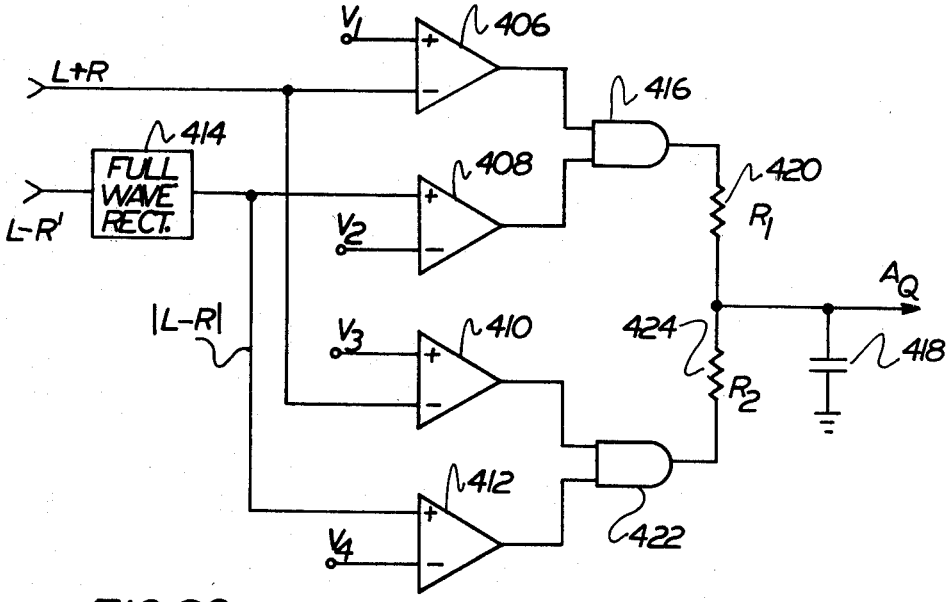
FIG. 20 illustrates an embodiment of a distortion estimator which provides a distortion estimate in accordance with the five distortion ranges illustrated in FIG. 19.

FIGS. 14–37 illustrate alternative embodiments of receivers and transmitters in accordance with the teachings of the present invention. Generally, FIGS. 14–17 deal with an AC coupling adapter for use in transmitters for transmitting AM stereo signals; FIGS. 18–20 relate to a simplified distortion estimator utilizing a piece-wise linear distortion model to synthesize the signal for controlling the transmitter; FIGS. 21–34 deal with alternative modulator/transmitter embodiments; and FIGS. 35–43 illustrate alternative embodiments of receivers.

In general, any AM signal can be expressed as the sum of in-phase and quadrature-phase components, and may be mathematically expressed:

$$V_c=(1+I)\ \mathrm{Cos}\ w_c t+(Q)\ \mathrm{Sin}\ w_c t \tag{4}$$

Where I is the in-phase modulating signal and Q is the quadrature-phase modulating signal. I and Q are typically audio modulating signals, and the "1" in the Cos $w_c t$ term establishes a quiescent carrier. This may be equivalently expressed as:

$$V_c=V_e\ Cos\ (w_c t+P) \tag{5}$$

where:

$$V_e=\sqrt{(1+I)^2+Q^2}\ \text{(envelope function)} \tag{6}$$

and $$P=-\mathrm{Arctan}\ [Q/(1+I)]\ \text{(phase function)} \tag{7}$$

In general, even if I and Q are AC coupled signals, having no DC components, the envelope $V_e$ will still contain some DC or very low frequency components. Stated mathematically:

$$V_e=1+DC(t)+AC(t) \tag{8}$$

where $$DC(t)=\text{subsonic and DC components} \tag{9}$$

and $$AC(t)=\text{audio components} \tag{10}$$

Unfortunately, many conventional AM transmitters are not DC coupled at their audio frequency input, hence the DC and subsonic components of the input signal do not contribute to the modulation of the RF signal. The truncation of the frequency spectrum of the input signal in this fashion, however, results in harmonic distortion in the subsequently transmitted signal.

If the envelope function, however, is slowly gain varied, this DC component can be eliminated without introducing harmonic distortion in the envelope function or the I and Q functions. Thus, If the envelope of equation (8), above, is divided by the quantity [1+DC(t)], the resulting envelope function has the form:

$$V_e/[1+DC(t)]=1+AC(t)/[1+DC(t)] \tag{11}$$

It will be noted that the only DC component in this envelope function is the "1" corresponding to the quiescent carrier; the envelope signal does not, however, include any subsonic components. Therefore, AC coupling in the transmitter does not distort the modulated signal. Although this modification does introduce a small gain variation into the transmitted signal, the extent of the gain variation is relatively minor and will be generally unnoticeable in the resulting demodulated signal.

Figure 14:
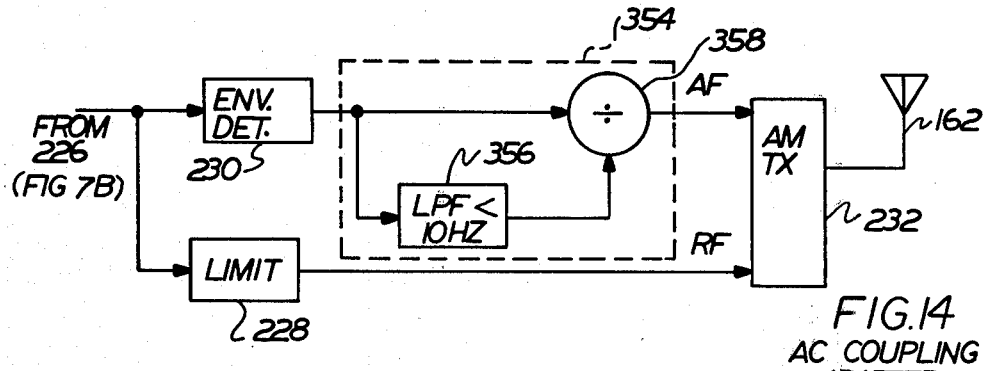
FIG. 14 illustrates one embodiment of an AC coupling adapter for use in conjunction with an AM transmitter.

FIG. 14 illustrates a broad block diagram of an AC coupling adapter for implementing this concept. For convenience of description, blocks of the FIG. 14 diagram which correspond with blocks in FIG. 7B have been correspondingly numbered. The input to the FIG. 14 circuit comprises the low level modulated RF signal which is to be transmitted by the AM transmitter 232. As described previously with respect to FIG. 7B, the envelope detector and limiter 228 separates this low level RF signal into an envelope signal and a phase modulated RF signal.

The envelope signal provided by envelope detector 230 corresponds to the envelope function described in the mathematical function of equation (8). The AC coupling adapter 354 processes this envelope signal so as to remove the DC components, in the fashion described hereinbefore. The AC coupling adapter 354 includes a low-pass filter 356 which essentially separates out the subsonic and DC components. A divider circuit 358 divides the envelope signal by these subsonic and DC components provided at the output of low-pass filter 356, so as to thereby provide a modified envelope signal having the form described in equation (11), above. This modified envelope signal is then provided to the AF input to the AM transmitter 232 in place of the envelope signal which would otherwise be provided directly thereto from the envelope detector 230.

The FIG. 14 AC coupling adapter depends for its operation upon the accuracy of division of divider circuitry 358. Imperfections in the divider or in the adjustment of the low-pass filter 356 may result in a division which does not completely cancel the DC and subsonic components.

Figure 15:
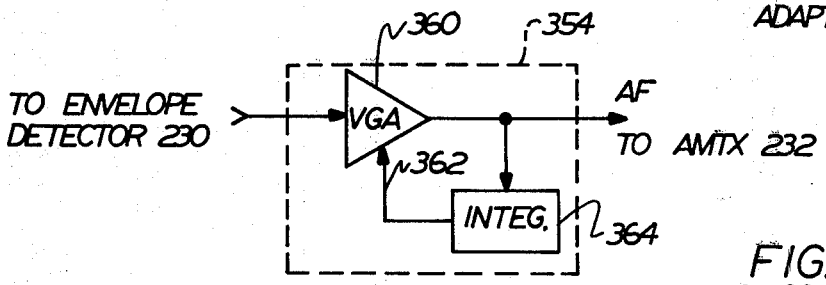
FIG. 15 illustrates an alternative embodiment of an AC coupling adapter.

The AC coupling adapter of FIG. 15 performs a function similar to the coupling adapter of FIG. 14. However, whereas the AC coupling adapter of FIG. 14 may be characterized as employing an open loop technique, the FIG. 15 adapter employes a closed loop approach. More specifically, the FIG. 15 AC coupling adapter 354 includes a voltage controlled, variable gain amplifier 360 whose gain is controlled by a signal supplied at a control input 362 thereto. The control signal for controlling the variable gain amplifier 360 is provided by an integrator circuit 364 whose input is derived from the output of the variable gain amplifier 360.

The integrator 364 essentially integrates the difference between the output of the variable gain amplifier and a fixed DC value, and provides a control signal on control line 362 which varies in such a fashion that the output of voltage control amplifier 360 maintains a DC value extremely close to this reference value. This feedback loop thus essentially varies the gain of the voltage control amplifier 360 so that the subsonic components of the envelope signal are cancelled.

Figure 16:
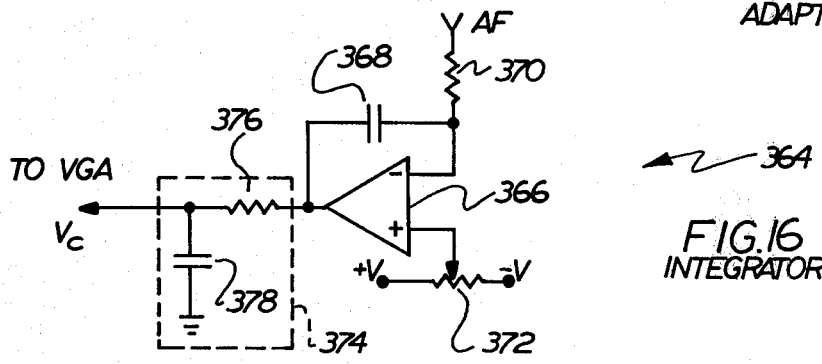
FIG. 16 provides a detailed circuit diagram of the integrator block of the AC coupling adapter of FIG. 15.

FIG. 16 illustrates one specific form which the integrator 364 of the FIG. 15 AC coupling adapter may take. This integrator includes an operational amplifier 366 having an integrating capacitor 368 connected between its output and inverting input. A resistor 370 couples the output of the voltage control amplifier 360 to the inverting input of amplifier 366. The output of operational amplifier 366 will essentially represent the integral of the difference between the audio frequency signal applied to the input of the integrator and the reference voltage applied to the noninverting input thereof. This reference signal is derived from the wiper arm of a potentiometer 372 which is interconnected between plus and minus supply voltages. As shown in FIG. 16, the integrator 364 includes a low-pass filter 374 at its output. This low-pass filter 374 takes the conventional form of a series resistor 376 and a shunt capacitor 378. The filtered output of this low-pass filter is provided to the control input of the variable gain amplifier 360.

Figure 17:
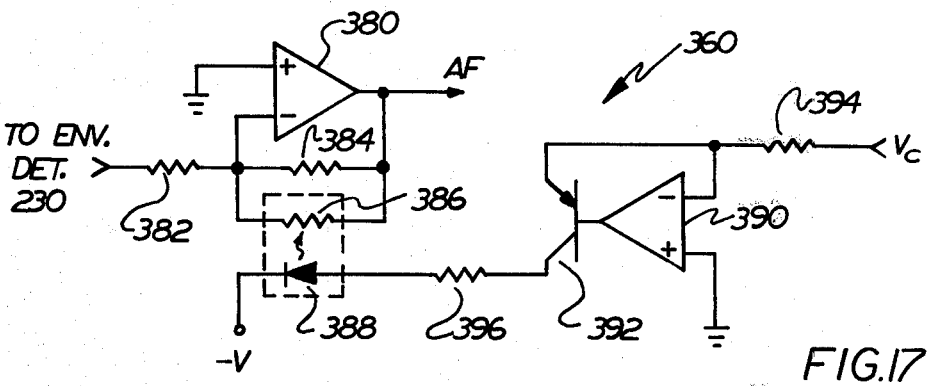
FIG. 17 is a detailed circuit schematic of the variable gain amplifier used in the AC coupling adapter of FIG. 15.

FIG. 17 illustrates one form which the variable gain amplifier 360 of FIG. 15 may take. In the embodiment illustrated in FIG. 17, the variable gain amplifier 360 includes an operational amplifier 380 connected in a conventional inverting amplifier mode. For proper phasing of the envelope signal, another inverting amplifier (not shown) having unit gain will follow amplifier 380. The operational amplifier 380 includes input and feedback resistors 382 and 384, respectively. The gain of the amplifier is determined by the ratio between the feedback resistance and the input resistance. Thus, the gain of the amplifier 380 may be varied by varying either the feedback resistance or the input resistance.

In FIG. 17, the feedback resistance is varied by connecting a photoresistor 386 in parallel with it. The resistance value of photoresistor 386 is directly dependent upon the amount of light impinging thereon. To control this resistance value, the photosensitive resistor 386 is optically coupled to a light emitting diode 388 which emits light approximately in proportion to the magnitude of current flowing therethrough. The resistance value of resistor 386, and thus the gain of amplifier 380 may therefore be controlled by controlling the magnitude of current flowing through light emitting diode 388.

To accomplish this, the circuitry of FIG. 17 includes a voltage-to-current converter comprised of another operational amplifier 390 having an PNP transistor 392 connected to the output thereof. The control voltage provided by integrator 364 is applied to the inverting input of operational amplifier 390 through an input resistor 394. The emitter of transistor 392 is also connected to the inverting input of amplifier 390. The noninverting input of amplifier 390, on the other hand, is connected directly to ground. The operational amplifier will adjust its output as needed to force the signal appearing at the inverting input thereof to the same voltage level as the noninverting input. Since the noninverting input is connected to ground, the inverting input will also, effectively, ride at a ground voltage level. Because of this, the magnitude of current flowing through resistor 394 will be directly dependent upon the magnitude of the control voltage $V_c$ applied thereto by the integrator 364.

Due to the extremely high input impedance of operational amplifier 390, the current flow through resistor 394 will pass into the emitter of transistor 392. Presuming that transistor 392 is selected to have a high gain, however, only a very small portion of this current will represent base current, with the majority thereof representing collector current. Thus, the current passing through the collector of transistor 392 will be directly proportional to the magnitude of the control voltage $V_c$. The collector of transistor 392 is, however, connected to the light emitting diode 388 through a resistor 396, so that the current flow through the light emitting diode 388 will similarly be controlled. The cathode of diode 388 will connected to any suitable negative voltage supply $-V$.

The distortion estimator which is illustrated in FIG. 5A is but one example of a form which a distortion estimator could take. In the FIG. 5A embodiment, the distortion estimate is developed by actually determining the form which the envelope of the resulting signal will take, and comparing this with the desired compatible form. Other distortion estimators may be constructed, however, which do not provide this type of closed loop distortion control. Thus, for example, the modulating signals themselves may be compared with preset limits to provide an incremental distortion estimate. FIG. 20 illustrates one form which such an incremental distortion estimator could take.

In understanding the distortion estimator of FIG. 20, reference should first be made to the vector diagrams of FIGS. 18 and 19. FIG. 18 represents the locus of points within which the vector 400 (representing the composite modulated signal) is constrained to fall. The maximum limits of the composite modulated signal vector 400 are determined by the limiter circuit, such as the limiter control illustrated in FIG. 8. The top and bottom boundaries on the (L+R) axis 402 represent the constraints that the L+R component not exceed +125% or −100%. The boundaries on the L−R axis 404 similarly represents the maximum modulation constraints of the L−R component, i.e., + and −100%. The diagonal boundaries, on the other hand, correspond with the 80% modulation constraints on the L and R vectors individually.

The amount by which the magnitude of vector 400 will be distorted from the compatible, (1+L+R) format will depend upon its location with the locus of points defined by FIG. 18. In general, distortion will exist only when the absolute magnitude of the (L−R) component is greater than zero, and in fact will occur primarily on the negative peaks of the (L+R) component. Utilizing these two facts, the vector locus of FIG. 18 may be broken into a number of different areas wherein the distortion within the defined area may be represented by a single, average distortion value.

FIG. 19 illustrates one fashion in which the FIG. 18 vector locus could be divided. If the vector 400 has an end point falling within region I, then the distortion may be approximated as zero, since the (L−R) vector will never represent more than a given percent of the (L+R) component. On the other hand, vectors having end points falling within region II are assigned an approximate distortion value of $K_1$, and those falling with regions III are assigned approximate distortion values of $K_2$.

Utilizing this weighting, a distortion estimator may be constructed which responds to the L+R and L−R components to provide an open loop approximation of the distortion which will be occasioned by those particular signals. One form of such a distortion estimator is illustrated in FIG. 20.

The distortion estimator of FIG. 20 includes four comparators 406, 408, 410 and 412. These comparators compare the magnitude of the L+R and L−R vectors with voltages representing the boundaries of regions I, II and III of FIG. 19. By comparing the magnitude of the L+R and L−R vectors with these references voltages, it can be determined whether or not the particular vector 400 defined by these two components falls within region I, II or III.

Comparator 406 compares the amplitude of the (L+R) component with reference voltage $V_1$, and will provide a high logic signal at its output only when this (L+R) component has a magnitude which is smaller than the reference voltage $V_1$. A comparator 408 compares the absolute value of the (L−R) component (as derived by a full wave rectifier circuit 414) with the reference voltage $V_2$. The output of comparator 408 will be at a high logic level only when the absolute value of the (L−R) component exceeds the reference voltage $V_2$. The outputs of both comparators 406 and 408 will therefore both be at a high logic level only when the amplitude of the (L+R) and (L−R) components is such that the vector 400 falls within either of regions II or III. A logic AND gate 416 logically "ANDs" the outputs of comparators 406 and 408, and thus will provide a high logic level output only when the composite vector 400 is within either region II or III of the vector locus, as illustrated in FIG. 19. In this event, a capacitor 418 will be charged towards a positive voltage through a resistor 420 having a resistance value of $R_1$.

The comparator 410 compares the magnitude of the (L+R) component with reference voltage $V_3$, whereas comparator 412 compares the absolute value of the (L−R) component with reference voltage $V_4$. The outputs of comparators 410 and 412 will both be at a high logic level only when the (L+R) and (L−R) components have the values necessary to place the vector 400 within region III of the vector locus illustrated in FIG. 19. In this event, the output of another AND gate 422 will shift to a high logic level, causing charging of the capacitor 418 through another resistor 424 having a value $R_2$.

Thus, whenever the vector 400 falls within the region identified as region I in FIG. 19, the outputs of both comparators 416 and 422 will be at a low logic level, hence whatever charge is carried on capacitor 418 will be discharging to ground through both resistors 420 and 424. If the vector 400 falls within region II, however, the output of AND gate 416 will be at a high logic level, while the output of AND gate 422 will remain at a low logic level. Consequently, in this event the capacitor 418 will be charging through resistor 420, and discharging through resistor 424. Finally, if the vector 400 falls within region III, then the outputs of both AND gates 416 and 422 will be high, hence the capacitor 418 will be charging through both resistors 420 and 424. It will therefore be seen that the voltage developed across capacitor 418 will be an approximation of the envelope distortion of a quadrature AM signal. This signal may be provided to the divider circuit 54 and pilot generator and modulator 60, in place of the gain control signal provided by distortion estimator 56 in FIG. 3. The gain signal would then vary linearly with the distortion estimate. If desired, a non-linear amplifier may be interposed between the capacitor 418 and the divider circuit 54 to introduce any desired non-linearity in the relationship between the distortion estimate and the gain signal.

Figure 21:
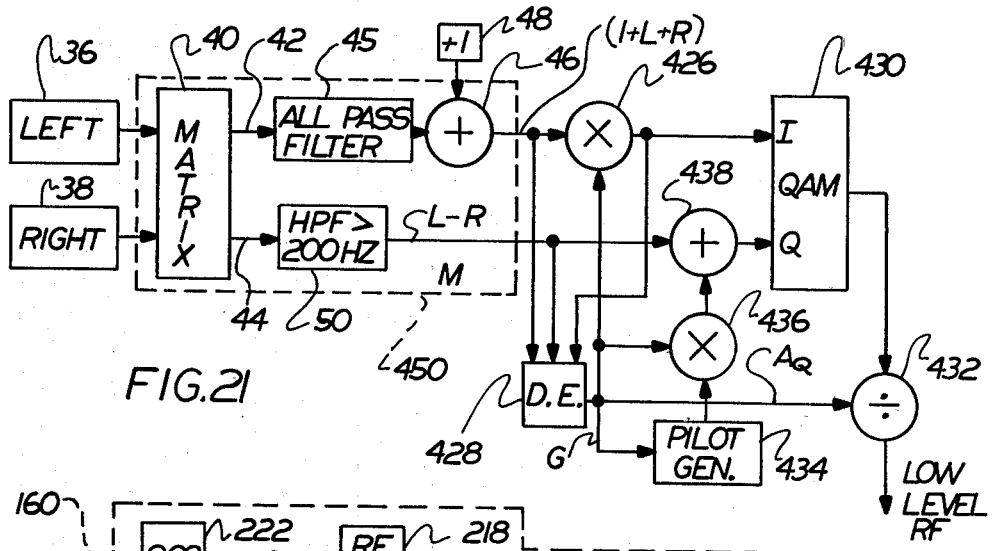
FIG. 21 is a broad block diagram of a modulator/-transmitter similar to that of FIG. 3, but where the gain of the in-phase channel is modulated.

FIG. 21 illustrates an alternative embodiment of the transmitter of FIG. 3, modified so that the gain of the in-phase channel is controlled, rather than the quadrature-phase channel as illustrated in FIG. 3. Again, for simplicity, portions of FIG. 21 which correspond with similar portions of FIG. 3 have been numbered correspondingly.

The transmitter embodiment of FIG. 21 provides a composite modulated signal having substantially the same form as that provided by the transmitter of FIG. 3. This composite modulated signal is generated in a slightly different fashion, however. Whereas both the FIG. 3 and FIG. 21 embodiments vary the phase angle between the L and R components of the composite modulated signal by changing the relative gains of the I and Q modulating signals, the embodiment of FIG. 21 accomplishes this relative gain change by means of a multiplier 426 in the I channel, rather than with a divider 54 in the Q channel, as in the FIG. 3 embodiment. This multiplier 426 will, of course, be controlled by the output of a distortion estimator 428. The gain adjusted I and Q signals are provided to a quadrature amplitude modulator 430 which provides at its output a composite modulated signal having those I and Q components. (The quadrature AM modulator 430 illustrated in FIG. 21 corresponds with elements 18–26 of the QAM transmitter of FIG. 7B). As with FIG. 3 embodiment, this composite modulated signal will include an envelope which will not be distorted from the compatible form by greater than a preselected amount.

The magnitude of this envelope signal, however, will vary with the gain of the in-phase component. Consequently, if the output of modulator 430 were directly provided to the transmitter for transmission, monophonic receivers would recover a signal whose loudness varied from time to time. To eliminate this loudness variation, an additional divider circuit 432 must be provided, also controlled by the gain control signal at the output of distortion estimator 428.

As before, this gain signal provided by distortion estimator 428 must be transmitted along with the composite modulated signal, and will preferably be incorporated into the quadrature-phase channel. To accomplish this, a pilot generator 434 is provided, which may be similar in form to either of the pilot signal generators and modulators illustrated in FIGS. 9 and 10. Because of the gain adjustment of the composite modulated signal introduced by the divider circuit 432, the contribution of the pilot to this composite modulated signal will also vary. Since it is desirable to provide a pilot having a fixed gain, however, a multiplier 434 must be provided, again controlled by the gain control signal provided at the output of distortion estimator 428, for multiplying the gain of the pilot signal so as to compensate for the division thereof by the divider circuit 432. This gain adjusted pilot signal is then added into the quadrature-phase channel by means of an adder circuit 438.

The distortion estimator 438 utilized in the FIG. 21 embodiment may have a form substantially identical to the distortion estimator 56 illustrated in FIG. 5A, except that an additional divider circuit must be provided to divide down the output of envelope generator 84 in accordance with the gain control signal provided by the attack/release circuit 106. The output of this divider circuit will then correspond to the envelope of the low level RF signal provided at the output of divider 432, and may be compared against the (1+L+R) signal in the subtractor circuit 86 of FIG. 5A.

The net result of the embodiment of FIG. 21 is exactly the same as that of the FIG. 3 embodiment. Thus, since the in-phase component is both multiplied (in multiplier 426) and divided (in divider 432) by the same signal, the gain of the I component will not vary. Similarly, since the pilot signal is multiplied (in multiplier 436) and divided (again in divider 432) the gain of the pilot signal is not varied. In fact, as in FIG. 3, it is only the Q component which suffers a net change in gain in the FIG. 21 embodiment.

Figure 22:
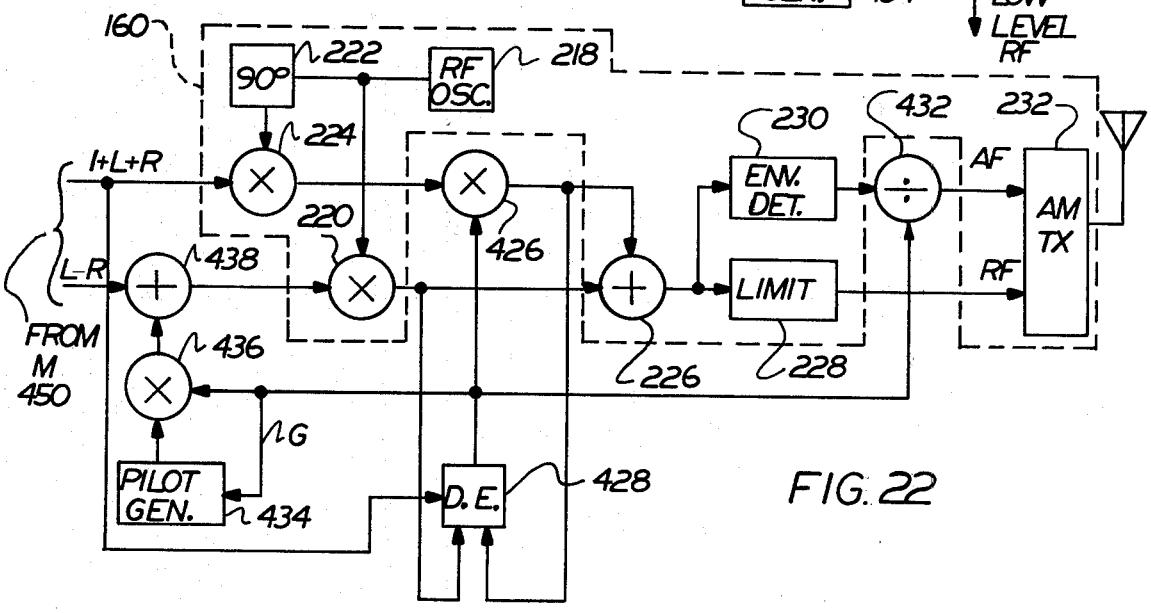
FIG. 22 is a broad block diagram of an alternative embodiment of the modulator/transmitter of FIG. 21.

The FIG. 22 embodiment is substantially similar to the FIG. 21 embodiment, except that the multiplication provided by multiplier 426 and division introduced by divider 432 are now inserted at different points in the transmitter circuitry. In FIG. 22, the QAM transmitter 160 of FIG. 7B is shown in its entirety, with corresponding blocks being numbered correspondingly. In this Figure the multiplier 426 is inserted immediately following the in-phase modulator 224, and hence operates upon an RF signal, rather than an audio frequency signal as in the FIG. 21 embodiment. Also, the division introduced by divider circuit 432 is now inserted following the envelope detector 230, and thus now operates upon an audio frequency signal, rather than a radio frequency signal as in the FIG. 21 embodiment.

The only additional point of departure of the FIG. 22 embodiment from the FIG. 21 embodiment is that the distortion estimator 428 must include some means for generating the envelope signal otherwise provided by the envelope generator 84 (see FIG. 5A). To derive this envelope signal, the distortion estimator 428 will include an adder circuit for adding together the outputs of multipliers 220 and 426, together with an envelope detector for detecting the envelope of the sum thereof. Also, a divider circuit must, of course, again be provided to compensate the gain of the resulting envelope signal for the multiplication introduced by multiplier circuit 426.

Figure 23:
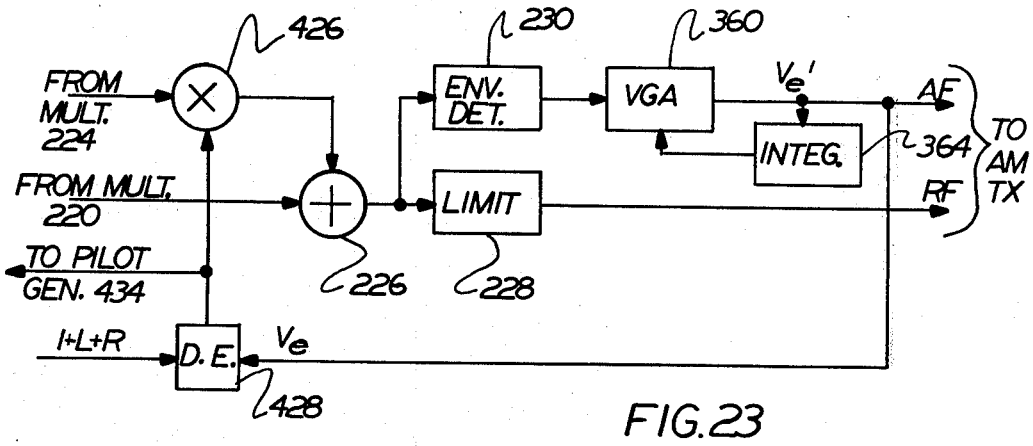
FIG. 23 is a broad block diagram of a portion of another alternative embodiment of the modulator/-transmitter of FIG. 21.

FIG. 23 illustrates a somewhat simplified form of the FIG. 22 circuit. In the FIG. 23 embodiment, the divider 432 is replaced by an AC coupling adapter, such as circuit 354 of FIG. 15. Thus, a variable gain amplifier 360 is provided for adjusting the gain of the envelope signal, and is controlled by the output of an integrator 364. As described previously, the function of this AC coupling adapter is to gain stabilize the envelope signal, hence it will automatically provide the function of the divider circuit 432, while also providing the benefits of eliminating the subsonic components in the fashion previously described. The distortion estimator 428 can now be further simplified by simply taking the output of the variable gain amplifier 360 and providing it to the distortion estimator 428 as the envelope signal.

Figure 24:
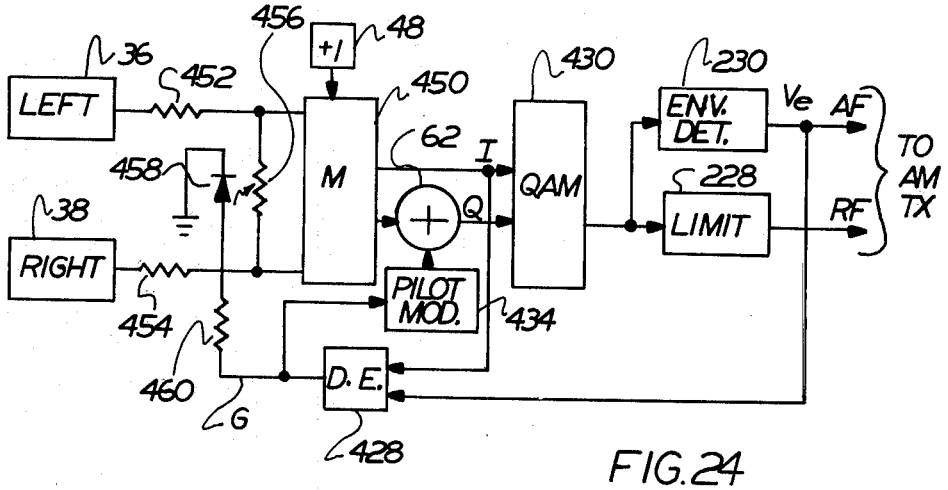
FIG. 24 is a broad block diagram of another embodiment of a modulator/transmitter in accordance with the teachings of the present invention, wherein the angle variation is accomplished by dynamic blending of the left and right signals.

FIG. 24 illustrates another approach for varying the angle between the L and R vectors of the composite modulated signal. In the FIG. 24 embodiment, this angle is changed, not by directly changing the gain of the in-phase or quadrature-phase modulating signals, but rather by dynamically blending the L and R signals at the input to the audio matrix. To accomplish this, input resistors 452 and 454 are respectively provided between signal sources 36 and 38 and matrix circuit 450 (which was shown in greater detail in FIG. 21). A photosensitive shunt resistor 456 is connected between the two inputs to the matrix circuit 450, and will provide blending of the left and right signals by an amount which is dependent upon the resistance value thereof. The effect of this blending is to reduce the difference between the L and R signals or, stated differently, to diminish the amplitude of the (L−R) component.

Photosentive resistor 456 is optically coupled to and controlled by a light emitting diode 458. The light emitting diode 458 is connected to the output of distortion estimator 56 through a dropping resistor 460, hence the level of current passing through the light emitting diode 458 will be directly dependent upon the voltage signal provided at the output of distortion estimator 56. If desired, a voltage-to-current convertor such as shown in FIG. 17 could be inserted between the distortion estimator 56 and the dropping resistor 460. The remainder of the transmitter of FIG. 24 is substantially the same as the transmitter of FIG. 3, except that the divider 56 has been eliminated and the envelope signal is returned from the envelope detector 230, rather than being synthesized within the distortion estimator, itself.

In the embodiments which have heretofore been described, the angle between the L and the R vectors of the composite modulated signal has been effectively varied by directly or indirectly varying the relative gains of the in-phase and quadrature-phase modulating signals. Of course, the composite modulated signal may also be derived by directly modulating two differently phased carriers by the L and R vectors, and dynamically varying the phase angle between the two RF carriers thus modulated. This approach is employed in the alternative embodiment modulator/transmitters described hereinafter in FIGS. 25–28.

Figure 25:
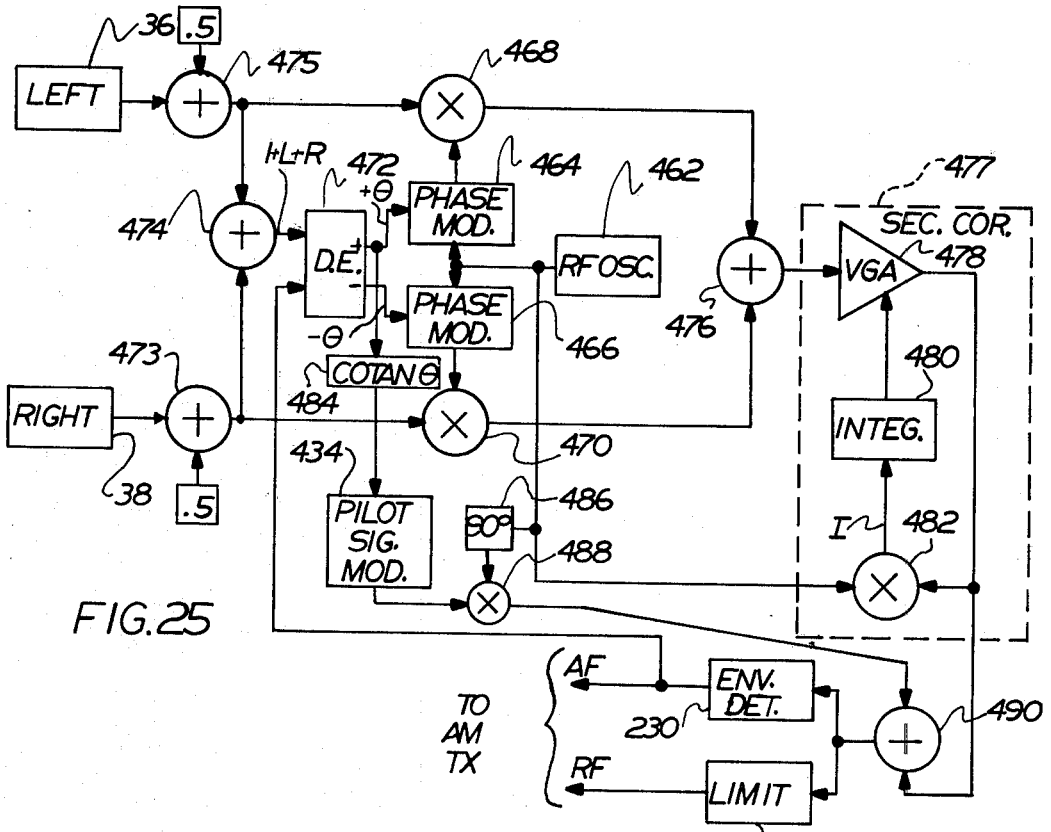
FIG. 25 is a broad block diagram of another embodiment of a modulator/transmitter in accordance with the teachings of the present invention, generally accomplishing the generation of the composite modulated signal by directly varying the phase angle between two modulated carriers.

Referring first to FIG. 25, a modulator/transmitter is illustrated wherein an RF oscillator 462 provides an RF signal having a constant frequency and amplitude. This RF signal is phase shifted in equal and opposite directions by two phase modulators 464 and 466. The resulting phase shifted carrier signals are each modulated by a corresponding source signal in respective modulators 468 and 470.

The phase modulators 464 and 466 are controlled by a distortion estimator 472. Distortion estimator 472 again may have substantially the same form as illustrated in FIG. 5. The (+) output of distortion estimator 472 will correspond with the output of the attack/release circuit 106, whereas the (−) output of distortion estimator 472 will be derived from an inverting amplifier (not shown) whose input is the (+) output of distortion estimator 472. Consequently, the two outputs of distortion estimator 472 will have equal magnitudes, but will be of opposite polarities, thereby insuring that the amount of phase shift provided by phase modulators 464, 466 will be of equal magnitude, but in opposite directions.

The distortion estimator 472 of FIG. 25 is provided with an envelope signal from the output of envelope detector 230. The distortion estimator compares this envelope signal with a compatible (1+L+R) signal formed by an adder circuit 474.

When the phase shifted signals at the outputs of phase modulator 464, 466 are modulated by the L and R signals provided by signal sources 36 and 38 (including DC components added in by adders 473, 475), and then added together in adder circuit 476, the resulting modulated signal will have the form defined by the bracketed mathematical expression in equation (2), above. This modulated signal, although having a phase angle which dynamically varies with the amount of distortion in the envelope, differs somewhat from the desired form since the gain of the in-phase (1+L+R) component varies with the cosine of the phase angle. Consequently, to obtain a gain stable in-phase component, it is necessary to correct the gain of the modulated signal provided by adder 476 in accordance with the secant of the phase angle $\theta$.

Secant correction can be implemented in many ways. In the FIG. 25 embodiment, secant correction is introduced by a variable gain amplifier 478 which modifies the gain of the signal at the output of adder 476 in accordance with a control signal provided by an integrator 480. Integrator 480 and variable gain amplifier 478 function in essentially the same fashion as the AC coupling adapter illustrated in FIG. 15, except that the input to the integrator 480 corresponds to only the in-phase component of the composite modulated signal. A product detector 482 recovers this in-phase component by multiplying the composite modulated signal at the output of variable gain amplifier 478 by the RF carrier signal provided by RF oscillator 462.

In operation, this secant corrector will dynamically adjust the gain of the modulated signal so that the DC value of the in-phase component will be stabilized. Since this DC value varies with the gain changes introduced by dynamic phase angle variations, the resulting gain correction factor exactly compensates for the gain variation of the in-phase component introduced by the varying phase angle. The output of the secant correction circuit 477 will therefore have substantially the form defined by the mathematical expression of equation (2).

As with previous embodiments, the FIG. 25 embodiment includes means for generating a pilot signal and for adding the pilot into the composite modulated signal which is transmitted. In previous embodiments, of course, the output of the distortion estimator 472 corresponded with the gain control signal and thus could be used to directly frequency modulate or amplitude modulate a pilot signal. In the FIG. 25 embodiment, however, the distortion estimator is included within a closed loop which controls, not the gain of the quadrature-phase component, but rather the phase angle between the L and the R vectors. Consequently, the control signal at the output of distortion estimator 472 now represents the phase angle $\theta$. To generate a pilot signal having the same form as in previous embodiments, thus, it is necessary to convert the signal at the output of distortion estimator 472 from a representation of the angle between the L and the R vector to a representation of the gain of the quadrature-phase component.

As is brought in equation (3), above, the phase angle varies as the arctangent of the reciprocal of the gain signal. Consequently, to convert the phase angle signal back into a gain signal, it is necessary to take the cotangent of the phase signal. FIG. 25 thus includes a function generator 484 whose output corresponds to the cotangent of the input. Cotangent function generator 484 may simply be an amplifier having its transfer characteristics modified in a piecewise-linear fashion to correspond to the cotangent function. The output of cotangent function generator 44 will therefore be a signal G which varies inversely with the gain of the quadrature-phase component of the composite modulated signal. This gain signal controls a pilot signal generator and modulator 434 which generates a pilot signal modulated in accordance therewith.

To insert this modulated pilot signal into the quadrature-phase channel, a modulator 488 modulates a quadrature-phased RF carrier signal (provided by phase-shifter 486) with the modulated pilot signal. The resulting RF pilot component is then added into the composite modulated signal at the output of secant corrector 477 by an adder circuit 490.

As with previous embodiments, the composite modulated signal must be processed so as to include a notch in the frequency spectrum of the (L−R) channel into which this pilot signal may be inserted. This will preferably be accomplished in the FIG. 25 embodiment by providing the left and right signals, not directly from left and right signal sources 36 and 38, but rather through a filter network such as network 154 of FIG. 7A.

Figure 26:
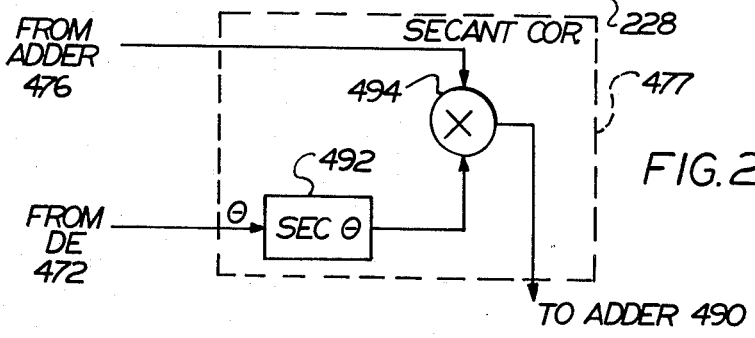
FIG. 26 illustrates an alternative embodiment of the secant correction block of the modulator/transmitter of FIG. 25.

FIG. 26 illustrates an open loop implementation of the secant correction block 477 of FIG. 25. In this Figure, a function generator 492 responds to the phase signal provided by distortion estimator 472 to directly generate a signal which varies as the secant thereof. The circuit 492 may, again, be simply an amplifier having an appropriately tailored transfer characteristic. The composite modulated signal at the output of adder 476 is then modulated in accordance with this secant signal by a multiplier 494. The resulting composite modulated signal, again, has the form defined in the mathematical expression of equation (2), above.

Figure 27:
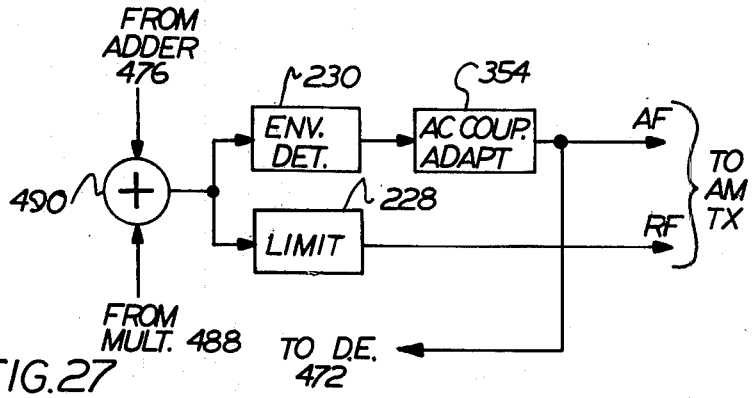
FIG. 27 illustrates a broad block diagram of a portion of another embodiment of the modulator/transmitter illustrated broadly in FIG. 25.

FIG. 27 illustrates still a third possible implementation of secant correction for use in a circuit such as that of FIG. 25. In the FIG. 27 embodiment, the secant corrector block 477 is removed from the circuit. Thus, the output of adder 476 is directly provided to the input of adder 490. As with the embodiment of FIG. 25, the output of adder 490 is provided to an envelope detector 230 and a limiter 228 so as to separate the composite modulated signal into an audio frequency envelope function and a radio frequency signal having a phase which varies with the phase of the composite modulated signal. Secant correction is incorporated into this embodiment by simply providing an AC coupling adapter such as AC coupling adapter 354 of FIGS. 14 and 15. This AC coupling adapter will automatically adjust the gain of the envelope signal so that the DC component thereof has a fixed amplitude, thereby providing the necessary secant correction.

The approach of FIG. 27 will also incidentally modulate the amplitude of the pilot signal. A slightly different approach which would avoid this would be to provide the envelope signal from envelope detector 230 to the integrator 480 of FIG. 25. Since the gain variation would then occur prior to the pilot insertion, pilot gain would be unaffected.

Figure 28:
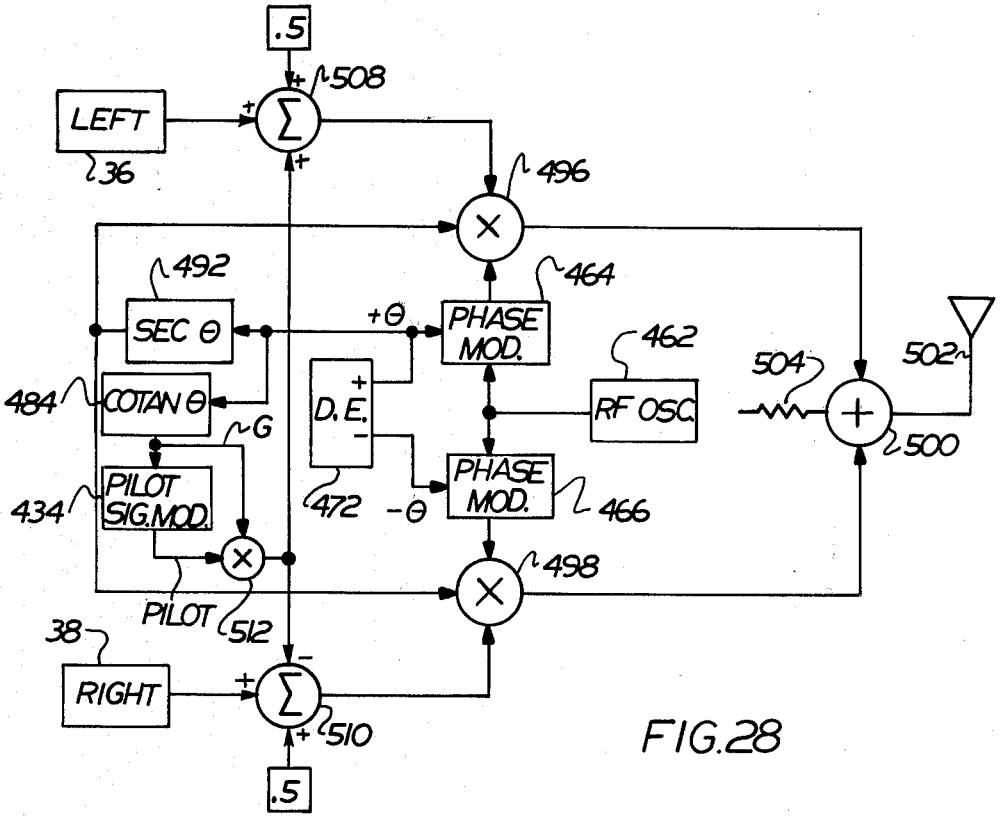
FIG. 28 illustrates an alternative embodiment of a modulator/transmitter in accordance with the teachings of the present invention, wherein two high level modulators are employed.

FIG. 28 illustrates an approach which is quite similar in many respects to that of the FIG. 25 embodiment, except that the low level RF modulators 468 and 470 are replaced by high level modulators 496 and 498. Thus, the FIG. 28 embodiment, also, includes an RF oscillator 462, two variable phase shifters 464 and 466, and a distortion estimator 472. The signals provided by these two high level modulators, when combined in a conventional hybrid 500, provide a high level modulated RF signal having sufficient power to be directly broadcast, without further amplification. Thus, the sum port of the hybrid 500 will be connected to the antenna 502, whereas the difference port will be connected to a reject load, illustrated in FIG. 28 schematically at 504. In this embodiment, secant correction is provided in a manner similar to that of FIG. 26, in that a secant function circuit 492 is provided which responds to the output of the distortion estimator 472 to provide a signal which varies as the secant of the phase angle between the L and the R modulated components. In the FIG. 28 embodiment, however, this secant correction signal is applied to the gain control inputs conventionally provided for modulators 496 and 498.

As in the FIG. 25 embodiment, the FIG. 28 embodiment includes a pilot circuit for generating and modulating a pilot signal in accordance with the varying gain of the quadrature-phase channel. This pilot circuit again includes a cotangent function generator 484 and pilot signal generator and modulator 434, as in FIG. 25. In the FIG. 28 embodiment, it is not convenient to modulate an RF carrier signal with the modulated pilot signal and to then add this RF pilot signal into the composite modulated signal. Instead, in the FIG. 28 embodiment, the pilot is incorporated into the transmitted signal by adding it to the left channel and subtracting it from the right channel. Thus, in the FIG. 28 embodiment, the summing circuit 508 sums the left channel signal together with a DC component and the pilot signal to form the signal which is provided to the high level modulator 496, whereas a summing circuit 510 adds the right signal and its DC component, while subtracting the pilot signal therefrom so as to provide the signal which is supplied to the high level modulator 498. Because the pilot signal is added to the L channel while subtracted from the R channel, the pilot will essentially cancel out in the sum (in-phase) channel, thus appearing exclusively in the difference (quadrature-phase) channel. The high level modulators of the FIG. 28 embodiment will gain vary the pilot signal along with the gain variations in the rest of the quadrature-phase channel. To avoid this, a multiplier circuit 512 is provided for multiplying the pilot signal by the same factor by which it is subsequently divided in high level modulators 496 and 498. The result of this is to gain stabilize the pilot signal in the resulting transmitted composite modulated signal.

FIG. 29 illustrates still another embodiment which is again very similar to that illustrated in FIG. 25. In this embodiment, however, a modified phase shifter 514 is provided in place of the phase modulators 464 and 466 of the FIG. 25 embodiment. This circuit 514 phase shifts the carrier signals at the two outputs thereof by equal and opposite amounts from the RF carrier signal provided by RF oscillator 462, in accordance with the arctangent of the signal provided at the input thereof. From equation (3), above, it can thus be concluded that the input signal provided thereto will vary as the reciprocal of the gain of the quadrature phase channel (i.e., will represent the gain signal G). Moreover, this modified phase shifter 514 also incidentally amplitude modulates the phase shifted carriers in accordance with the secant of the phase angle $\theta$, thereby eliminating the need for a separate secant correction circuit at the output of the adder 476.

Since the secant correction circuit has been eliminated, the pilot signal can now be added directly into the composite modulated signal at the adder 476. To this end, the output of the distortion estimator 428 (which represents G rather than $\theta$) is provided directly to a pilot signal generator and modulator 434. Generator and modulator 434 provides at its output the modulated pilot signal which is to be transmitted along with the composite modulated signal. The pilot signal is modulated onto a quadrature-phased carrier by a modulator 516 whose quadrature-phased carrier is provided by a 90° phase shift circuit 518. The signal at the output of multiplier 516 is thus a quadrature-phased RF carrier signal having the pilot signal modulated thereon. This RF signal is simply added into the composite modulated signal in the adder circuit 476.

In the FIG. 29 embodiment, the audio signals provided by left and right signal sources 36 and 38 are not level shifted as are those in the FIG. 25 embodiment. Consequently, the output of modulators 468 and 470 will not include quiescent carrier components. To provide the quiescent, in-phase carrier component, the FIG. 29 embodiment adds the output of RF oscillator 462 into the composite modulated signal, again through the adder circuit 476. Also, since there is no DC component in the two audio signals, the adder circuit 474 must combine the sum of the L and the R signals with a DC component provided by circuit 520, to generate the compatible (1+L+R) signal required by distortion estimator 428.

FIG. 30 illustrates one specific form which the modified phase shifter 514 of FIG. 29 may take. In general, the modified phase shifter 514 generates the phase shifted signal by linearly combining the output of the RF oscillator 462 with a quadrature-phased carrier (provided by 90° phase shifter 518) of varying amplitude. Thus, to provide the carrier signal which is phase shifted in the positive direction, the output of 90° phase shifter 518 is divided by the factor G by a divider circuit 522 with the resultant gain varied quadrature-phase carrier being added together with the in-phase carrier in an adder circuit 524. The resulting RF carrier signal will have a phase angle with respect to the RF signal provided by oscillator 462 which varies in accordance with the varying input signal G, and will also have a varying amplitude.

To provide a carrier signal which is phase shifted in the negative direction, the output of divider 522 is subtracted from the in-phase carrier in a subtractor 530. The output of subtractor 530 will be an RF carrier signal phase shifted by the same amount, but in the opposite direction of the RF carrier signal provided by adder circuit 524.

The operation of modified phase shifter 514 may perhaps be more readily understood through reference to the vector diagram of FIG. 31. In this Figure, the horizontal vector 532 represents the RF carrier signal provided by oscillator 462. Since the contribution of this carrier signal to the output of adder 524 is constant, it is represented for definitional purposes as having a magnitude of "1". The quadrature-phased component is represented by vector 534 and, in FIG. 31, is oriented at 90° with respect to vector 532 since the signals which they represent are orthogonally phased. The magnitude of this vector is represented in FIG. 31 as (1/G) since it is attenuated by a factor of G in the divider circuit 522.

The RF carrier signal at the output of adder 524 is the vector sum of vector 532 and 534, and thus corresponds with vector 536 of FIG. 31. This vector will form an angle of 0 with respect to vector 532, and will have an amplitude equal to the square root of the sum of the squares of the amplitude of vectors 532 and 534. From basic trigonometry it follows that the phase angle $\theta$ will have a value equal to arctan (1/G) and the amplitude will have a value equal to secant $\theta$. Thus, the simple circuit of FIG. 30 not only properly varies the phase angles of the two RF signals in response to a signal which varies directly with the gain of the quadrature-phase channel, but also varies the magnitude of these RF carrier signals in exactly the fashion required to compensate for the gain variations which would otherwise exist in the composite modulated signal.

In the embodiments which have heretofore been described, the gain of the quadrature phase component is continuously variable (between preselected limits) to limit the amount of distortion in the envelope of the composite transmitted signal. In FIGS. 32–35, to be described hereinafter, the gain is instead varied in an incremental fashion, jumping from one discrete gain value to the next as required to maintain the distortion in the envelope below a preselected limit.

Figure 32:
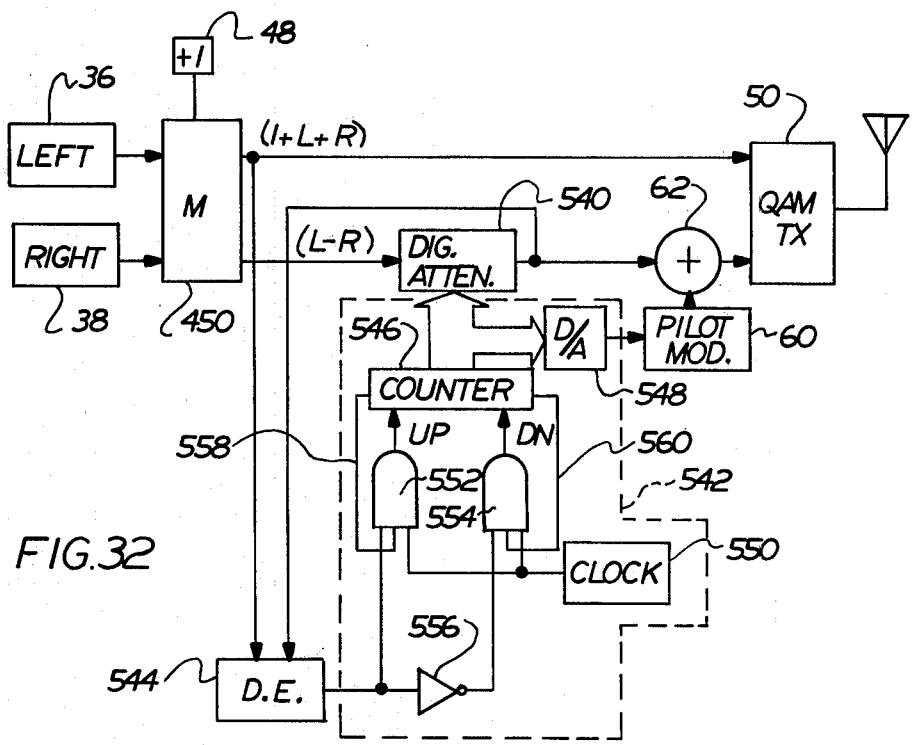
FIG. 32 is a block diagram of an embodiment of a modulator/transmitter in accordance with the teachings of the present invention, utilizing closed loop distortion estimation and incremental gain shifting.

The FIG. 32 embodiment is very similar to the embodiment illustrated in FIG. 3, and, as with previous embodiments, those portions of the FIG. 32 embodiment which correspond to similar portions of the FIG. 3 embodiment have been correspondingly numbered. The FIG. 32 embodiment differs from the FIG. 3 embodiment in that the linear divider circuit 54 has been replaced by a digital attenuator 540, and in that the attack/release circuit 106 (FIG. 5A) of the distortion estimator 56 has been replaced by a digital attack-/release circuit 542.

The digital attenuator 540 may take any conventional form and may, for example, include an operational amplifier whose gain is equal to the ratio of a feedback resistance to an input resistance, wherein the input resistor is now variable in accordance with a digital control signal. This input resistor may, for example, comprise the series of parallel connected resistors, with each of the resistors having a solid state switch connected in series therewith, each switch being controlled by a corresponding bit of a digital control word. The total resistance of this network will be equal to the parallel combination of those resistances whose switches are closed at any given time. Consequently, by varying the digital word which controls these solid state switches, the input resistance and thus the gain of the amplifier may be varied. Moreover, if the parallel-connected resistors have values which follow a binary progression, then a binary coded digital word may be used to control those switches.

Variations in the value of this input resistance affect the gain of the attenuator in an inverse relationship; that is, the greater the input resistance, the smaller the gain of the attenuator. Consequently, the digital attenuator 540 acts as a divider circuit, wherein the amount of division is dependent upon the digital control word provided thereto.

The digital attack/release circuit 542 which controls the digital attenuator 540 is, in turn, controlled by the output of a distortion estimator 544. Distortion estimator 544 may essentially be identical to the distortion estimator illustrated in FIG. 5, except that the output will now be taken from comparator 104, rather than from attack/release circuit 106. It will be recalled that the output of comparator 104 (and thus the output of distortion estimator 544 of FIG. 32) will remain at a low logic level until the distortion in the envelope of the composite modulated signal exceeds a predetermined limit. The output of the distortion estimator 544 will shift to a high logic level when this limit is exceeded.

In FIG. 32, the digital attack/release circuit 542 includes a counter 546 whose accumulated count is provided to, and controls the digital attentuator 540. Thus, this accumulated count corresponds to the gain signal G. A digital-to-analog converter 548 converts this digital gain signal into an analog signal and provides it to a pilot generator and modulator 60. The gain signal G will be modulated onto a pilot and added into the quadrature phase channel by the adder 62.

The count contained within counter 546 is incremented or decremented in accordance with the control signal provided by the distortion estimator 544. Actual incrementing and decrementing of the count in counter 546 is controlled by clock pulses provided by clock circuit 550, as gated to UP and DOWN inputs to the counter 546 through AND gates 552 and 554. These AND gates are enabled or disabled under control of the logic signal provided by distortion estimator 544. Thus, the output of distortion estimator 544 is directly supplied to one input of AND gate 552, and is provided through an inverter 556 to the AND gate 554.

When the amount of distortion in the envelope of the composite modulated signal exceeds the predetermined limit, the output of the distortion estimator 544 will shift to a high logic level. This will enable AND gate 552 to pass the clock pulses provided by clock circuit 550. Consequently, as long as the distortion exceeds the predetermined limit the clock pulses provided by clock circuit 550 will be gated into the UP input in counter 556, thereby causing the gain signal to be incremented, and the gain of the (L−R) component to be diminished. At the same time, AND gate 554 will be disabled, since the output of inverter 556 will be at a low logic level.

When the output of distortion estimator 554 shifts to a low logic level again, indicating that the distortion in the envelope of the composite modulated signal is now within acceptable limits, the AND gate 552 will be disabled. The high logic level then appearing at the output of inverter 556 will, however, enable AND gate 554. Consequently, in this condition the clock pulses provided by clock circuit 550 will be gated through AND gate 554 to the DOWN input of counter 546, thereby causing the count contained within counter 546 to be decremented.

If desired the clock circuit 550 may provide clock signals having different frequencies to the AND gates 552 and 554, thus making the attack and decay times different. For example, the rate of the clock provided to AND gate 552 could be made ten times the rate of the clock provided to AND gate 554, thereby making the gain signal attack ten times faster than its decay.

As stated earlier, the gain of the (L−R) channel should be confined to within a predetermined range (corresponding to phase angles of between 30° and 90°). To this end, the AND gates 552 and 554 will each include a third input, controlled by the overflow and underflow outputs of counter 546. These outputs will normally be at a high logic level, hence the operation of the digital attack/release circuit 542 will be as described above. If the count contained within counter 546 reaches the maximum allowed count, however, the overflow output 558 of counter 546 will shift to a low logic level, thereby disabling the supply of further clock pulses to the UP input of counter 546 from clock circuit 550. Similarly, if the count contained within counter 546 reaches the lowest allowed count, the underflow output 560 thereof will shift to a low logic level, thereby disabling the supply of further clock pulses to the DOWN input of counter 546 from clock circuit 550.

In operation, the incremental gain shifting circuit of FIG. 32 will be adjusted by the feedback loop so as to have the gain value necessary to maintain the distortion in the envelope of the composite modulated signal below the predetermined limit set into the distortion estimator 544.

Figure 33:
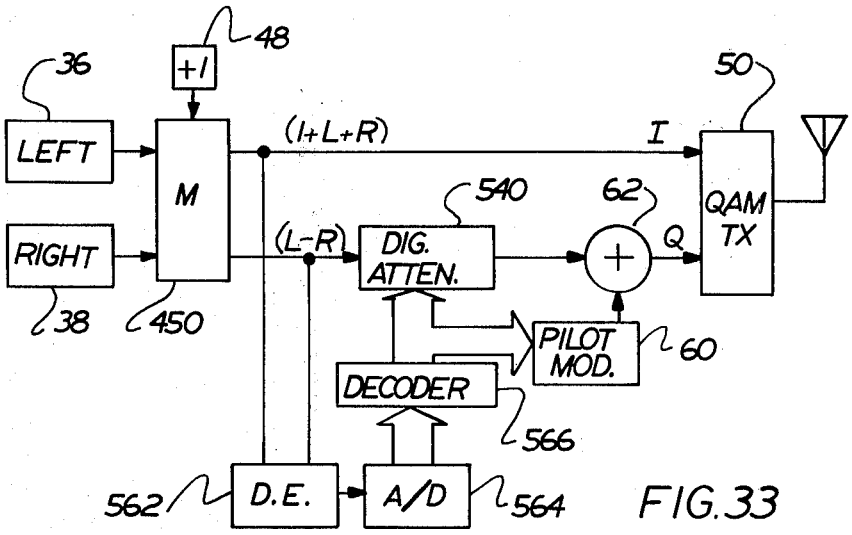
FIG. 33 is a block diagram of still another embodiment of a modulator/transmitter in accordance with the teachings of the present invention, employing open loop distortion estimation and incremental gain shifting.

FIG. 33 illustrates an open loop embodiment of a transmitter in accordance with the teachings of the present invention, again utilizing incremental gain shifting rather than infinitely variable gain shifting as in the embodiment of FIG. 3. In the FIG. 33 embodiment, the (L−R) input to distortion estimator 562 is derived directly from the output of circuit 450, rather than from digital attenuator 540. Consequently, the distortion estimate provided at the output of divider circuit 90 (FIG. 5A) will correspond with a measure of the amount of distortion which will be present in a full quadrature modulated signal employing the in-phase and quadrature-phase components provided at the outputs of circuit 450. Since the necessary gain signal to reduce this distortion to a lower, preselected limit is directly related to this measure of distortion, the output of divider 92 may be directly used to control the digital attenuator 540. Consequently, distortion estimator 562 (which may also have the form illustrated in FIG. 20) provides at its output a signal corresponding to the output of capacitor 418 of FIG. 20, or of divider 92 of FIG. 5A. An analog-to-digital converter 564 converts this analog measure of distortion into a corresponding digital word, then supplies that word to a decoder circuit 566. The decoder circuit 566, which may be a programmed logic array (PLA), read only memory (ROM), etc., will translate the digital signal at the output of analog-to-digital converter 64 into the digital gain signal necessary to reduce the distortion to below predetermined limits. The output of decoder 566 is provided to the digital attenuator 540 to control the amount of attenuation of the (L−R) component. As before, this gain signal is also provided to pilot generator and modulator 60 for provision of a pilot signal to be transmitted along with the composite modulated signal.

Figure 34:
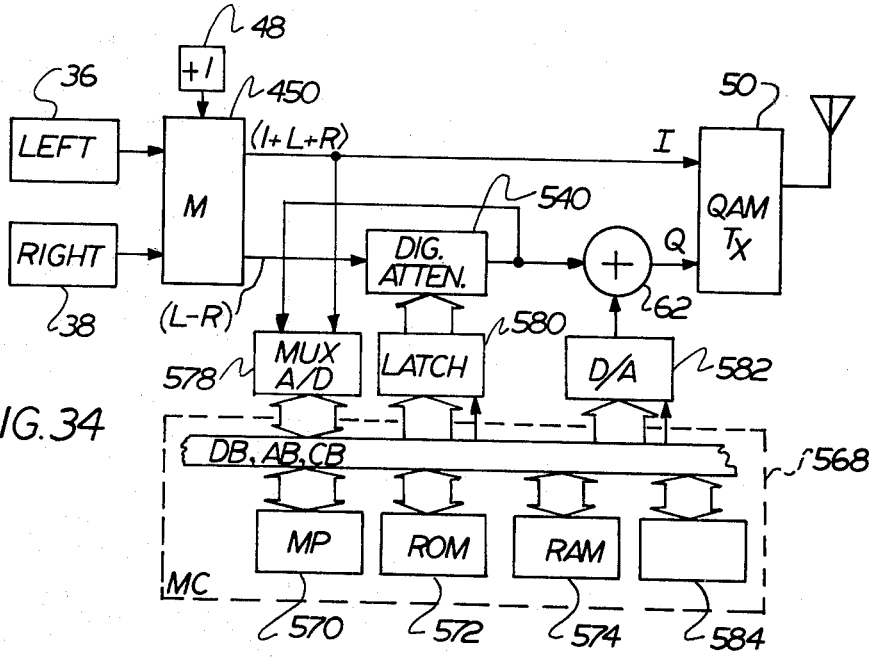
FIG. 34 is a block diagram of yet another embodiment of a modulator/transmitter in accordance with the teachings of the present invention, wherein a microprocessor is used to control a digital attenuator.
Figure 35:
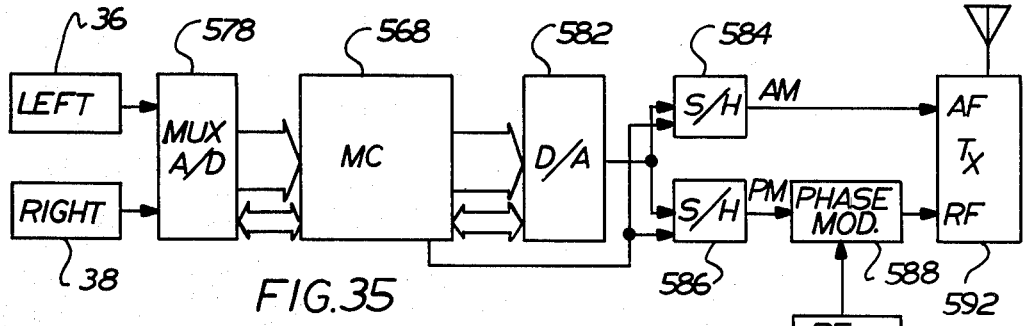
FIG. 35 is a block diagram of another microcomputer-oriented modulator/transmitter in accordance with the teachings of the present invention.

In the embodiments of FIGS. 34 and 35, an even more completely digital approach is taken. Thus, in the FIG. 34 embodiment, a microcomputer is used to calculate the gain signal for application to the gain shifter 540, and is also used to synthesize the pilot signal which is transmitted along with the composite modulated signal. In the FIG. 35 embodiment, all audio processing is done by the microcomputer.

In FIG. 34, a microcomputer system 568 is provided consisting of a conventional microprocessor 570 together with associated solid state memory 572 and 574. The microprocessor is interconnected with the memory 572 and 574 as well as other peripheral components via a system bus 576 including a data bus, address bus, and control bus. The program instructions for controlling the operation of the microprocessor 570 will be permanently stored within a read-only memory (ROM) 572, whereas the random access memory (RAM) 574 will be used for providing working storage during the operation of the system.

The (1+L+R) and gain controlled (L−R) signals are loaded into the microcomputer 568 through a multiplexing analog-to-digital converter 578. The analog inputs to the converter 578 are coupled to an A/D converter through a multiplexer so that either one of the two inputs can be digitized at any given time under control of the microprocessor 570 via the system bus 576. During normal operation the microprocessor 570 alternately reads the in-phase and gain shifted quadrature-phase channels through the multiplexing A/D converter 578, utilizing the resulting digitized signals to determine the appropriate control word to be provided to the digital attenuator 540. This control word is stored in a latch 580, loaded from the system bus 576. The control word stored within the latch 580 is updated periodically, depending upon the content of the two signals loaded into the microprocessor via A/D 578. The microcomputer system 568 also synthesizes a digital signal having a value which varies with the desired variations in the modulated pilot signal, whether AM or FM. These digital words are converted to analog by a digital-to-analog (D/A) converter 582. The resulting analog signal, corresponding to the modulated pilot signal, is then supplied to one input of adder circuit 62 for inclusion in the quadrature phase component of the composite modulated signal.

The microcomputer system 568 may, of course, include other peripherals (schematically indicated at 584) for providing timing or "number crunching" functions, for outputting engineering information, status information, etc.

The microcomputer system 568 may, of course, be programmed to perform the required operations in many different ways. For example, microcomputer 568 may be programmed to perform the following steps:

| Step | Description |
|---|---|
| 001 | Read in (1+L+R) and (L−R) via A/D 578. |
| 002 | Calculate instantaneous $V_e$ based upon values read in step 001. |
| 003 | Subtract a fixed number from the $V_e$ value calculated in step 002 to eliminate the DC component thereof. |
| 004 | Update a stored RMS value of the envelope based upon the envelope signal $V_e$ derived in step 003. |
| 005 | Subtract (1+L+R) from the instantaneous envelope $V_e$ as calculated in step 002 to thereby generate a distortion signal. |
| 006 | Perform digital filtering (weighting) of distortion signal as derived in step 005. |
| 007 | Update the stored RMS value of the distortion signal upon the basis of the value determined in step 006. |
| 008 | Multiply the RMS value derived in step 007 times a constant (accomplishes the same scaling function as potentiometer 102 of FIG. 5B). |
| 009 | If the result of step 008 is greater than the result of step 004 and if the result of step 004 is greater than a preset limit (e.g., corresponding to approximately 5% modulation), then increment a stored value of G and go to step 011. |
| 010 | Otherwise decrement the stored value of G, |

-continued

| Step | Description |
|---|---|
| | but not below a value of 1. |
| 011 | Load the value of G as adjusted in either step 009 or 010 into the latch 580. |

The foregoing steps update the value of G loaded into the latch 580 upon the basis of the new audio signals as read into the microcomputer 568 via the A/D converter 578. In the following steps, the microcomputer synthesizes the modulated pilot, based upon this new value of G. This program thus essentially synthesizes a signal having the form:

$$\text{pilot} = \text{Cos}[w_p t + \sum_{t=0}^{t} (G(t) - 1)] \quad (12)$$

This equation defines a pilot signal which has a center frequency of $w_p$ but which is frequency modulated with the gain signal G. In synthesizing this signal, the microcomputer 568 may perform the following steps:

| Step | Description |
|---|---|
| 012 | Subtract a value of 1 from the new value of G. |
| 013 | Add the result of step 012 to the old sum. |
| 014 | Subtract $2\pi$if the result of step 013 is greater than $2\pi$. |
| 015 | Read the time T (from a timer, not separately shown in FIG. 34 which overflows every $2\pi/w_p$). |
| 016 | Multiply T by $w_p$. |
| 017 | Add the results of step 016 to the results of step 014. |
| 018 | Subtract $2\pi$ if the result of step 016 is greater than $2\pi$. |
| 019 | Evaluate the cosine of the value resulting from step 018. |
| 020 | Load D/A converter 582 with rhe result of step 019 to thereby provide an analog output signal corresponding to the pilot. |
| 021 | Return to step 001. |

If the microcomputer 568 is fast enough, it can be used to perform even more of the functions required of the circuit of FIG. 34. Thus, both the digital attenuator 540, summer 62, matrix circuit 450, and QAM TX 50 can be either eliminated or substantially simplified by programming the microcomputer 568 to instead perform these functions.

In the embodiment of FIG. 35, the L and R signal sources 36 and 38 provide their audio signals directly to the multiplexing A/D converter 578 for conversion to digital signals to be read into the microcomputer 568. The microcomputer 568 will cyclically read the values of the left and right signals, and will in each cycle calculate from these values a value corresponding to the instantaneous amplitude and instantaneous phase of the desired composite modulated signal (including both a varying gain quadrature phase component and a pilot signal). The instantaneous AM and PM digital values will be loaded one after the other into a D/A converter 582, which will convert each to a corresponding analog value. Sample-and-hold circuits 584 and 586 will be controlled by the microcomputer 568 to alternately respond to the analog signals provided at the output of D/A converter 582, hence each will provide at its output a corresponding one of the AM and PM values being provided by the microcomputer 568.

The AM analog values loaded into sample-and-hold circuit 584, when filtered by a filter, not shown, will correspond to the desired envelope of the composite modulated signal which is to be transmitted. Similarly, the analog signal provided at the output of sample-and-hold circuit 586 will vary with the desired phase variations of the resulting composite modulated signal. A phase modulator 588 phase modulates an RF signal provided by an oscillator 590 to provide an RF signal whose phase varies in accordance with the phase signal provided at the output of sample-and-hold circuit 586. A conventional AM transmitter 592 may then be used to amplify the RF signal provided by phase modulator 588, amplitude modulate it with the AM signal provided by sample-and-hold circuit 584, and then transmit it.

The remaining FIGS. 36–43 illustrate certain alternative embodiments for receivers used for receiving the modulated signals generated by the transmitters which have heretofore been described. In general, it will be appreciated that for each of the transmitters which has been described, a receiver employing similar concepts is possible.

Figure 36:
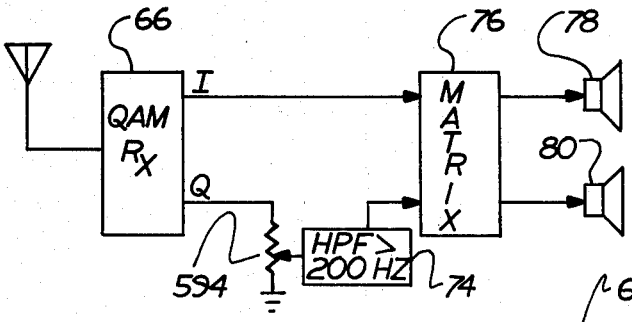
FIG. 36 is a block diagram of a receiver for receiving and demodulating signals generated by modulators in accordance with the teachings of the present invention, and including a manually adjustable stereo blend control.

FIG. 36 illustrates a much simplified receiver for receiving the composite modulated signal in accordance with the teachings of the present invention. This receiver corresponds generally to the receiver illustrated in FIG. 4, except that no circuitry is provided in the quadrature-phase channel for dynamically varying the gain thereof in accordance with a pilot signal. Instead, the quadrature-phase component is divided down by a constant amount set by a potentiometer 594. This receiver may be thought of as a "fixed angle" receiver in that the signals provided at the output of matrix 76 and 78 will have minimum crosstalk (maximum separation) only when the phase angle between the modulated L and R vectors of the received signal has a value corresponding to the Q channel attenuation setting of potentiometer 594. By varying the setting of the potentiometer 594, the phase angle for which the receiver is optimized may be varied. Preferably, the control for potentiometer 594 will be located to be readily accessible to the operator, so that he may adjust it as desired.

Figure 37:
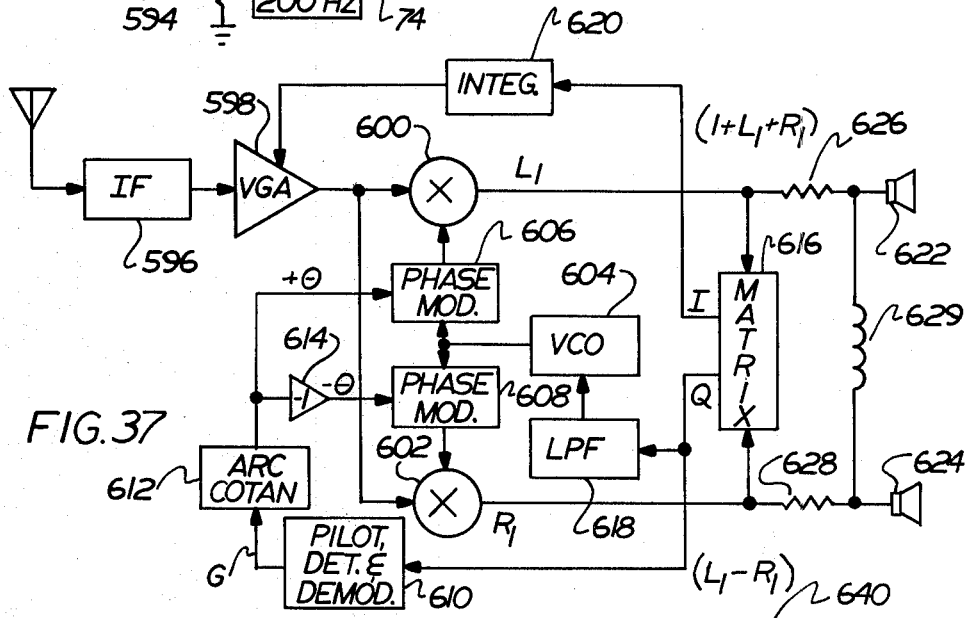
FIG. 37 is broad block diagram of another embodiment of a receiver in accordance with the teachings of the present invention.
Figure 38:
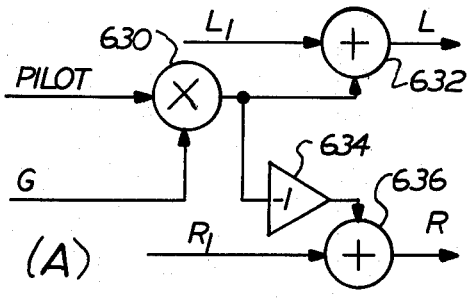
FIGS. 38A and B illustrate two different pilot elimination circuits useful in a receiver system such as that illustrated in FIG. 37.
Figure 38:
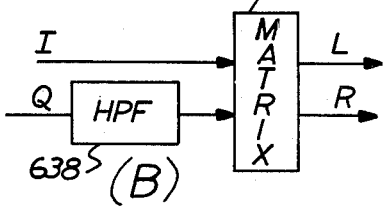
Figure 41:
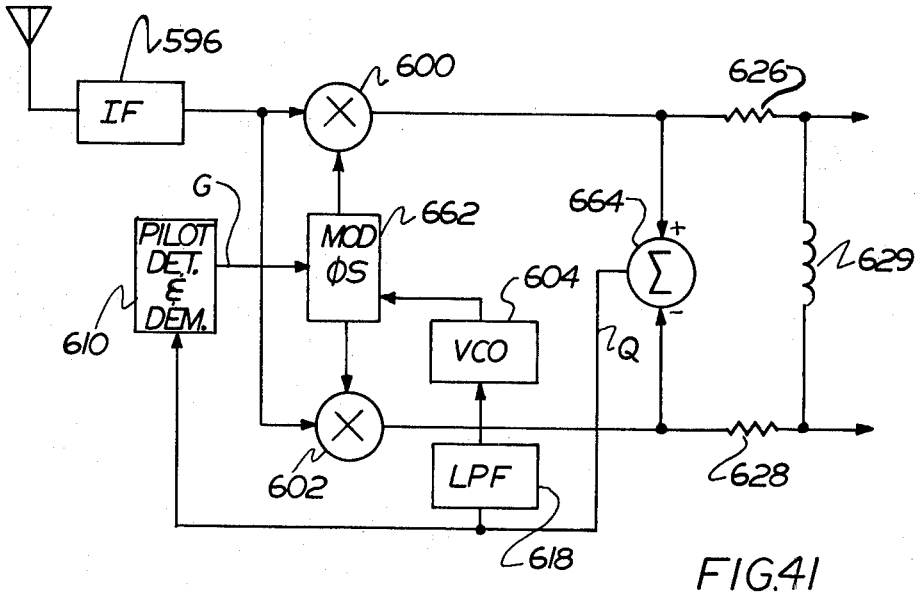
FIG. 41 is a block diagram of a receiver similar to that of FIG. 37, but employing a modified phase shifter.

FIG. 37 illustrates a receiver corresponding conceptually to the transmitter of FIG. 25. Thus, in the receiver of FIG. 37 the received signal is demodulated by varying the phase angle between carrier signals utilized to demodulate the L and R signals directly from the transmitted signal. The incoming signal is first shifted to an intermediate frequency by an IF circuit 596, and then is gain adjusted by a variable gain amplifier 598, controlled in a fashion to be described hereinafter. The gain shifted RF signal provided at the output of variable gain amplifier 598 is supplied to two product detectors 600 and 602, also provided with carriers phased so that the output signal provided thereby directly corresponds to the L and R signals. More specifically, a voltage controlled oscillator (VCO) 604 provides an IF signal at its output which is in phase quadrature with the carrier of the IF composite modulated signal at the output of IF circuit 596. This quadrature-phase IF signal is phase modulated by two phase modulators 606 and 608. These phase modulators phase displace the IF signal provided by VCO 604 by equal amounts, but in opposite directions, providing the resulting phase shifted IF signals to product detectors 600 and 602.

As long as the angle of modulation provided by phase modulators 606 and 608 corresponds with the angles separating the modulated L and R components of the composite modulated signal from the carrier signal, then the output signal provided by the two product detectors 600 and 602 will correspond to the L and R vectors, themselves (plus additional, higher frequency components which can easily be filtered out).

In the FIG. 37 receiver, the phase modulators 606 and 608 are adjusted to track the phase of the incoming signal by means of a pilot detector and demodulator 610. Of course, the signal provided at the output of the pilot detector and demodulator corresponds to the gain signal G, rather than the phase angle $\theta$ which must be used to control the phase modulators 606 and 608. Consequently, some means must be provided for converting the gain signal G into the phase angle signal $\theta$. From equation (3), above, it can be concluded that the phase angle $\theta$ is equal to arc cotan G. The receiver of FIG. 37 includes a function generator 612 having an arc cotangent transfer function. As with the function generators, this function generator 612 may be simply a non-linear amplifier having a transfer function which is a piecewise-linear approximation of the arc contangent function.

The signal at the output of circuit 612 will correspond with phase angle signal $\theta$, and may be provided directly to phase modulator 606 for controlling the phase angle of the signal provided thereto by the VCO 604. The same signal will be provided to phase modulators 608 through an inverting amplifier 614. Thus, phase modulator 608 will phase displace the RF carrier signal by an amount which is of equal magnitude, but of opposite polarity of the phase shift provided by phase modulator 606.

The audio signals recovered by product detectors 600 and 602 are combined in matrix 616 to once again synthesize the in-phase (1+L+R) and quadrature-phase (L−R) components. The quadrature-phase component is provided to the pilot detector and demodulators 610, which filters out the pilot signal and demodulate it in the fashion described previously with respect to FIGS. 11–13, and is also provided to a low-pass filter 618. The signal at the output of the low-pass filter 618 controls the voltage-controlled oscillator (VCO) 604, thereby completing a phase-locked loop. In operation, this phase-locked loop will automatically lock the signal provided by VCO 604 into phase-quadrature with the IF frequency of the signal provided at the output of variable gain amplifier 698.

From equation (2), above, it will be recalled that the L and R vectors of the composite modulated signal are modulated by a factor corresponding to the secant of the phase angle $\theta$. Consequently, the L and R signals detected by product detectors 600 and 602 will vary in gain dependent upon the secant of the phase angle $\theta$ between the two vectors. To eliminate this gain variation, the (1+L+R) output of matrix 616 is provided to an integrator 620, whose output is connected to the control input of the variable gain amplifier 598. The integrator 620 and variable gain amplifier 598 represent an automatic gain control loop similar to the gain control loops described previously with respect to FIGS. 15 and 25. In operation, the effect of the loop will be to control the gain of the variable gain amplifier 598 so that the DC component (i.e., the "1" in the (1+L+R) mathematical description of the sum signal) has a constant value, thereby necessarily stabilizing the gain of the L and R components.

In the circuitry of FIG. 37, the output signals provided by detectors 600 and 602 will include a low-frequency component corresponding to the pilot signal therein. Consequently, some means must be provided for removing this from the signal prior to reproduction with the utilization means, indicated in FIG. 37 as speakers 622 and 624. In the FIG. 37 embodiment, the pilot signal is effectively cancelled by cross coupling the L and R channels with an inductor 629, which is in turn isolated from the outputs of detectors 600 and 602 by respective resistors 626 and 628. Since the pilot signal component is of equal magnitude but of opposite polarity in the L and R signals, it will be cancelled therefrom if the two signals are added together. The effect of resistors 626 and 628 and inductor 629 is to essentially add the L and R signals together at low frequencies, while maintaining high separation therebetween at higher frequencies. Consequently, the pilot signal is cancelled.

FIGS. 38A and B represent two other methods by which the pilot signal could be eliminated. It will be recalled from the description of FIG. 13 that the pilot detector and demodulator effectively recovers a signal corresponding to the modulated pilot signal. This pilot signal, if properly processed, can be added to the L and R signals to produce the cancellation of the components introduced therein.

In the FIG. 38A embodiment, the pilot signal provided by the pilot detector and demodulator 610 is modulated in a multiplier 630 by the gain signal G, also recovered by the pilot detector and demodulator. This is necessary since the gain correction introduced by integrator 620 and variable gain amplifier 598 modulates the amplitude of the pilot signal along with the amplitudes of the L and R signals. The resulting gain modified pilot signal is then added directly into the L signal by means of an adder 632 and is subtracted from the R signal by first inverting it with an inverter 634 and then adding it to the R signal with an adder 636. The resulting L and R signals provided at the outputs of adder 632 and 636 lack a pilot component, and may be directly supplied to the utilization means.

In the FIG. 38B embodiment, the Q output of matrix circuit 616 is filtered by a high-pass filter 638 to eliminate the pilot signal therefrom. A matrix circuit 640 then adds and subtracts the I output of matrix 616 and the output of high-pass filter 638 to thereby recover L and R signals from which the pilot signal has been eliminated.

Figure 39:
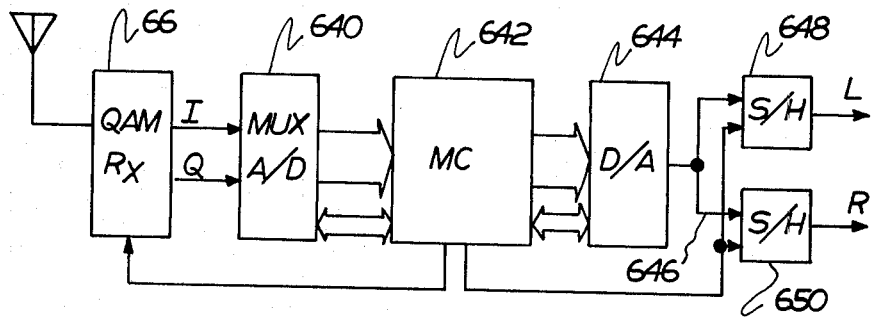
FIG. 39 is a block diagram of a microcomputer-oriented receiver for receiving and demodulating signals generated in accordance with the teachings of the present invention.

FIG. 39 represents a receiver utilizing microcomputer control to perform the functions performed in previous embodiments with dedicated analog circuits. The receiver of FIG. 39 therefore conceptually corresponds to the transmitter of FIG. 35. In the FIG. 39 embodiment, the output of the QAM receiver 66 is provided to a multiplexing A/D converter 642 which provides digitized signals to a microcomputer 642. The microcomputer 642 processes the digital I and Q signals provided by A/D 640, and performs the required gain shifting and pilot cancellation functions by manipulating these digital values. The resulting processed, digital I and Q values are then added and subtracted to recover digital versions of the L and R signals. These digital L and R signals are supplied cyclically and alternately to a D/A converter 644, which provides the corresponding analog signals on an output line 646 thereof. Two sample-and-hold circuits 648 and 650 are controlled by the microcomputer 642 to each sample the output of D/A converter 644 when the output thereof represents an associated one of the L and R signals. The resulting analog L and R signals may be filtered and provided to utilization means in any conventional manner. Of course, in an embodiment such as that illustrated in FIG. 39, the microcomputer 642 may also perform other functions, such as controlling a frequency synthesizer in the QAM receiver 66, performing additional processing of the L and R signals (tone control, balance, etc.) prior to supplying them to the two sample-and-hold circuits 648 and 650, and providing read-outs of appropriate information to the user.

Although the microcomputer is illustrated in FIG. 39 as responding to I and Q signals, similar receivers may also be provided to operate on other input signals. Thus, the circuit 66 may instead provide envelope and phase signals to the microcomputer, or even envelope and frequency signals. The microcomputer 642 can in all cases be programmed to perform the signal manipulation necessary to recover the L and R signals therefrom.

Figure 40:
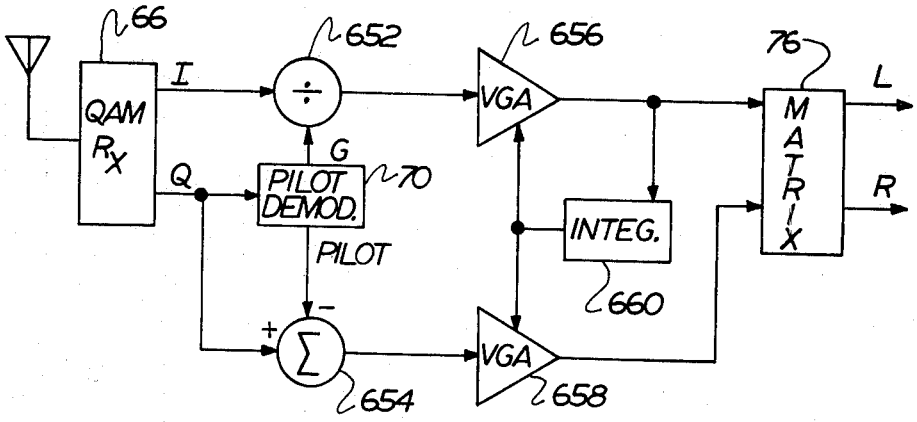
FIG. 40 is a block diagram of still another receiver for receiving and demodulating signals in accordance with the teachings of the present invention, wherein the gain of the in-phase channel is varied.

The FIG. 40 receiver embodiment is similar in many respects to the receiver of FIG. 4, except that the gain adjustment is provided in the in-phase channel, rather than in the quadrature-phase channel. A divider circuit 652 divides the in-phase signal provided at the output of QAM receiver 66, by the gain signal G provided by a pilot detector and demodulator 70. In this embodiment, the summing circuit 654 provides the pilot cancellation function of summing circuit 348 of FIG. 13.

Although the gain of the signal at the output of divider circuit 652 will be substantially equal to the gain of the signal in the quadrature-phase channel, both signals will vary in gain in accordance with the gain signal G, thereby introducing variations in the apparent loudness of the subsequently recovered L and R signals. To eliminate this, an automatic gain control circuit is provided, comprising two variable gain amplifiers 656 and 658, both controlled in unison by the output of an integrator circuit 660. In the FIG. 40 embodiment, the integrator 660 and variable gain amplifiers 656 and 658 again perform essentially the same function as the integrator 620 and variable gain amplifier 598 of FIG. 37. Thus, the integrator 660 automatically adjusts the gain of the variable gain amplifiers 656 and 658 so that the DC component of the gain adjusted I channel is substantially constant. The inherent result of this is to stabilize the gain of the audio frequency signals in the I and Q channels. As in the FIG. 4 embodiment, the resulting signals are then provided to a matrix circuit 76 which adds and substracts them to recover the L and R audio signals therefrom.

Figure 42:
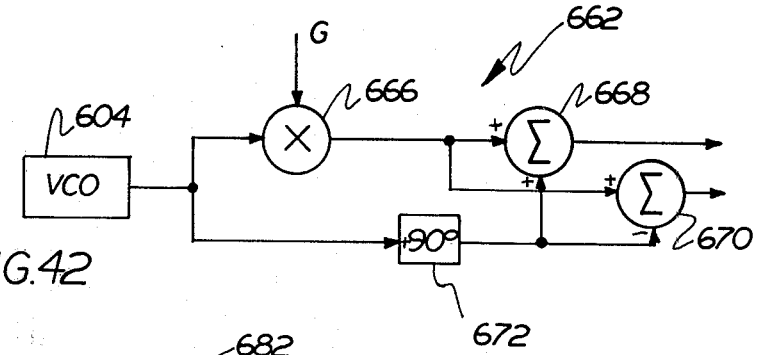
FIG. 42 is a block diagram of a modified phase shifter such as could be used in the receiver of FIG. 41.

FIG. 42 illustrates still another receiver embodiment, generally similar to the one illustrated in FIG. 7, but utilizing a modified phase shifter to eliminate the need for gain correction and for conversion of the gain signal G into a phase angle signal $\theta$. As with the embodiment of FIG. 37, the FIG. 41 embodiment includes an RF stage 596, two product detectors 600 and 602, a pilot detector and demodulator 610, low-pass filter 618, voltage controlled oscillator (VCO) 604, and a pilot cancellation circuit consisting of resistors 626 and 628 and inductor 629.

Unlike the FIG. 37 embodiment, however, a modified phase shifter 662 is substituted for phase modulators 606 and 608.

The RF, phase displaced signals provided by modified phase shifter 662 will inherently be amplitude modulated so as to compensate for the varying gain of the L and R signals. This eliminates the need for the variable gain amplifier 598 and integrator 620 of FIG. 37, and permits a simple subtractor circuit 664 to be substituted for the matrix 616 of FIG. 37. Moreover, the modified phase shifter 662 phase displaces the RF carrier signal by the appropriate amount directly in response to the gain control signal G provided at the output of pilot detector and demodulator 610, thus eliminating the need for arc cotangent generator 612 and inverting amplifier 614.

FIG. 42 illustrates one form which this modified phase shifter 662 may take. In general, the modified phase shifter 662 of FIG. 42 generates the phase shifted RF carrier signals by modifying the relative gains of two quadrature-phase carriers, and then combining the resulting vectors. In this sense, it is somewhat similar to the modified phase shifter of FIG. 29.

More specifically, the modified phase shifter 662 of FIG. 42 includes a multiplier 666 for modulating the gain of the RF signal provided by voltage controlled oscillator 604 in accordance with the gain signal G. The resulting gain adjusted carrier signal is then combined with two phase shifted carrier signals in summing circuits 668 and 670. The phase shifted carrier signals are derived by a circuit 672 which phase shifts the carrier signal provided by oscillator 604 by 90°, providing the phase shifted signal along output lines to the two signal summers 668 and 670.

Figure 43:
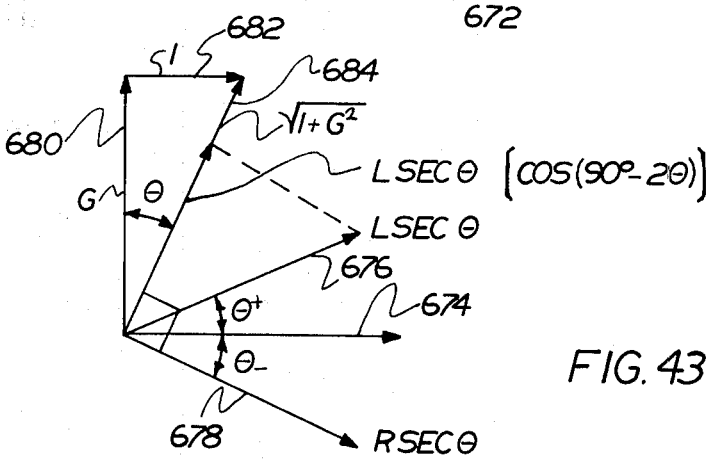
FIG. 43 is a vector diagram useful in understanding the operation of the modified phase shifter of FIG. 42.

The operation of the phase shifter 662 may be more readily understood through reference to the vector diagram of FIG. 43. In this Figure, the vector 674 represents the quiescent carrier, whereas vectors 676 and 678 respectively represent the left and right modulated vectors, phase displaced on either side of the carrier vector 674 by + and $-\theta$. The phase-locked loop consisting of summing circuit 664, low-pass filter 618 and VCO 604 of FIG. 41 will lock the RF carrier at the output of VCO 604 in phase quadrature with the carrier vector 674 of the incoming signal. In FIG. 43, the vector 680 represents this quadrature phase RF signal provided by voltage controlled oscillator 604. Due to the gain multiplication introduced by multiplier 666, the vector 680 will have a magnitude of G. The signal summer 668 combines the RF signal represented by vector 680 with the 90° phase shifted RF signal, represented by vector 682 in FIG. 43. This vector is illustrated in FIG. 43 as having a value of 1, since its gain is undisturbed. The vector 684 of FIG. 43 represents the signal at the output of adder 668, and is the vector sum of the two vectors 680 and 682. The magnitude of this vector is equal to:

$$V_{RF}=\sqrt{1+G^2} \tag{13}$$

From equation (2), above, it is known that the gain G is equal to Cot $\theta$, hence equation 13 may be rewritten as:

$$=\sqrt{1+[\cot\theta]^2} \tag{14}$$

$$=\text{Cosec}\,\theta \tag{15}$$

From basic trigonometric principles, it can be determined that the phase angle between the vectors 680 and 684 is identically equal to the phase angle $\theta$. Consequently the vector 684 is in phase quadrature with the vector 678.

The phase shifter 662 generates an RF signal phase shifted by $\theta$ on the other side of vector 680 (and therefore in phase quadrature with vector 676) by subtracting the 90° phase shifted signal from the gain adjusted signal in signal subtractor 670.

When the RF signal represented by vector 684 of FIG. 43, is multiplied by the incoming signal in product detector 600, the gain of the resulting signal will be equal to the magnitude of vector 684 times the image of vector 676 on vector 684. More specifically:

$$V_o = (\text{cosec } \theta) L \text{ Sec } \theta [\text{Cos } (90° - 2\theta)] \quad (16)$$

Utilizing the trigonometric identify for the cosine for the difference of the two angles, equation (16) may be rewritten as:

$$= L \text{ Sec } \theta \text{ Cosec } \theta [2\text{Sin } \theta \text{ Cos } \theta] \quad (17)$$
$$= 2L \quad (18)$$

Thus, the signal provided at the output of multiplier 600 will be equal to twice the left signal L. From a similar theoretical analysis it can be concluded that the signal provided at the output of product detector 602 will be equal to 2R.

In the described modulator embodiments, a number of different phase angle variation rules and methods have been used. These have included open and closed loop, and incremental and continuous distortion estimation. The circuit which selects the phase angle (or Q channel gain) may take other forms as well, however. For example, the envelope of the (L−R) signal could be detected and used as the gain control signal. Refinements of this approach would be to frequency weight the (L−R) signal before envelope detection and/or to normalize the gain control signal by dividing it by the envelope of the (L+R) signal. Other approaches may be used which, for example, examine the relative amplitudes and/or frequency distributions of the L and R signals and select a gain control signal accordingly. All of these approaches, and others, are within the scope of the present invention.

Therefore, although the invention has been described with respect to preferred embodiments, it will be appreciated that the described embodiments are exemplary only. Many permutations and combinations of the particular embodiments described herein as well as rearrangements and alterations of parts may be made without departing from the spirit and scope of the present invention, as defined in the appended claims.

What is claimed is:

1. A modulator comprising:

modulator means for providing a composite modulated signal having a subsonically varying quiescent carrier component, and adaptor means for separating said composite modulated signal into AF and RF components for application to AF and RF inputs of an AM transmitter, said adapter means including means responsive to said composite modulated signal to provide an envelope signal which varies as the envelope of said composite modulated signal, and means for subsonically adjusting the gain of said envelope signal so that its DC component remains substantially fixed, thereby reducing harmonic distortion resulting from AC coupling of said envelope signal into said AF input of said AM transmitter.

2. A modulator as set forth in claim 1, wherein said means for gain adjusting said envelope signal comprises filter means for filtering said envelope signal to provide a signal corresponding to the subsonic part of said envelope signal, and means for gain adjusting said envelope signal in accordance with said subsonic part provided by said filter means.

3. A modulator as set forth in claim 1, wherein said means for gain adjusting said envelope signal comprises amplifier means for amplifying said envelope signal by an amount which varies in accordance with a gain control signal provided thereto, and means responsive to the amplified envelope signal for providing said gain control signal.

4. A modulator as set forth in claim 3, wherein said gain control signal providing means comprises means for integrating the difference between a known D.C. level and the subsonically varying D.C. level of said amplified envelope signal and for providing a gain control signal which varies with said integral.

5. A modulator as set forth in claim 1, wherein said modulator means comprises means for providing a composite modulated signal including two phase displaced AM carrier components with the amplitude of each being modulated in accordance with a corresponding one of first and second signals and means for varying the phase displacement between said AM components in dependence upon characteristics of said first and second signals.

6. A modulator as set forth in claim 5, wherein said modulator means further comprises means for providing said gain adjusted envelope signal to said phase displacement varying means, and wherein said phase displacement varying means comprises means for varying said phase displacement in accordance with the extent to which said gain adjusted envelope of said composite modulated signal differs from a desired form.

7. A modulator as set forth in claim 6, wherein said composite modulated signal also includes a quiescent carrier component phased midway between said two phase displaced AM carrier components, and wherein said means for varying said phase displacement includes means for varying the gain of the component of said composite modulated signal which is in-phase with said quiescent carrier components so as to thereby vary said phase displacement, said adapter means varying the gain of said composite modulated signal so that the gain adjusted envelope provided thereby has a substantially fixed gain in-phase component but a varying gain component in phase-quadrature with said quiescent carrier.

8. An AM stereo modulator comprising means for providing two phase-displaced carrier signals, means for amplitude modulating each of said carrier signals in accordance with a corresponding one of first and second modulating signals, means for linearly combining the resulting amplitude modulated carriers to provide a composite modulated signal, and means for varying the phase displacement between said two phase-displaced carrier signals in dependence upon characteristics of said first and second modulating signals, and further comprising means for varying the gain of said composite modulated signal so as to stabilize the gain of the component thereof which is in-phase with the quiescent carrier of said composite modulated signal.

9. An AM stereo modulator as set forth in claim 8, wherein said gain varying means comprises means for demodulating the component of said composite modulated signal which is in-phase with said quiescent carrier, means for detecting the D.C. level of said demodulated in-phase component, and means for varying the gain of said composite modulated signal so that said D.C. level remains substantially constant.

10. An AM stereo modulator comprising means for providing two phase-displaced carrier signals, means for amplitude modulating each of said carrier signals in accordance with a corresponding one of first and second modulating signals, means for linearly combining the resulting amplitude modulated carriers to provide a composite modulated signal, and means for varying the phase displacement between said two phase-displaced carrier signals in dependence upon characteristics of said first and second modulating signals, and further comprising adapter means for separating said composite modulated signal into AF and RF components for application to AF and RF inputs an AM transmitter, said adapter means including means responsive to said composite modulated signal to provide an envelope signal which varies as the envelope of said composite modulated signal, and means for adjusting the gain of said envelope signal so that the level of its D.C. component remains substantially fixed.

11. An AM stereo modulator comprising means for providing two phase-displaced carrier signals, means for amplitude modulating each of said carrier signals in accordance with a corresponding one of first and second modulating signals, means for linearly combining the resulting amplitude modulated carriers to provide a composite modulated signal, and means for varying the phase displacement between said two phase-displaced carrier signals in dependence upon characteristics of said first and second modulating signals, wherein said means for providing said two phase-displaced carrier signals includes means for providing two phase-displaced carrier signals whose amplitudes vary in accordance with the secant of one-half the phase angle between said two phase-displaced carrier signals.

12. An AM stereo modulator comprising means for providing two phase-displaced carrier signals, means for amplitude modulating each of said carrier signals in accordance with a corresponding one of first and second modulating signals, means for linearly combining the resulting amplitude modulated carriers to provide a composite modulated signal, and means for varying the phase displacement between said two phase-displaced carrier signals in dependence upon characteristics of said first and second modulating signals, further including means for providing a pilot signal having a characteristic which varies in a known dependence upon said phase displacement, and means for combining said pilot signal with said composite modulated signal.

13. An AM stereo modulator as set forth in claim 12, wherein said means for providing said pilot signal comprises means for providing a pilot signal having a characteristic which varies as the cotangent of one-half the phase angle between said two-phase displaced carrier signals, whereby said characteristic varies in accordance with relative gain variations between the in-phase and quadrature-phase components of said composite modulated signal.

14. An AM stereo modulator comprising means for providing two phase-displaced carrier signals, means for amplitude modulating each of said carrier signals in accordance with a corresponding one of first and second modulating signals, means for linearly combining the resulting amplitude modulated carriers to provide a composite modulated signal, and means for varying the phase displacement between said two phase-displaced carrier signals in dependence upon characteristics of said first and second modulating signals, wherein said means for providing said two phase-displaced carrier signals comprises means for providing a first carrier signal, and phase shifter means responsive to said carrier signal and to a phase displacement control signal for providing two phase-displaced carriers equally phase displaced on either side of said first carrier signal by an amount which varies in accordance with said phase displacement control signal.

15. An AM stereo modulator as set forth in claim 14, wherein said phase shifter means comprises means responsive to said first carrier signal to provide a second carrier signal phase shifted by 90° relative to said first carrier signal, means for adjusting the amplitude of said second carrier signal in inverse dependence upon said phase displacement control signal, and means for combining said first carrier signal and amplitude adjusted second carrier signal to provide said two phase-displaced carriers.

16. An AM stereo modulator as set forth in claim 15, wherein said means for combining comprises adder means for adding said first carrier signal and amplitude adjusted second carrier signal to provide a sum signal representing one of said two phase displaced carriers, and means for subtracting said first carrier signal and amplitude adjusted second carrier signal to provide a difference signal representing the other of said two phase displaced carriers.

17. An AM stereo modulator as set forth in claim 14, wherein said phase shifter means comprises means responsive to said phase displacement control signal for providing said two phase-displaced carrier signals have a phase displacement therebetween which varies in accordance with twice the arctangent of the reciprocal of said phase displacement control signal and having amplitudes which vary in accordance with the secant of one-half of said phase displacement.

18. An AM stereo modulator comprising means for providing first and second signals, and means responsive to said first and second signals to provide two phase-displaced AM carrier components with the amplitude of each of said AM components being modulated in accordance with a corresponding one of said first and second signals, and with the phase displacement being varied between discrete incremental values in dependence upon characteristics of said first and second signals.

19. An AM stereo modulator comprising means for providing in-phase and quadrature-phase modulating signals, means for varying the relative gains of said in-phase and quadrature-phase modulating signals between discrete incremental values in accordance with at least one characteristic of said signals, and QAM modulating means for modulating the in-phase and quadrature-phase components of a QAM signal with the relative gain varied in-phase and quadrature-phase modulating signals.

20. An AM stereo modulator as set forth in claim 19, wherein said relative gain varying means comprises means responsive to said in-phase and quadrature-phase modulating signals for providing a control signal having a value which varies in accordance with said at least one characteristic of said signals, and means responsive to said control signal for setting said relative gains of said in-phase and quadrature-phase modulating signals at a discrete incremental value associated with said value of said control signal.

21. An AM stereo modulator as set forth in claim 19, wherein said relative gain varying means comprises means responsive to said relative gain varied in-phase and quadrature-phase modulating signals for providing a feedback signal having a value which varies with the residual extent of said at least one characteristic in said relative gain varied modulating signals, and means responsive to said feedback signal for incrementing or decrementing said discrete incremental value of said relative gain in accordance with said feedback signal.

22. An AM stereo modulator as set forth in claim 19, wherein said relative gain varying means includes a microcomputer.

23. An AM stereo demodulator comprising means for receiving a composite modulated signal including at least two phase displaced AM carrier components, the amplitude of each of said components being modulated in accordance with a corresponding one of first and second signals, with the phase displacement between said AM components varying in dependence upon characteristics of said first and second signals, and means for recovering said first and second signals from said composite modulated signal, said recovering means comprising means for providing first and second phase reference signals, each varying in phase so as to remain substantially in phase-quadrature with a corresponding one of said two phase displaced AM carrier components, and first and second demodulator means each responsive to said composite modulated signal for synchronously demodulating said composite modulated signal in accordance with a corresponding one of said phase reference signals whereby said first and second signals are thereby recovered from said composite modulated signal.

24. An AM stereo demodulator as set forth in claim 23, wherein the gain of said first and second signals modulating said phase displaced AM carrier components varies with said phase displacement, and wherein said AM stereo demodulator further comprises gain control means for controlling the gain of the recovered first and second signals so as to compensate for said gain variations.

25. An AM stereo demodulator as set forth in claim 24, wherein said gain control means comprises variable gain amplifier means responsive to said received composite modulated signal for controlling the gain thereof in accordance with a gain control signal for providing a gain corrected composite modulated signal to said first and second demodulator means, and control means responsive to said recovered first and second signals for providing said gain control signal.

26. An AM stereo demodulator as set forth in claim 25, wherein said control means comprises means for adding together said recovered first and second signals to provide a sum signal having a D.C. level which varies with the gain of said recovered first and second signals, and means for providing a said gain control signal in accordance with said D.C. level.

27. An AM stereo demodulator as set forth in claim 23, wherein said received composite modulated signal includes a pilot component modulated in accordance with a pilot signal having a value which varies as a function of said phase displacement, and wherein said demodulator further includes means for recovering said pilot signal from said composite modulated signal and means for controlling the phases of said phase reference signals as a function of said value of said recovered pilot signal.

28. An AM stereo demodulator as set forth in claim 27, wherein said composite modulated signal includes a quiescent carrier phased midway between said two phase displaced AM carrier components and wherein said means for controlling the phases of said phase reference signals comprises means for providing a recovered carrier signal in phase quadrature with said quiescent carrier of said composite modulated signal, first and second phase shifter means responsive to said recovered carrier and to said value of said recovered pilot signal for respectively providing said first and second phase reference signals, phase displaced by equal amounts on either side of said recovered carrier, said phase shifter means shifting the phases of said phase reference signals relative to said recovered carrier in functional dependence upon said value of said pilot signal.

29. An AM stereo demodulator as set forth in claim 28, wherein said first and second phase shifter means shift the phases of said phase reference signals relative to said recovered carrier by equal and opposite angles which each vary as the arc cotangent of said pilot signal value.

30. An AM stereo demodulator as set forth in claim 29, wherein said first and second phase shifter means also modulate the amplitudes of said phase reference signals in accordance with the cosecant of the phase displacement between said phase reference signals and said recovered carrier.

31. An AM stereo demodulator comprising means for receiving a QAM signal having a quadrature-phase component whose gain varies in accordance with variations in a pilot signal also received by said means, QAM demodulator means for demodulating said QAM signal to recover in-phase and quadrature-phase modulating signals therefrom, and means for adjusting the gain of said recovered in-phase modulating signal in accordance with said variations in said pilot signal so that said recovered in-phase modulating signal varies in gain substantially the same as does said gain varying quadrature-phase component, whereby the ratio of the gains of said recovered in-phase and quadrature-phase modulating signals remains substantially constant.

32. An AM stereo demodulator as set forth in claim 31 and further comprising gain stabilizing means responsive to said recovered quadrature-phase and gain adjusted in-phase modulating signals for gain stabilizing said signals to provide substantially fixed gain in-phase and quadrature-phase modulating signals at the output thereof.

33. An AM stereo demodulator as set forth in claim 32, wherein said recovered in-phase modulating signal includes a D.C. component whose level is adjusted by said gain adjusting means, and wherein said gain stabilizing means comprises first and second variable gain amplifier means each responsive to a gain control signal and to a corresponding one of said recovered quadrature-phase and gain adjusted in-phase modulating signals for amplifying said corresponding one of said signals by an amount which varies in accordance with said gain control signal, and means for providing said gain control signal to said first and second variable gain amplifier means and responsive to said D.C. component of the amplified in-phase modulating signal provided at the output of the corresponding one of said first and second variable gain amplifier means for varying said gain control signal so that said D.C. component remains substantially fixed.

34. An AM stereo modulator comprising means for providing first and second signals, means responsive to said first and second signals to provide two phased displaced AM carrier components with the amplitude of each being modulated in accordance with a corresponding one of said first and second signals, and with the phase displacement between said AM components being varied in accordance with a phase displacement control signal, means for providing sum and difference signals corresponding to the sum of and difference between said first and second signals, means for comparing said sum and difference signals with preset limits, and means for providing said phase displacement control signal in accordance with the results of said comparisons.

35. An AM stereo demodulator comprising means for receiving a QAM signal whose in-phase component is modulated in accordance with the sum of first and second signals and whose quadrature-phase component is modulated in accordance with the difference between said first and second signals, said quadrature-phase component having a gain which varies with time, QAM demodulator means for demodulating said QAM signal to recover in-phase and quadrature-phase modulating signals therefrom, means for manually adjusting the relative gains of said recovered in-phase and quadrature-phase modulating signals, and means for adding said gain adjusted modulating signals to one another to recover a third signal and for subtracting said gain adjusted modulating signals from one another to recover a fourth signal.

* * * * *